US008535861B2

(12) United States Patent
Haruyama et al.

(10) Patent No.: US 8,535,861 B2
(45) Date of Patent: Sep. 17, 2013

(54) IMAGE FORMING APPARATUS AND PROCESS CARTRIDGE

(75) Inventors: Daisuke Haruyama, Kanagawa (JP); Masahiro Iwasaki, Kanagawa (JP); Takayuki Yamashita, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 804 days.

(21) Appl. No.: 12/556,254

(22) Filed: Sep. 9, 2009

(65) Prior Publication Data

US 2010/0247148 A1 Sep. 30, 2010

(30) Foreign Application Priority Data

Mar. 27, 2009 (JP) ..... 2009-080154

(51) Int. Cl.
*G03G 15/00* (2006.01)

(52) U.S. Cl.
USPC ..... 430/66; 399/121; 399/123

(58) Field of Classification Search
USPC ..... 399/121, 123; 430/66
See application file for complete search history.

(56) References Cited

U.S. PATENT DOCUMENTS

| | | | |
|---|---|---|---|
| 4,724,194 | A | 2/1988 | Shirai et al. |
| 5,283,145 | A | 2/1994 | Nukada et al. |
| 5,290,928 | A | 3/1994 | Nukada et al. |
| 5,298,617 | A | 3/1994 | Nukada et al. |
| 5,302,479 | A | 4/1994 | Daimon et al. |
| 5,308,728 | A | 5/1994 | Imai et al. |
| 5,338,636 | A | 8/1994 | Nukada et al. |
| 5,358,813 | A | 10/1994 | Iijima et al. |
| 5,378,569 | A | 1/1995 | Nukada et al. |
| 5,393,629 | A | 2/1995 | Nukada et al. |
| 5,416,207 | A | 5/1995 | Imai et al. |
| 5,459,004 | A | 10/1995 | Daimon et al. |
| 5,463,043 | A | 10/1995 | Nukada et al. |
| 5,639,581 | A | 6/1997 | Iwasaki et al. |
| 5,734,003 | A | 3/1998 | Iwasaki et al. |
| 2002/0119382 | A1 | 8/2002 | Nakata et al. |
| 2004/0142258 | A1 | 7/2004 | Fukushima et al. |
| 2005/0181291 | A1 | 8/2005 | Kami et al. |
| 2006/0210311 | A1 | 9/2006 | Kakui et al. |

(Continued)

FOREIGN PATENT DOCUMENTS

| | | |
|---|---|---|
| JP | A 56-51749 | 5/1981 |
| JP | GB 2 098 822 A | 11/1982 |

(Continued)

OTHER PUBLICATIONS

Machine English language translation of JP 2007086202 Apr. 2007.*

(Continued)

*Primary Examiner* — Hoa V Le
(74) *Attorney, Agent, or Firm* — Oliff & Berridge, PLC

(57) ABSTRACT

There is provided an image forming apparatus including electrophotographic photoreceptor, a charging unit, an electrostatic latent image forming unit, a developing unit, and a residual toner removing unit, the surface protective layer of the electrophotographic photoreceptor having a surface free energy of about 10 mN/m to about 30 mN/m, the toner in the developing unit includes silica, and the residual toner removing unit including a blade member including a base layer and an edge layer having a type A durometer hardness of from about HsA 75 to about HsA 90 at 23° C., the hardness of the edge layer being higher than the hardness of the base layer.

16 Claims, 6 Drawing Sheets

(56) References Cited

U.S. PATENT DOCUMENTS

| | | | |
|---|---|---|---|
| 2008/0241716 | A1 | 10/2008 | Ishikawa et al. |
| 2009/0004583 | A1 | 1/2009 | Nukada et al. |
| 2010/0008707 | A1 | 1/2010 | Sako et al. |

FOREIGN PATENT DOCUMENTS

| | | | |
|---|---|---|---|
| JP | A 60-22131 | | 2/1985 |
| JP | A 4-189873 | | 7/1992 |
| JP | A 5-98181 | | 4/1993 |
| JP | A 5-99737 | | 4/1993 |
| JP | A 5-140472 | | 6/1993 |
| JP | A 5-140473 | | 6/1993 |
| JP | A 5-263007 | | 10/1993 |
| JP | A 5-279591 | | 10/1993 |
| JP | A 8-176293 | | 7/1996 |
| JP | A 8-208820 | | 8/1996 |
| JP | A 8-278645 | | 10/1996 |
| JP | A 2002-82469 | | 3/2002 |
| JP | A-2002-214990 | | 7/2002 |
| JP | A 2003-186234 | | 7/2003 |
| JP | A 2004-205542 | | 7/2004 |
| JP | A 2004-264359 | | 9/2004 |
| JP | A 2004-317950 | | 11/2004 |
| JP | A 2004-341136 | | 12/2004 |
| JP | A 2005-292470 | | 10/2005 |
| JP | A-2006-267652 | | 10/2006 |
| JP | A-2007-086202 | | 4/2007 |
| JP | A-2009-031719 | | 2/2009 |
| JP | A-2009-031721 | | 2/2009 |
| WO | WO 2008/093536 | A1 | 8/2008 |
| WO | WO 2009/004898 | A1 | 1/2009 |

OTHER PUBLICATIONS

Aug. 23, 2011 Office Action issued in Japanese Application No. 2009-080154 (with translation).

European Search Report issued in corresponding European Patent Application No. 10156215 mailed Jul. 23, 2010.

* cited by examiner

IMAGE FORMING APPARATUS AND PROCESS CARTRIDGE

CROSS-REFERENCE TO RELATED APPLICATIONS

This application is based on and claims priority under 35 USC 119 from Japanese Patent No. 2009-080154 filed on Mar. 27, 2009.

BACKGROUND

1. Technical Field

The present invention relates to an image forming apparatus and a process cartridge.

2. Related Art

Recently, attention has been focused on increasing the speed and extending the operational lifetime of image forming apparatuses including a charging means, an exposure means, a developing means, a transfer means and a fixing means, in other words, xerographic image forming apparatuses, as a result of technological developments in these members and systems. Similarly, demands for increased response speeds and increased reliability of subsystems have also intensified. In this regard, electrophotographic photoreceptors used for image forming are exposed to large outside electrical and mechanical forces due to chargers, developing devices, transfer devices, cleaners and the like, and thus are susceptible to image defects such as scratches, abrasion, cracking and the like. Therefore, there is specifically a strong demand for improved response speeds and reliability.

In order to suppress scratches, abrasions and the like, and to improve operational lifetime, resins having high mechanical strength may be used for electrophotographic photoreceptors.

SUMMARY

According to an aspect of the invention, there is provided an image forming apparatus, including an electrophotographic photoreceptor including an electroconductive substrate, and a photosensitive layer and a surface protective layer disposed on the electroconductive substrate in this order; a charging unit that charges the electrophotographic photoreceptor; an electrostatic latent image forming unit that forms an electrostatic latent image on the charged electrophotographic photoreceptor; a developing unit that develops the electrostatic latent image formed on the electrophotographic photoreceptor using a toner to form a toner image; a transfer unit that transfers the toner image on a transfer medium; and a residual toner removing unit that removes the toner remaining on the electrophotographic photoreceptor after transfer of the toner Image, the surface protective layer of the electrophotographic photoreceptor having a surface free energy of from about 10 mN/m to about 30 mN/m, the toner in the developing unit including silica, and the residual toner removing unit including a blade member including a base layer and an edge layer having a type A durometer hardness of from about HsA 75 to about HsA 90 at 23° C., the hardness of the edge layer being higher than the hardness of the base layer.

BRIEF DESCRIPTION OF THE DRAWINGS

Exemplary embodiments of the present invention will be described in detail based on the following figures, wherein.

DETAILED DESCRIPTION

Figure 1:
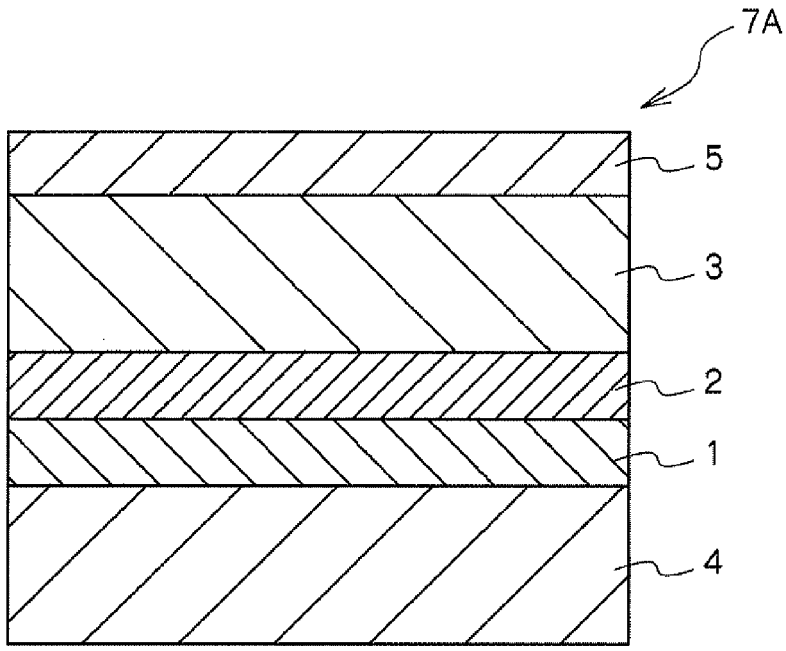
FIG. 1 is a schematic partial cross-sectional view of an electrophotographic photoreceptor of an exemplary embodiment.

The image forming apparatus of this exemplary embodiment includes an electrophotographic photoreceptor including an electroconductive substrate, and a photosensitive layer and a surface protective layer disposed on the electroconductive substrate in this order; a charging unit that charges the electrophotographic photoreceptor; an electrostatic latent image forming unit that forms an electrostatic latent image on the charged electrophotographic photoreceptor; a developing unit that develops the electrostatic latent image formed on the electrophotographic photoreceptor using a toner to form a toner image; a transfer unit that transfers the toner image on a transfer medium; and a residual toner removing unit that removes the toner remaining on the electrophotographic photoreceptor after transfer of the toner image, the surface protective layer of the electrophotographic photoreceptor having a surface free energy of from 10 mN/m (or about 10 mN/m) to 30 mN/m (or about 30 mN/m), the toner in the developing unit including silica, and the residual toner removing unit including a blade member including a base layer and an edge layer having a type A durometer hardness of from HsA 75 (or about HsA 75) to HsA 90 (or about HsA 90) at 23° C., the hardness of the edge layer being higher than the hardness of the base layer.

Hereinafter the image forming apparatus of the exemplary embodiment is described in detail.

In the following description, the electrophotographic photoreceptor (also may be referred to as "photoreceptor"), the toner and the residual toner removing unit (hereinafter may also be referred to as "cleaning device") that are constitutional elements of the image forming apparatus of the exemplary embodiment are first explained, and examples of the image forming apparatus and the process cartridge are then explained.

In the present specification, the numerical range shown by using "to" refers to a range that includes the numerical values described before and after the "to" as the minimum value and the maximum value, respectively.

Electrophotographic Photoreceptor

First, the electrophotographic photoreceptor of the exemplary embodiment is specifically described with referring to the drawings. In the drawings, the same symbols are provided to the same or corresponding parts, and the overlapping explanations are omitted.

FIG. 1 is a schematic partial cross-sectional view showing one preferable exemplary embodiment of the electrophotographic photoreceptor of the exemplary embodiment. FIGS.

2 and 3 are each a schematic partial cross-sectional view of the electrophotographic photoreceptor of other exemplary embodiment.

The electrophotographic photoreceptor 7A as shown in FIG. 1 is so-called a function separation type photoreceptor (or a multi-layer type photoreceptor), which has an electroconductive substrate 4 and an undercoating layer 1 formed on the electroconductive substrate 4, a photosensitive layer including a charge generating layer 2 and a charge transporting layer 3 formed on the undercoating layer in this order, and a surface protective layer 5 formed on the photosensitive layer.

Figure 2:
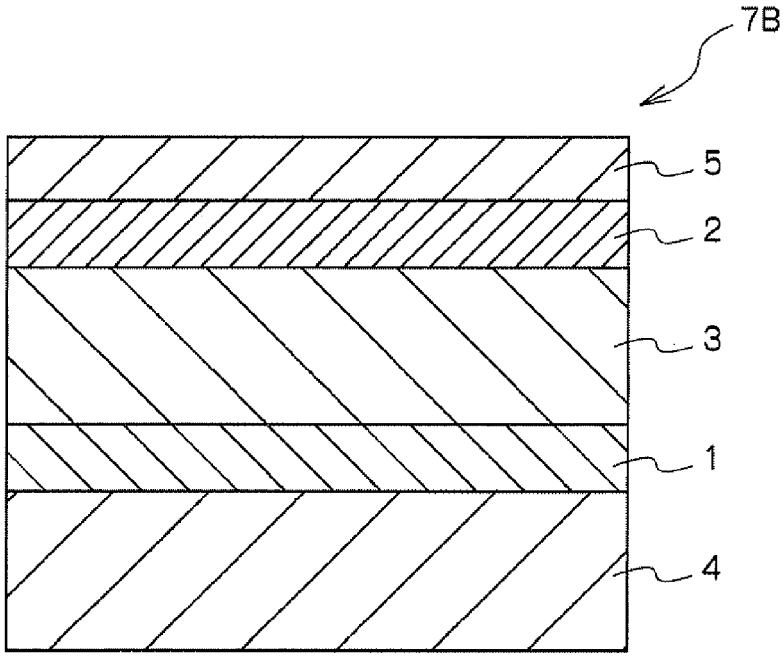
FIG. 2 is a schematic partial cross-sectional view of an electrophotographic photoreceptor of an exemplary embodiment.

The electrophotographic photoreceptor 7B shown in FIG. 2 is a function separation type photoreceptor in which the functions are separated between the charge generating layer 2 and the charge transporting layer 3 as in the electrophotographic photoreceptor 7A shown in FIG. 1, which has a structure in which the electroconductive substrate 4 is formed on the undercoating layer 1, the photosensitive layer including the charge transporting layer 3 and the charge generating layer 2 is formed on the electroconductive substrate in this order, and the surface protective layer 5 formed on the photosensitive layer.

Figure 3:
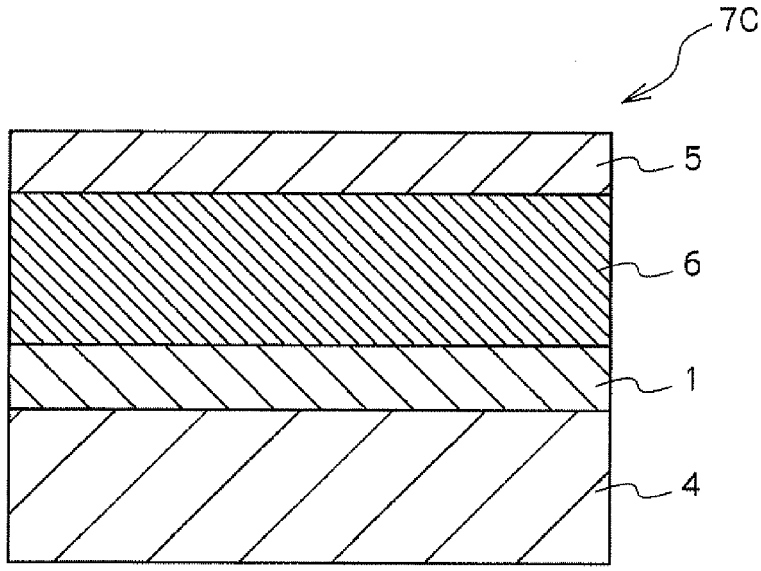
FIG. 3 is a schematic partial cross-sectional view of an electrophotographic photoreceptor of an exemplary embodiment.

The electrophotographic photoreceptor 7C as shown in FIG. 3 is an integrated function type photoreceptor in which the charge generating material and the charge transporting material are included in the same layer (charge generating/charge transporting layer 6), which has a structure in which the undercoating layer 1 is formed on the electroconductive substrate 4, and the charge generating/charge transporting layer 6 and the surface protective layer 5 are formed in this order on the undercoating layer. In the electrophotographic photoreceptor 7C, a single layer type photosensitive layer that is the charge generating/charge transporting layer 6 is disposed.

In the electrophotographic photoreceptors shown in FIGS. 1 and 3, the undercoating layer 1 may be or may not be provided.

Hereinafter each element is explained based on the electrophotographic photoreceptor 7A shown in FIG. 1 as a representative example.

<Surface Protective Layer>

The surface protective layer 5 is explained.

The surface protective layer 5 is the outermost layer in the electrophotographic photoreceptor 7A, which is a layer separately provided so as to protect the photosensitive layer including the charge generating layer 2 and the charge transporting layer 3. When the photoreceptor includes the surface protective layer 6, the outermost surface of the photoreceptor may have resistance to abrasion, scratches and the like, and the transfer efficiency of the toner may be improved.

In the exemplary embodiment, the surface protective layer 16 has a surface free energy of 10 mN/m (or about 10 mN/m) to 30 mN/m (or about 10 mN/m).

The surface free energy of the surface protective layer 16 may be controlled by, for example, adding a silicone-based compound, a fluorine-based compound, an aliphatic acid metal salt or the like.

Of these, it is preferable to add the silicone-based compound or the fluorine-based compound. In this case, when the silicone-based compound or the fluorine-based compound is added by a large amount, the surface free energy tends to decrease.

Examples of the silicone-based compound applied to control the surface free energy may include silicone particles, silicone oil and the like. Specific examples of such silicone-based compound may include dimethylpolysiloxane, diphenylpolysiloxane, phenylmethylsiloxane and the like.

Furthermore, examples of the fluorine-based compound to be applied to control the surface free energy may include fluorine resin particles, particles including a resin obtained by copolymerization of a fluorine resin and a monomer having a hydroxy group, and the like. Specific examples of such fluorine-based compound may include polyvinylidene fluoride, polytetrafluoroethylene and the like.

Here, the surface free energy is explained.

Wettability is a surface physical characteristic that significantly affects the mutual adhesion property between toner mother particles, an external additive or the like included in the toner and the electrophotographic photoreceptor. It is thought that the lower the wettability of the surface of the electrophotographic photoreceptor is, the easier the removal (cleaning) of the toner remained on the surface of the electrophotographic photoreceptor after transfer of the toner image may be. The wettability of the surface of the electrophotographic photoreceptor, i.e., adhesion force, may be represented by using surface free energy (synonymous with surface tension) as an index.

The surface free energy ($\gamma$) is a phenomenon caused on a surface by intermolecular force, which is a force that affects the molecules constituting a substance.

Figure 8:
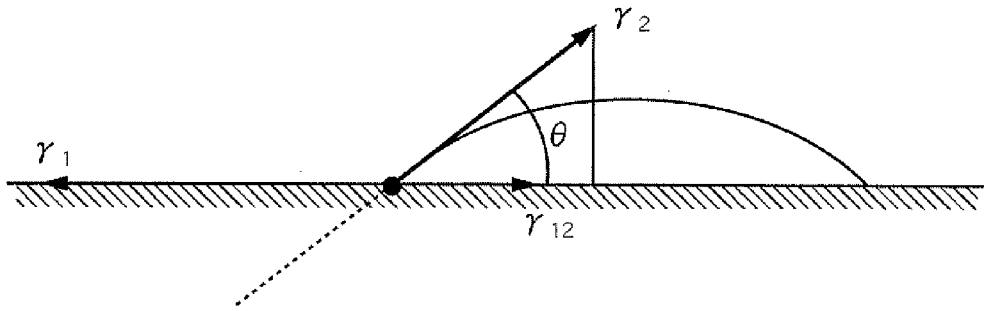
FIG. 8 is a side view showing the state of adhesion wetting and the contact angle.

FIG. 8 is a side view showing a state of adhesion wettability. In the adhesion wettability shown in FIG. 8, the relationship between the wettability and the surface free energy ($\gamma$) is represented by the following Young's formula (formula (1)).

$$\gamma_1=\gamma_2\cdot\cos\theta+\gamma_{12} \quad (1)$$

In formula (1), $\gamma_1$: surface free energy on surface of substance 1

$\gamma_2$: surface free energy on surface of substance 2

$\gamma_{12}$: boundary free energy between substances 1 and 2

$\theta$: contact angle of substance 2 to substance 1.

According to formula (1), reduction in wettability of substance 2 to substance 1, which means that $\theta$ is increased for less wetting, is attained by increasing the boundary free energy $\gamma_{12}$ related to a wetting work of the electrophotographic photoreceptor and the foreign matters and decreasing the surface free energies $\gamma_1$ and $\gamma_2$.

When adhesion of the toner to the surface of the electrophotographic photoreceptor is studied according to formula (1), substance 1 may be considered as the electrophotographic photoreceptor and substance 2 may be considered as the toner respectively. Accordingly, for cleaning the electrophotographic photoreceptor, the wettability on the right side of formula (1), namely, the adhesion condition of the toner to the electrophotographic photoreceptor may be controlled by controlling the surface free energy $\gamma_1$ of the electrophotographic photoreceptor.

As conventional technique that defines a surface condition of an electrophotographic photoreceptor, technique in which a contact angle with pure water is used as shown in, for example, JP-A No. 60-22131 may be mentioned. However, with regard to wettability between a solid and a liquid, the contact angle $\theta$ may be measured as shown in the above-mentioned FIG. 8, but in the case of a solid and a solid such as the electrophotographic photoreceptor and the toner, the contact angle $\theta$ may not be measured. Accordingly, the technique described in the above-mentioned document may be applied to wettability between the surface of the electrophotographic photoreceptor and pure water, but wettability to solid such as a toner contained in a developer and the relationship between of wettability to solid and cleanability may not be explained satisfactorily.

With respect to the wettability between a solid and a solid such as the electrophotographic photoreceptor and the toner, it is thought that the Forkes's theory that mentioned about a non-polar intermolecular force may be further extended to polar or hydrogen-bonding intermolecular force components (refer to Tomoaki Kitazaki, Toshio Hata, et al.; "Extension of Forkes's Formula and Evaluation of Surface Tension of Polymeric Solid", Nippon Secchaku Kyokaishi (Journal of the Adhesion Society of Japan), Nippon Secchaku Kyokai, 1972, vol. 8, No. 3, pp. 131-141). According to this extended Forkes's theory, the surface free energy of each substance may be determined by 2 to 3 components. The surface free energy in the adhesion wettability corresponding to the adhesion of the toner or the like to the surface of the electrophotographic photoreceptor may be determined by 3 components.

The surface free energy between solid materials is explained below.

In the extended Forkes's theory, an addition rule of the surface free energy represented by the following formula (2) is assumed to be established.

$$\gamma=\gamma^d+\gamma^p+\gamma^h \quad (2)$$

In formula (2), $\gamma^d$: dipolar component (polar wettability)

$\gamma^p$: dispersion component (non-polar wettability)

$\gamma^h$: hydrogen-bonding component (hydrogen-bonding wettability).

Where the addition rule of formula (2) is applied to the Forkes's theory, the interface free energy $\gamma_{12}$ between substances 1 and 2 which are both solids is obtained as shown in formula (3).

$$\gamma_{12}=\gamma_1+\gamma_2-\{2\sqrt{(\gamma_1^d\cdot\gamma_2^d)}+2\sqrt{(\gamma_1^p\cdot\gamma_2^p)}+2\sqrt{(\gamma_1^h\cdot\gamma_2^h)}\} \quad (3)$$

wherein $\gamma_1$: surface free energy of substance 1

$\gamma_2$: surface free energy of substance 2

$\gamma_1^d$, $\gamma_2^3$: dipolar component of substance 1 and dipolar component substance 2, respectively $\gamma_1^p$, $\gamma_2^p$: dispersion component of substance 1 and dispersion component of substance 2, respectively $\gamma_1^h$, $\gamma_2^h$: hydrogen-bonding component of substance 1 and hydrogen-bonding component of substance 2, respectively.

The surface free energies ($\gamma^d$, $\gamma^p$, $\gamma^h$) of the components in the solid materials to be measured as represented by formula (2) are calculated by using reagents whose surface free energies of the components are known, and measuring adhesion with the reagents. Accordingly, with respect to each of substances 1 and 2, the surface free energies of the components is obtained, and, using the surface free energies of the components, the surface free energies of the substances 1 and 2 may be obtained using formula (3).

The measurement method of the surface free energy applied to the present specification is further specifically mentioned in the following Examples.

It is preferable that the surface protective layer 5 is a layer including a crosslinked product of a composition including at least one compound selected from a compound having a guanamine structure (hereinafter may be referred to as "guanamine compound") and a compound having a melamine structure (hereinafter may be referred to as "melamine compound") and at least one charge transporting material including at least one substituent selected from —OH, —$OCH_3$, —$NH_2$, —SH and —COOH (hereinafter may be referred to as "specific charge transporting material"). Furthermore, it is preferable that the solid content concentration of the at least one compound selected from a guanamine compound and a melamine compound is from 0.1% by weight (or about 0.1% by weight) to 5% by weight (or about 5% by weight) in the composition including the compound and the specific charge transporting material.

When the surface protective layer 5 has the above-mentioned constitution, the mechanical strength and electronic stability of the electrophotographic photoreceptor may further be improved, whereby the high reliability and long lifetime of the image forming apparatus may further be improved.

First, the guanamine compound is explained.

The guanamine compound is a compound having a guanamine backbone (structure), and examples may include acetoguanamine, benzoguanamine, formoguanamine, steroguanamine, spiroguanamine, cyclohexylguanamine and the like.

The guanamine compound is particularly preferably at least one of a compound represented by the following formula (A) and multimers thereof. The multimers are oligomers obtained by polymerization of the compound represented by formula (A) as a structural unit, and have a polymerization degree of, for example, 2 or more and 200 or less, preferably 2 or more and 100 or less. The compound represented by formula (A) may be used alone or as a mixture of two or more kinds thereof. In particular, solvent solubility of the compound represented by formula (A) may be improved where used as a mixture of two or more kinds thereof, or as a multimer (oligomer) in which the compound is used as a structural unit.

(A)

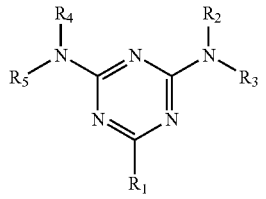

In formula (A), $R_1$ is a linear or branched alkyl group having 1 to 10 carbon atoms, a substituted or unsubstituted phenyl group having 6 to 10 carbon atoms, or a substituted or unsubstituted alicyclic hydrocarbon group having 4 to 10 carbon atoms; $R_2$ through $R_5$ are each independently a hydrogen atom, —$CH_2$—OH or —$CH_2$—O—$R_6$, wherein $R_6$ is a linear or branched alkyl group having 1 to 10 carbon atoms.

In formula (A), the alkyl group represented by $R_1$ has 1 to 10, 1 to 8, and more preferably 1 to 5 carbon atoms. The alkyl group may be linear or branched.

In formula (A), the phenyl group represented by $R_1$ has 6 to 10, preferably 6 to 8 carbon atoms. Examples of the substituent which the phenyl group may have may include a methyl group, an ethyl group, a propyl group and the like.

In formula (A), the alicyclic hydrocarbon group represented by $R_1$ has 4 to 10, preferably 5 to 8 carbon atoms. Examples of the substituent which the alicyclic hydrocarbon group may have may include a methyl group, an ethyl group, a propyl group and the like.

In the "—$CH_2$—O—$R_6$" represented by $R_2$ through $R_5$ in formula (A), the alkyl group represented by $R_6$ has 1 to 10, preferably 1 to 8, and more preferably 1 to 6 carbon atoms. The alkyl group may be linear or branched. Preferable examples of the alkyl group may include a methyl group, an ethyl group, a butyl group and the like.

The compound represented by formula (A) is particularly preferably a compound wherein $R_1$ is a substituted or unsubstituted phenyl group having 6 to 10 carbon atoms, and $R_2$ through $R_5$ are each independently —$CH_2$—O—$R_6$. $R_6$ is preferably selected from a methyl group and an n-butyl group.

The compound represented by formula (A) is synthesized from, for example, guanamine and formaldehyde according to a known method (for example, Jikken Kagaku Koza, the 4$^{th}$ edition, Vol 28, p. 430).

Specific examples of the compound represented by formula (A) include, but not limited to, the following compounds. The following specific examples are shown in the form of a monomer, but the compound may be in the form of a multimer (oligomer) in which the monomer is used as a structural unit.

(A)-1

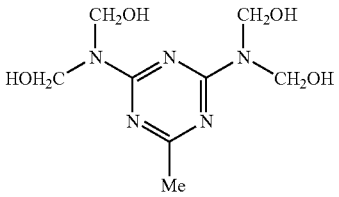

(A)-2

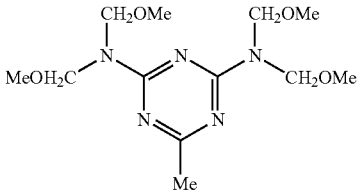

(A)-3

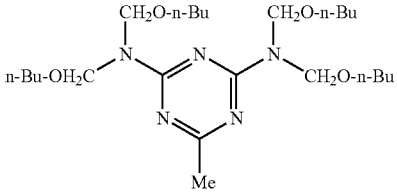

(A)-4

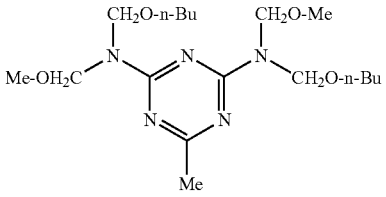

(A)-5

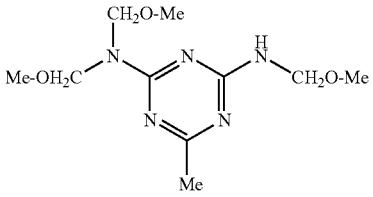

(A)-6

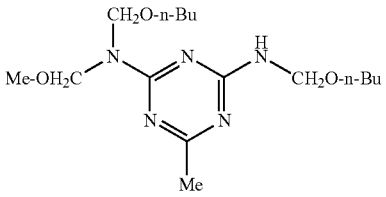

-continued (A)-7

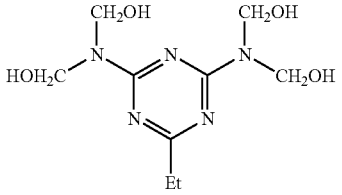

(A)-8

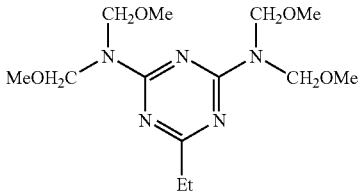

(A)-9

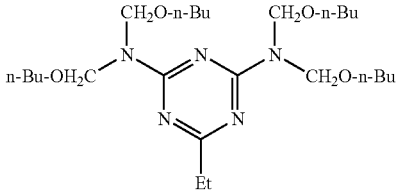

(A)-10

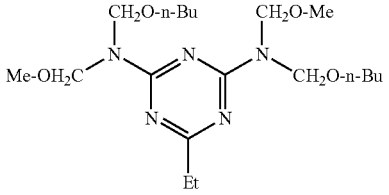

(A)-11

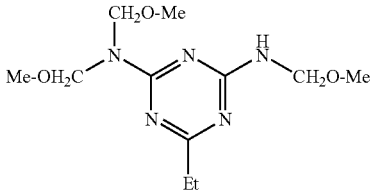

(A)-12

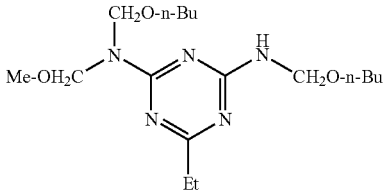

(A)-13

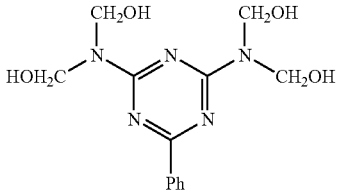

(A)-14

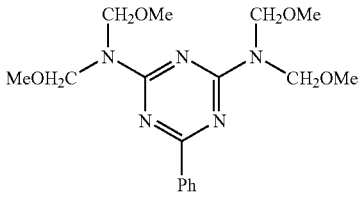

-continued
(A)-15
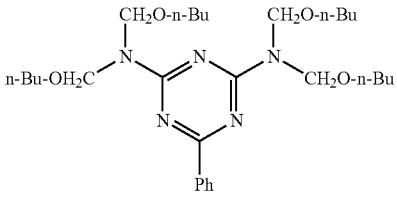
(A)-16
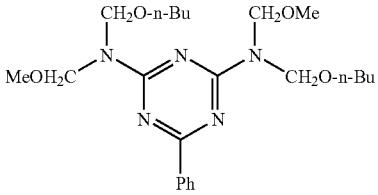
(A)-17
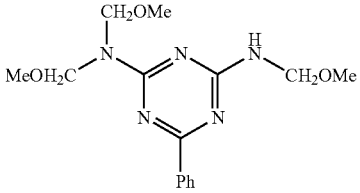
(A)-18
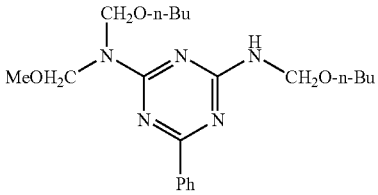
(A)-19
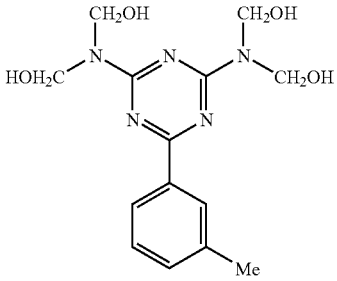
(A)-20
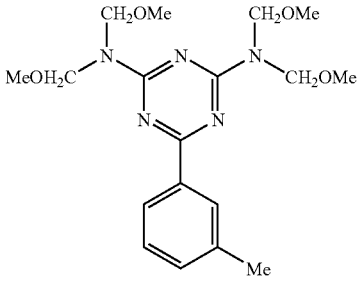
-continued
(A)-21
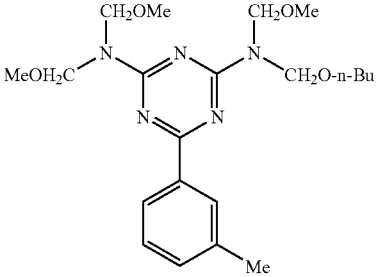
(A)-22
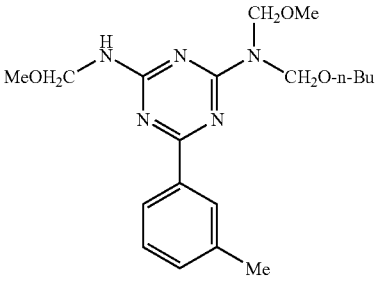
(A)-23
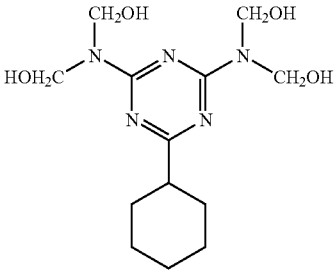
(A)-24
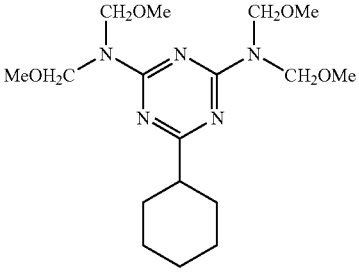
(A)-25
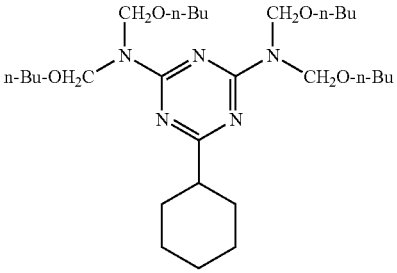

-continued
(A)-26
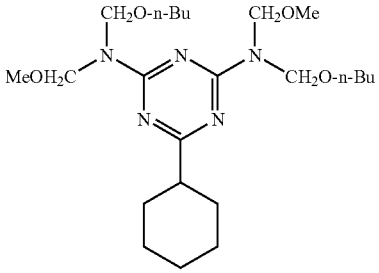
(A)-27
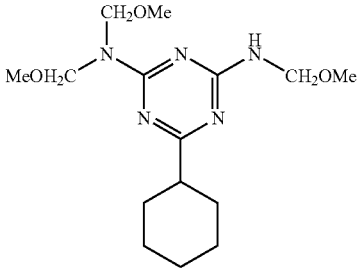
(A)-28
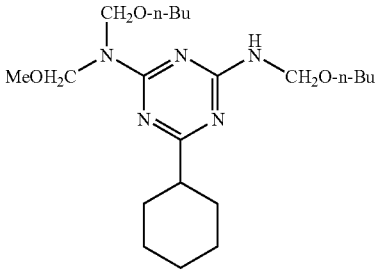
(A)-29
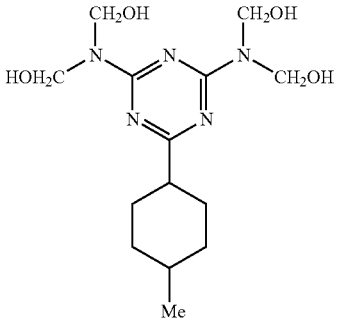
(A)-30
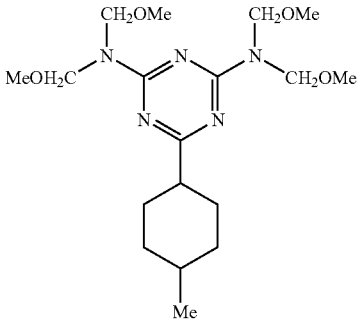
-continued
(A)-31
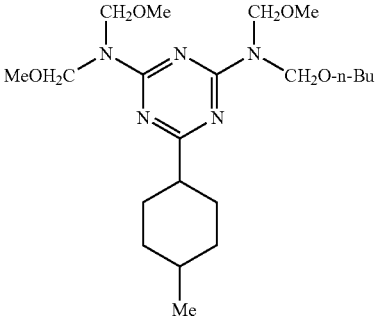
(A)-32
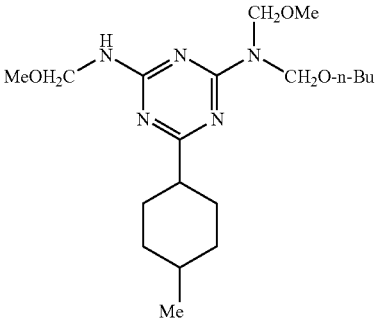
(A)-33
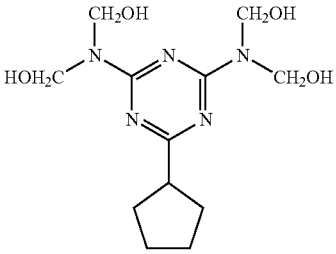
(A)-34
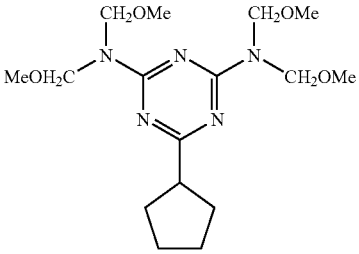
(A)-35
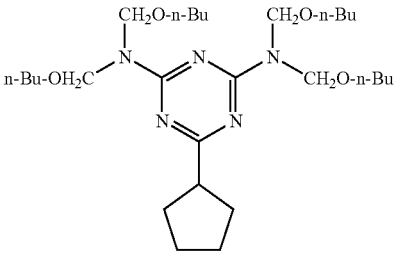

-continued (A)-36

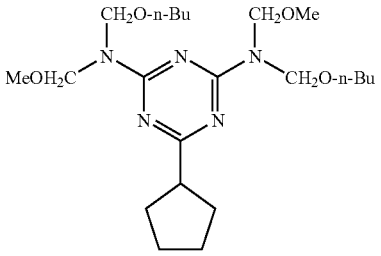

(A)-37

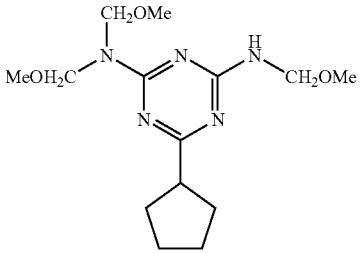

(A)-38

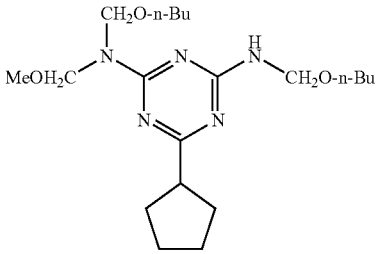

(A)-39

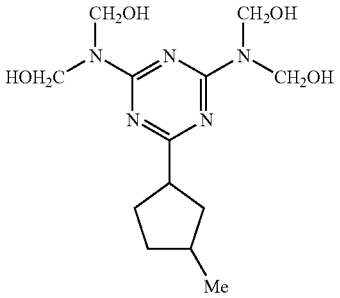

(A)-40

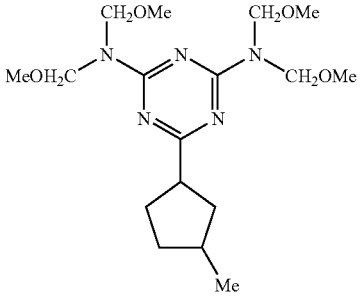

-continued (A)-41

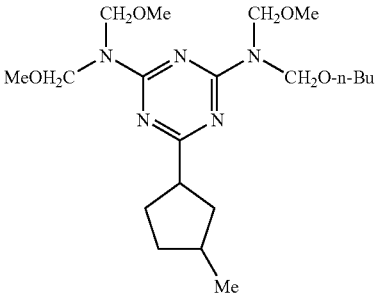

(A)-42

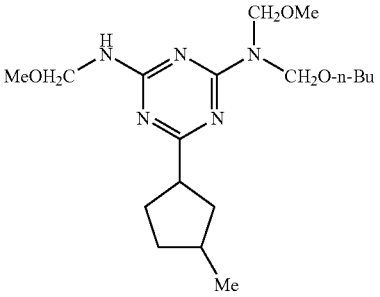

Examples of commercial products of the compound represented by formula (A) may include SUPER BECKAMIN (R) L-148-55, SUPER BECKAMIN (R) 13-535, SUPER BECKAMIN (R) L-145-60 and SUPER BECKAMIN (R) TD-126 (manufactured by DIC Corporation), NIKALACK BL-60 and NIKALACK BX-4000 (manufactured by Nippon Carbide Industries Co., Inc.), and the like.

After the compound represented by formula (A) (including multimers) is synthesized or purchased, in order to remove the influence of the residual catalyst, the compound may be dissolved in an appropriate solvent such as toluene, xylene or ethyl acetate, followed by washing with distilled water or ion exchanged water, or treatment with an ion exchange resin.

Next, the melamine compound is explained.

The melamine compound has a melamine backbone (structure), and is specifically preferably at least one of a compound represented by the following formula (B) and multimers thereof. Similarly to formula (A), the multimers are oligomers obtained by polymerization of the compound represented by formula (B) as a structural unit, and have a polymerization degree of, for example, 2 or more and 200 or less, preferably 2 or more and 100 or less. The compound represented by formula (B) or multimers thereof may be used alone or as a mixture of two or more kinds thereof. Alternatively, the compound represented by formula (A) may be used in combination with the compound represented by formula (A) or a multimer thereof. In particular, solvent solubility of the compound represented by formula (B) may be improved where used as a mixture of two or more kinds thereof, or as a multimer (oligomer) in which the compound is used as the structural unit.

(B)

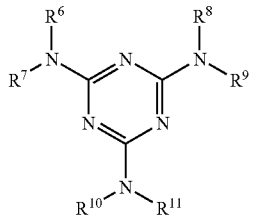

In formula (B), $R^6$ through $R^{11}$ are each independently a hydrogen atom, —$CH_2$—O or —$CH_2$—O—$R^{12}$, and $R^{12}$ is an alkyl group having 1 to 5 carbon atoms which may be branched. Examples of the alkyl group may include a methyl group, an ethyl group, a butyl group and the like.

The compound represented by formula (B) is synthesized from, for example, melamine and formaldehyde according to a known method (for example, synthesized in a similar manner to the melamine resin described in Jikken Kagaku Koza, the 4$^{th}$ edition, vol 28, p. 430).

Specific examples of the compound represented by formula (B) include, but not limited to, the following compounds. These following specific examples are shown in the form of a monomer, but the compound may be in the form of a multimer (oligomer) in which the monomer is used as a structural unit.

(B)-1

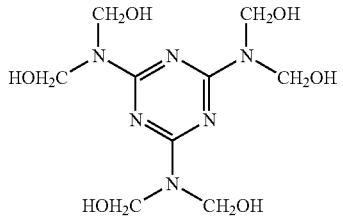

(B)-2

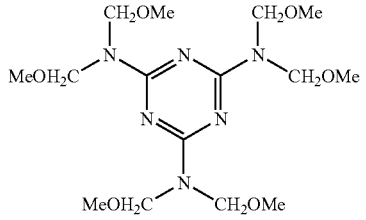

(B)-3

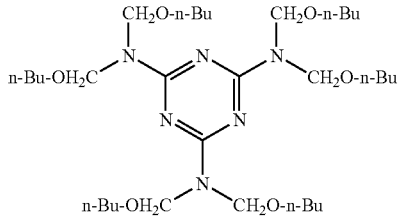

(B)-4

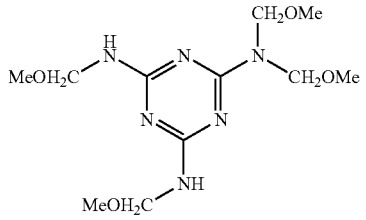

-continued (B)-5

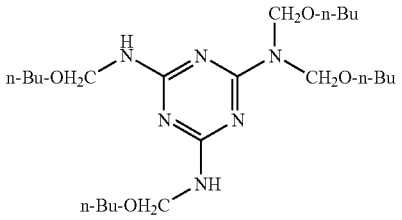

(B)-6

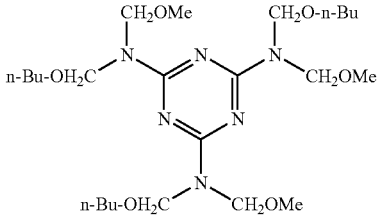

(B)-7

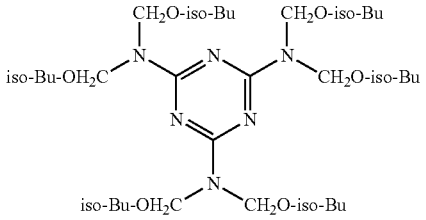

Examples of commercial products of the compound represented by formula (B) may include SUPERMELAMI No. 90 (manufactured by NOF Corporation), SUPER BECKAMIN (R) TD-139-60 (manufactured by DIC Corporation), U-VAN 2020 (manufactured by Mitsui Chemicals Inc.), SUMITEX RESIN M-3 (manufactured by Sumitomo Chemical Co., Ltd.), NIKARAC MW-30 (manufactured by Nippon Carbide Industries Co., Inc) and the like.

After the compound represented by formula (B) (including multimers) is synthesized or purchased, in order to remove the influence of the residual catalyst, the compound may be dissolved in an appropriate solvent such as toluene, xylene or ethyl acetate, followed by washing with distilled water or ion exchanged water, or treatment with an ion exchange resin.

Next, the specific charge transporting material is explained. The specific charge transporting material has at least one substituent selected from the group consisting of —OH, —$OCH_3$, —$NH_2$, —SH and —COOH. The specific charge transporting material particularly preferably has at least two (more preferably three) substituents selected from the group consisting of —OH, —$OCH_3$, —$NH_2$, —SH and —COOH. As the reactive functional groups (substituents) of the specific charge transporting material increases, the crosslinking density may increase, and a crosslinked film having higher strength may be obtained. In particular, where a blade cleaner is used, the revolution torque of the electrophotographic photoreceptor for a blade cleaner may be reduced, whereby damages to the blade and abrasion of the electrophotographic photoreceptor may be suppressed. The specific reason of this is not known, but is probably due to that the increase of the reactive functional groups gives a cured film having a high crosslinking density, and the molecular motion on the outermost surface of the electrophotographic photoreceptor is suppressed and the interaction with the molecules on the surface of the blade member is weakened. The charge transporting material preferably includes from two to four substituents selected from the group consisting of —OH, —$OCH_3$, —$NH_2$, —SH and —COOH, and more preferably includes from three to four substituents selected from the group consisting of —OH, —$OCH_3$, —$NH_2$, —SH and —COOH.

The specific charge transporting material is preferably the compound represented by the following formula (I).

$$F—((—R_1—X)_{n1}(R_2)_{n2}—Y)_{n3} \quad (I)$$

In formula (I), F is an organic group derived from a compound having a positive hole-transporting ability; $R_1$ and $R_2$ are each independently a linear or branched alkylene group having 1 to 5 carbon atoms; n1 represents 0 or 1; n2 represents 0 or 1; n3 is an integer of 1 to 4; X is an oxygen atom, NH or a sulfur atom, and Y is —OH, —$OCH_3$, —$NH_2$, —SH or —COOH.

In formula (I), the organic group represented by F is preferably derived from a positive hole-transporting compound such as an arylamine derivative. Preferable examples of the arylamine derivative include triphenylamine derivatives and tetraphenylbenzidine derivatives.

The compound represented by formula (I) is preferably the compound represented by formula (II). The compound represented by formula (II) may have excellent stability, in particular, stability against charge mobility, oxidation and the like.

(II)

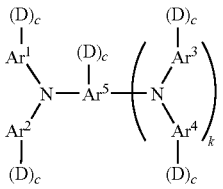

In formula (II), $Ar^1$ through $Ar^4$ may be the same or different from each other and are each independently a substituted or unsubstituted aryl group; $Ar^5$ is a substituted or unsubstituted aryl group or a substituted or unsubstituted arylene group; D is $—(—R_1—X)_{n1}(R_2)_{n2}—Y$; c each independently represents 0 or 1; k is 0 or 1; the total number of D is 1 or more and 4 or less; $R_1$ and $R_2$ are each independently a linear or branched alkylene group having 1 to 5 carbon atoms; n1 is 0 or 1; n2 is 0 or 1; X is an oxygen atom, NH or a sulfur atom; and Y is —OH, —$OCH_3$, —$NH_2$, —SH or —COOH.

In formula (II), "$—(—R_1—X)_{n1}(R_2)_{n2}—Y$" represented by D is the same as that in formula (I), and $R_1$ and $R_2$ are each independently a linear or branched alkylene group having 1 to 5 carbon atoms; n1 is preferably 1; n2 is preferably 1; X is preferably oxygen; and Y is preferably a hydroxy group.

The total number of D in formula (II) corresponds to n3 in formula (I), is preferably 2 or more and 4 or less, and more preferably 3 or more and 4 or less. In formulas (I) and (II), where the total number of D is preferably 2 or more and 4 or less, and more preferably 3 or more and 4 or less in one molecule, the crosslinking density may be increased, and thus a stronger crosslinked film may be obtained. In particular, where a blade cleaner is used, the revolution torque of the electrophotographic photoreceptor may be reduced, which may reduce damages to the blade and abrasion of the electrophotographic photoreceptor. The specific reason of this is not known, but is probably due to that the increase of the reactive functional groups gives a cured film having a high crosslinking density, and the molecular motion on the outermost surface of the electrophotographic photoreceptor is suppressed and the interaction with the molecules on the surface of the blade member is weakened.

In formula (II), $Ar^1$ through $Ar^4$ are preferably represented by any one from formulas (1) through (7). The formulas (1) through (7) are shown together with "-(D)c" which may be linked to $Ar^1$ through $Ar^4$.

(1)

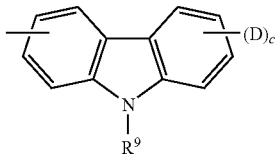

(2)

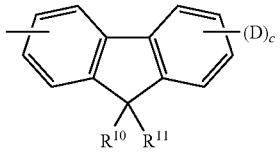

(3)

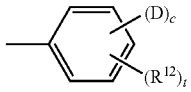

(4)

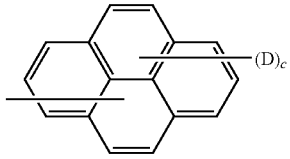

(5)

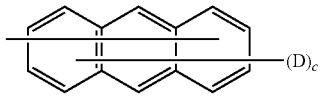

(6)

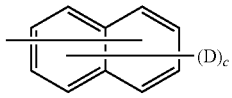

(7)

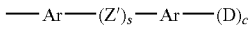

In formulas (1) and (7), $R^9$ is one selected from the group consisting of a hydrogen atom, an alkyl group having 1 to 4 carbon atoms, a phenyl group substituted with an alkyl group having 1 to 4 carbon atoms or an alkoxy group having 1 to 4 carbon atoms, an unsubstituted phenyl group, and an aralkyl group having 7 to 10 carbon atoms; $R^{10}$ through $R^{12}$ are each one selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom; Ar represents a substituted or unsubstituted arylene group; D and c are the same as "D" and "c" in formula (II); s is 0 or 1; and t is an integer of 1 or more and 3 or less.

In formula (7), Ar is preferably one represented by the following formula (8) or (9).

(8)

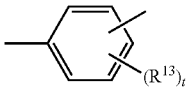

(9)

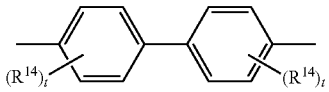

In formulas (8) and (9), $R^{13}$ and $R^{14}$ are each independently one selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom; and t is an integer of 1 or more and 3 or less.

In formula (7), Z' is preferably represented by any one selected from the following formulas (10) through (17).

(10) $-(CH_2)_q-$

(11) $-(CH_2CH_2O)_r-$ (12)

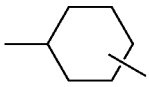

(13)

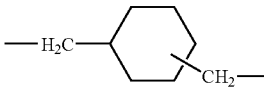

(14)

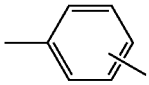

(15)

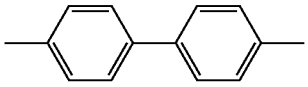

(16)

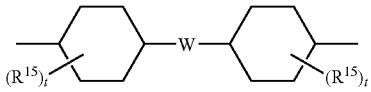

(17)

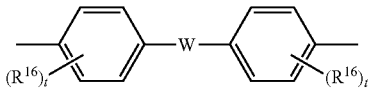

In formulas (10) through (17), $R^{15}$ and $R^{16}$ are each independently one selected from the group consisting of a hydrogen atom, an alkyl group having 1 to 4 carbon atoms, an alkoxy group having 1 to 4 carbon atoms or a phenyl group substituted with an alkoxy group having 1 to 4 carbon atoms, an unsubstituted phenyl group, an aralkyl group having 7 to 10 carbon atoms, and a halogen atom; W is a divalent group; q and r are each independently an integer of 1 or more and 10 or less; and t is an integer of 1 or more and 3 or less.

In formulas (16) and (17), W is preferably a divalent group represented by any one of formulas (18) through (26). In formula (25), u is an integer of 0 or more and 3 or less.

(18) $-CH_2-$

(19) $-C(CH_3)_2-$

(20) $-O-$

(21) $-S-$

(22) $-C(CF_3)_2-$

(23) $-Si(CH_3)_2-$ (24)

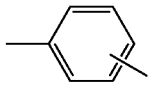

(25)

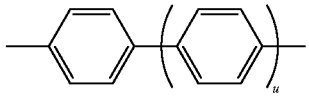

(26)

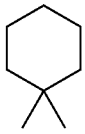

In formula (II), where k is 0, $Ar^5$ is an aryl group as exemplified for $Ar^1$ through $Ar^4$, in above (1) to (7), and where k is 1, $Ar^5$ is an arylene group obtained by removing a hydrogen atom from the aryl group.

Specific examples of the compound represented by formula (I) include the following compounds (I)-1 through (I)-34. The compound represented by formula (I) is not limited to the following compounds.

I-1

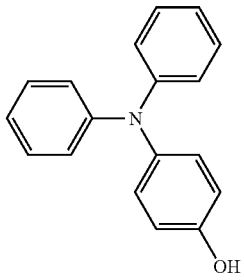

I-2

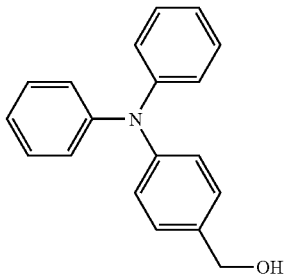

-continued
I-3
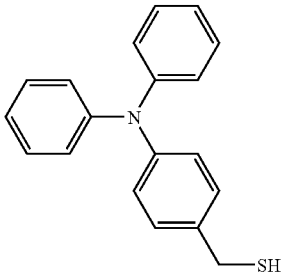
I-4
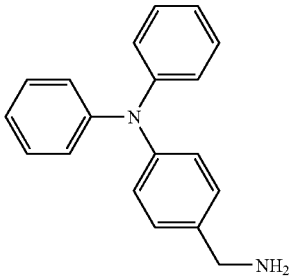
I-5
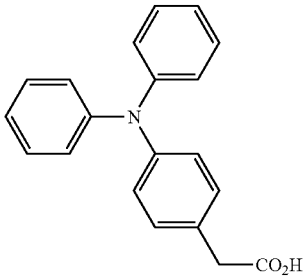
I-6
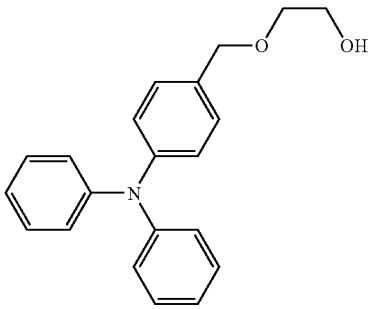
I-7
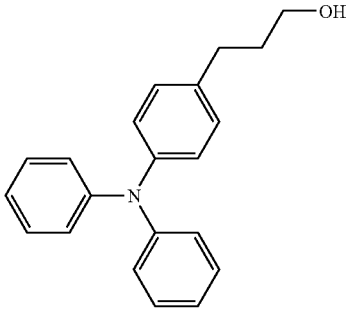
-continued
I-8
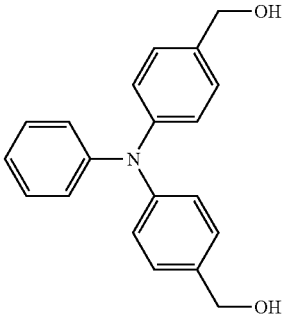
I-9
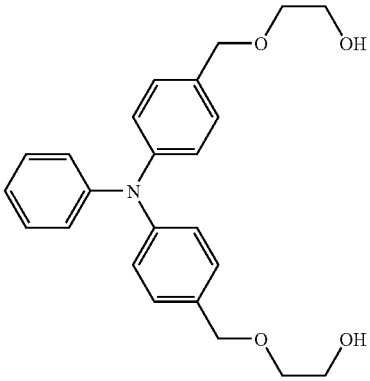
I-10
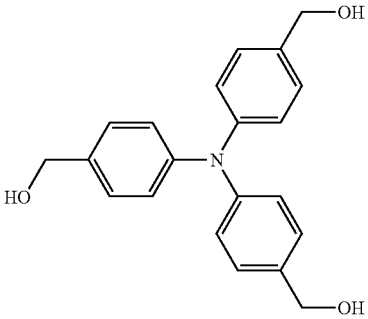
I-11
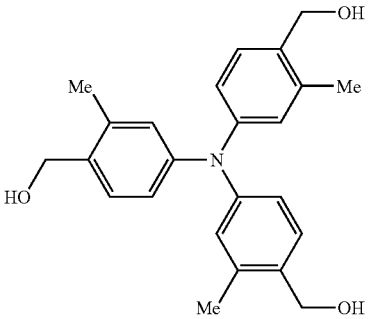

-continued
I-12
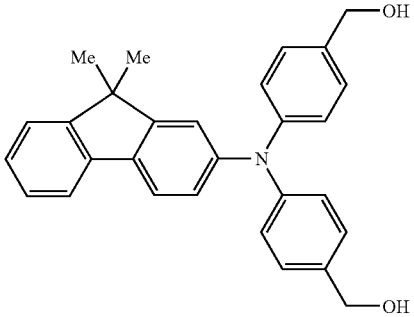
I-13
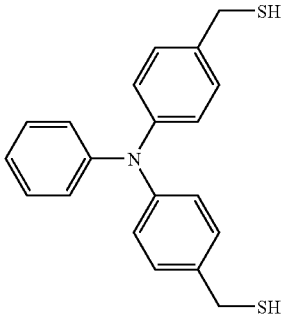
I-14
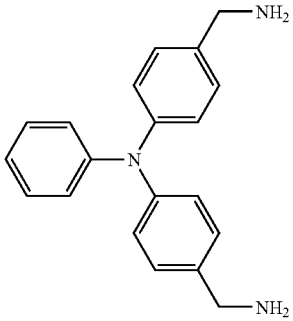
I-15
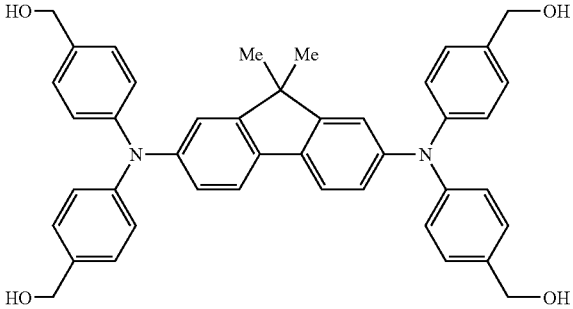
I-16
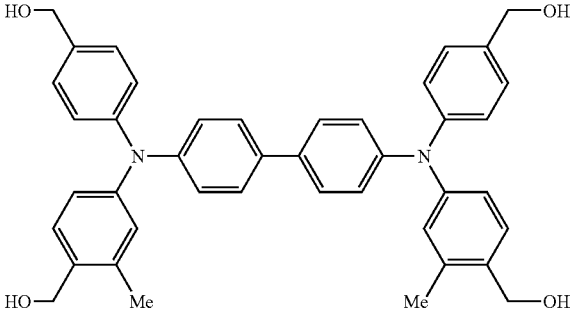
-continued
I-17
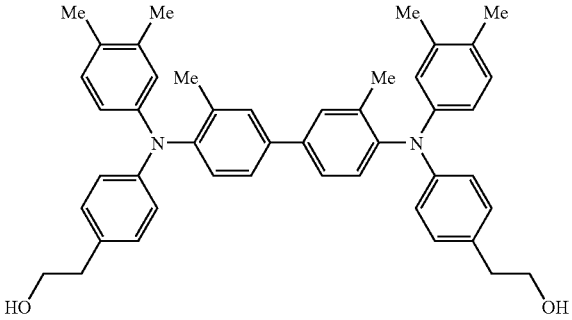
I-18
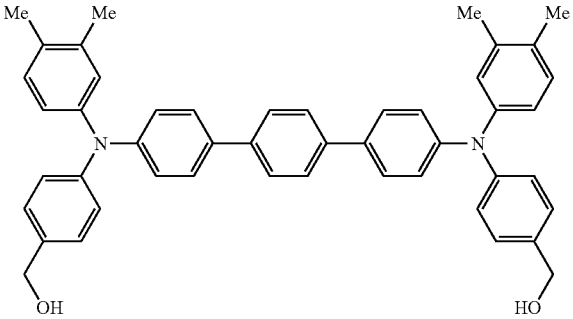
I-19
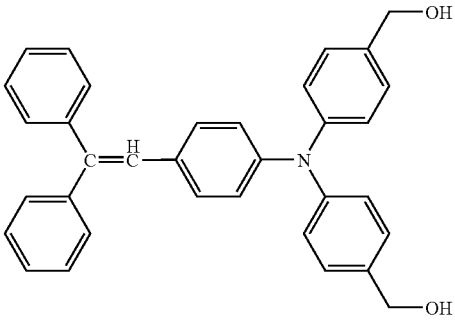
I-20
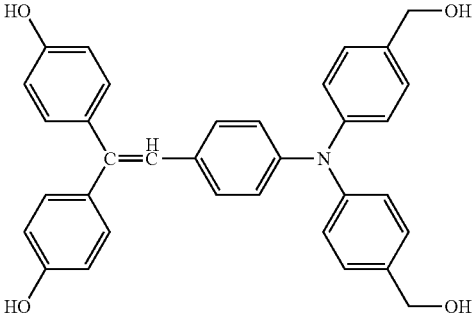

-continued
I-21
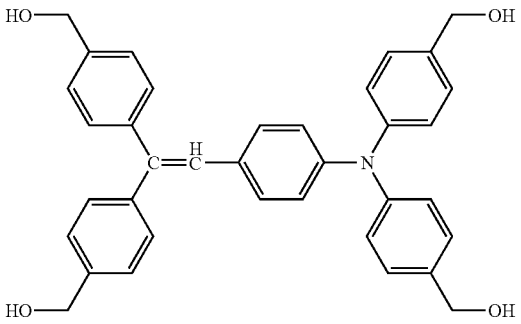
I-22
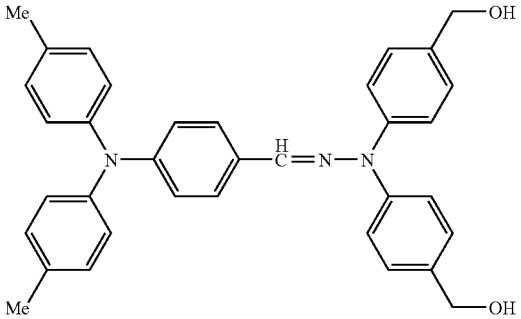
I-23
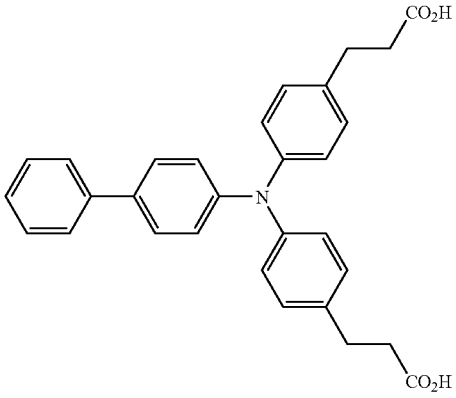
I-24
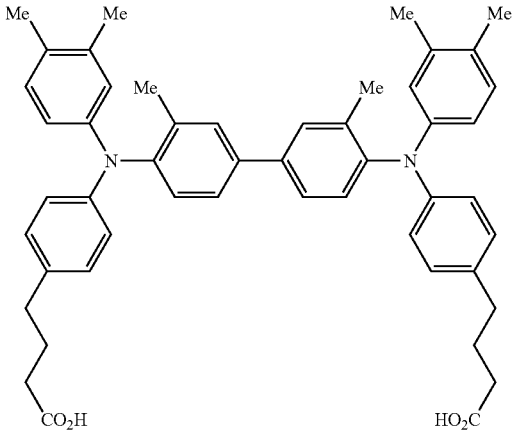
-continued
I-25
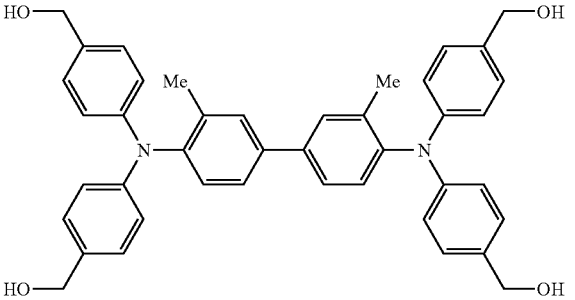
I-26
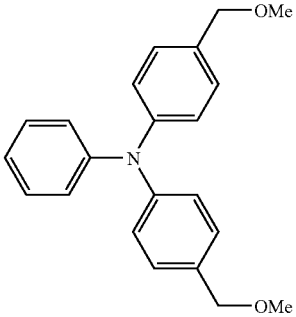
I-27
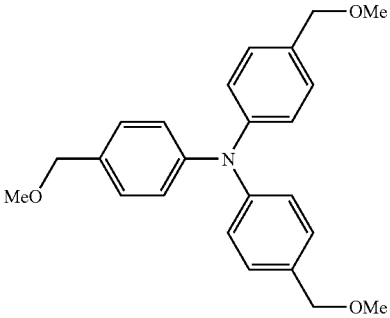
I-28
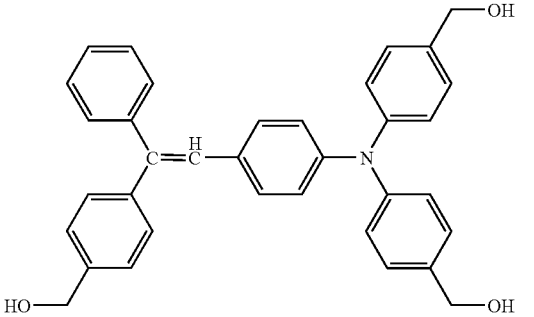
I-29
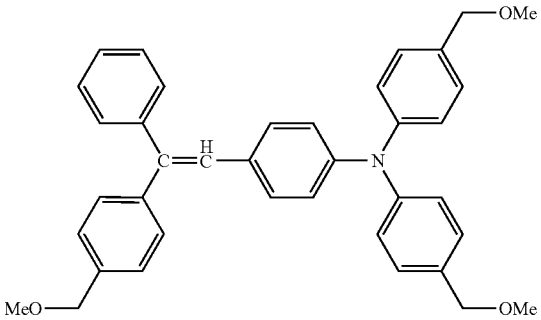

-continued

I-30

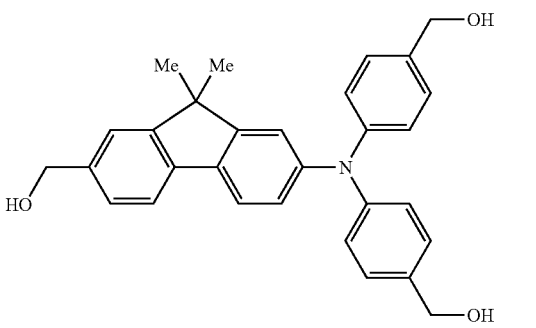

I-31

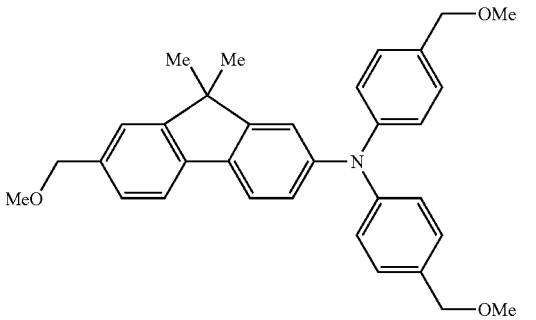

I-32

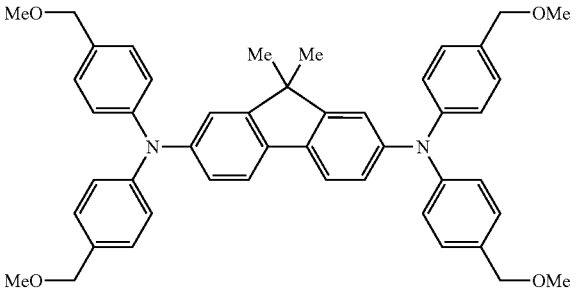

I-33

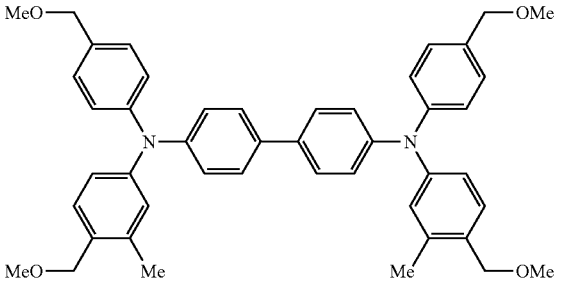

I-34

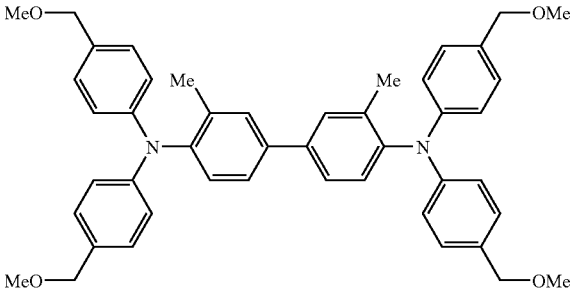

The solid content concentration of the at least one specific charge transporting material in the composition is preferably 80% by weight (or about 80% by weight) or more, more preferably 90% by weight (or about 90% by weight) or more, and further preferably 95% by weight (or about 95% by weight) or more. Where the solid content concentration is in the above-mentioned range, the durability where electronic or mechanical stress is applied to the photoreceptor from outside of the photoreceptor may further be increased. Where the solid content concentration is less than the above-mentioned range, electrical property may be deteriorated as compared with the case where the solid content concentration is in the above-mentioned range. The upper limit of the solid content concentration is not limited as long as the at least one selected from the guanamine compound (for example, a compound represented by formula (A)) and the melamine compound (for example, a compound represented by formula (B)) and other additives effectively act, and higher solid content concentration is preferable.

As mentioned above, the solid content concentration of the at least one selected from the guanamine compound (for example, a compound represented by formula (A)) and the melamine compound (for example, a compound represented by formula (B)) in a coating liquid is preferably 0.1% by weight (or about 0.1% by weight) or more and 5% by weight (or about 5% by weight) or less, and more preferably 1% by weight or more and 3% by weight or less. Where the solid content concentration is less than the above-mentioned range, a dense film may be less likely to be formed and sufficient strength may be hard to be obtained as compared with the case where the solid content concentration is in the above-mentioned range. Where the solid content concentration exceeds the above-mentioned range, electric property and resistance properties against ghosting may be deteriorated.

The content of the at least one specific charge transporting material in the surface protective layer 5 may be 80% by weight (or about 80% by weight) or more, preferably 90% by weight or more, and more preferably 95% by weight or more.

The content of the specific charge transporting material in the surface protective layer 5 may be controlled by adjusting the specific charge transporting material in the composition.

The solid content concentration of the at least one selected from the guanamine compound and the melamine compound in the surface protective layer 5 is preferably 0.1% by weight or more and 5% by weight or less, and more preferably 1% by weight or more and 3% by weight or less.

The content of the at least one specific charge transporting material or the at least one selected from the guanamine compound and the melamine compound in the surface protective layer 5 may be controlled by adjusting the solid content concentrations of these compounds in the composition.

The protective layer 5 is further illustrated below.

The protective layer 5 may include a phenolic resin, a melamine resin, an urea resin, an alkyd resin and the like in addition to the crosslinked product of the composition including at least one selected from the guanamine compound (for example, a compound represented by formula (A)) and the melamine compound (for example, a compound represented by formula (B)) and the specific charge transporting material (for example, a compound represented by formula (I)). Furthermore, in order to improve the strength, a compound having more functional groups in one molecule, such as a spiroacetal guanamine resin (for example "CTU-GUANAMINE" (manufactured by Ajinomoto-Fine-Techno Co., Inc.) may be copolymerized with the material in the crosslinked product.

In order to prevent excess adsorption of discharge product gas, the protective layer 5 may include other heat curable resin such as a phenolic resin, a melamine resin and a benzoguanamine resin, whereby oxidation by discharge product gas may be effectively suppressed.

Furthermore, a surfactant may be added to the surface protective layer 5. The surfactant to be used is not specifically limited as long as it is a surfactant including at least one kind or more structure selected from a fluorine atom, an alkylene oxide structure and a silicone structure, and preferable examples may include those having multiple structures mentioned above since they have high affinity and compatibility with a charge transporting organic compound, the film forming property of the coating liquid for the surface protective layer may be improved, and wrinkles and unevenness of the surface protective layer 5 may be suppressed.

Examples of the surfactant having a fluorine atom may include various surfactants. Specific examples of the surfactants having a fluorine atom and an acrylic structure may include POLYFLOW KL600 (manufactured by Kyoeisha Chemical Co., Ltd.), FTOP EF-351, EF-352, EF-801, EF-802 and EF-601 (manufactured by JEMCO Inc.), and the like. Examples of the surfactant having an acryl structure may include a polymer or copolymer of monomers such as acrylic or methacrylic compounds.

Examples of the surfactant having a fluorine atom may include surfactants having a perfluoroalkyl group, and specific preferable examples may include perfluoroalkyl sulfonate (for example, perfluorobutane sulfonate, perfluorooctane sulfonate and the like), perfluoroalkyl carboxylate (for example, perfluorobutane carboxylate, perfluorooctane carboxylate and the like), perfluoroalkyl group-containing phosphoric acid esters. The perfluoroalkyl sulfonates and perfluoroalkylcarboxylates may be salts thereof and amide-modified forms thereof.

Examples of commercial products of the perfluoroalkyl sulfonate include MEGAFAC F-114 (manufactured by DIC Corporation), EFTOP EF-101, EF102, EF-103, EF-104, EF-105, EF-112, EF-121, EF-122A, EF-122B, EF-122C, EF-123A (manufactured by JEMCO), A-K, 501 (manufactured by NEOS Corporation), and the like.

Examples of commercial products of the perfluoroalkylcarboxylic acids may include MEGAFAC F-410 (manufactured by DIC Corporation), EFTOP EF-201 and EF-204 (manufactured by JEMCO), and the like.

Examples of commercial products of the perfluoroalkyl-containing phosphoric acid esters may include MEGAFAC F-493 and F-494 (manufactured by DIC Corporation) EFTOP EF-123A, EF-123B, EF-125M and EF-132 (manufactured by JEMCO), and the like.

Examples of the surfactant having an alkylene oxide structure may include polyethylene glycol, polyether defoaming agents, polyether modified silicone oils and the like. Preferable examples of the polyethylene glycol may include those having a number average molecular weight of 2000 or less. Examples of the polyethylene glycol having a number average molecular weight of 2000 or less may include polyethylene glycol 2000 (number average molecular weight: 2000), polyethylene glycol 600 (number average molecular weight: 600), polyethylene glycol 400 (number average molecular weight 400), polyethylene glycol 200 (number average molecular weight: 200) and the like.

Examples of the polyether defoaming agent may include PE-M and PE-L (manufactured by Wako Pure Chemical Industries, Ltd.), DEFOAMING AGENT No. 1 and DEFOAMING AGENT No. 5 (manufactured by Kao Corporation), and the like.

Examples of the surfactant having a silicone structure may include general silicone oils such as dimethylsilicone, methylphenylsilicone and diphenylsilicone, and derivatives thereof.

Examples of the surfactant having both a fluorine atom and an alkylene oxide structure may include those having an alkylene structure or polyalkylene structure at a side chain, those having an alkylene oxide or polyalkylene oxide structure whose terminal has been substituted with a substituents including a fluorine atom, and the like. Specific examples of the surfactant having an alkylene oxide structure may include MEGAFAC F-443, F-444, F-445 and F-446 (manufactured by DIC Corporation), POLY FOX PF636, PF6320, PF6520 and PF656 (manufactured by Kitamura Chemicals Co., Ltd.), and the like.

Examples of the surfactants having both an alkylene oxide structure and a silicone structure may include KF351 (A), KF352 (A), KF353 (A), KF354 (A), KF355 (A), KF615 (A), KF618, KF945 (A) and KF 6004 (manufactured by Shin-Etsu Chemical Co., Ltd.), TSF4440, TSF4445, TSF4450, TSF4446, TSF4452, TSF4453 and TSF4460 (manufactured by GE Toshiba Silicones), BYK-300, 302, 306, 307, 310, 315, 320, 322, 323, 325, 330, 331, 333, 337, 341, 344, 345, 346, 347, 348, 370, 375, 377, 378, UV3500, UV3510 and UV3570 (manufactured by BYC Chemie Japan), and the like.

The content of the surfactant is preferably 0.01% by weight or more and 1% by weight or less, and more preferably 0.02% by weight or more and 0.5% by weight or less, with respect to the total amount of the solid contents in the surface protective layer 5. When the content of the surfactant having a fluorine atom is 0.01% by weight or more, effect of suppressing coating deficiencies such as suppression of wrinkles and unevenness may tend to be higher. Furthermore, when the content of the surfactant having fluorine atoms is 1% by weight or less, the surfactant having a fluorine atom and the cured resin may be less likely to be separated and thus the strength of the obtained cured product may tend to be maintained.

The protective layer 5 may further include another coupling agent or fluorine compound for the purpose of controlling the film-forming property, flexibility, lubricity and adhesiveness of the film. Examples of such compounds may include various silane coupling agents and commercially available silicone-based hard coating agents.

Examples of the silane coupling agent include vinyltrichlorosilane, vinyltrimethoxysilane, vinyltriethoxysilane, γ-glycidoxypropylmethyldiethoxysilane, γ-glycidoxypropyltrimethoxysilane, γ-aminopropyltriethoxysilane, γ-aminopropyltrimethoxysilane, γ-aminopropylmethyldimethoxysilane, N-β(aminoethyl)-γ-aminopropyltriethoxysilane, tetramethoxysilane, methyltrimethoxysilane and dimethyldimethoxysilane. Examples of the commercially available hard coating agent include KP-85, X-40-9740 and X-8239 (manufactured by Shin-Etsu Chemical Co., Ltd.), AY42-440, AY42-441 and AY49-208 (manufactured by Toray Dow Corning Silicone Co. Ltd.), and the like.

In order to impart water repellency, a fluorine-containing compound such as (tridecafluoro-1,1,2,2-tetrahydrooctyl)triethoxysilane, (3,3,3-trifluoropropyl)trimethoxysilane, 3-(heptafluoroisopropoxy)propyltriethoxysilane, 1H,1H,2H,2H-perfluoroalkyltriethoxysilane, 1H,1H,2H,2H-perfluorodecyltriethoxysilane and 1H,1H,2H,2H-perfluorooctyltriethoxysilane may be added. The amount of the silane coupling agent may be determined as appropriate, whereas the amount of the fluorine-containing compound is preferably 0.25 times by weight or less, with respect to the fluorine-free compounds. Where the amount of the fluorine-containing compound exceeds the above-mentioned range, the film-forming property of the crosslinked film may be impaired.

A resin that are soluble in alcohols may also be added to the surface protective layer 5 for the purposes such as controlling of the discharge gas resistance, mechanical strength, scratch resistance, particle dispersibility and viscosity, reduction of the torque, controlling of the abrasive wear, extension of pot life, and the like.

The alcohol-soluble resin means a resin soluble in an alcohol having 5 or less carbon atoms at a ratio of 1% by weight or more. Examples of the resins that are soluble in an alcohol-based solvent include polyvinylbutyral resins, polyvinylformal resins, polyvinylacetal resins such as partially acetalized polyvinylacetal resins having butyral partially modified by formal or acetoacetal (for example, S-LEC B and K manufactured by Sekisui Chemical Co., Ltd., and the like), polyamide resins, cellulose resins and polyvinylphenolic resins. Specifically preferred are polyvinyl acetal resins and polyvinyl phenolic resins in view of electrical characteristics. The weight average molecular weight of the resin is preferably 2,000 to 100,000, more preferably 5,000 to 50,000. Where the molecular weight of the resin is less than 2,000, effects achieved by adding of the resin may be insufficient, and where the molecular weight exceeds 100,000, the solubility may be lowered to limit the content of the resin, which may cause film deficiencies during application. The content of the resin is preferably 1% by weight or more and 40% by weight or less, more preferably 1% by weight or more and 30% by weight or less, and further preferably 5% by weight or more and 20% by weight or less. Where the content of the resin is less than 1% by weight, effects achieved by adding the resin may be insufficient, and where the content exceeds 40% by weight, image blurring may occur at high temperature and humidity (for example, 28° C., 85% RH).

In order to suppress the deterioration caused by oxidizing gas such as ozone that is generated in the charging device, an antioxidant may be added to the protective layer 5. Higher resistance to oxidization than ever is required for a photoreceptor having enhanced surface mechanical strength and longer lifetime, since the photoreceptor tends to be exposed to oxidizing gas for the longer period of time. Preferable examples of the antioxidant include hindered phenol-based or hindered amine-based antioxidants, and known antioxidants such as organic sulfur-based antioxidant, phosphite-based antioxidants, dithiocarbamate-based antioxidants, thiourea-based antioxidants and benzimidazole-based antioxidants also may be used. The content of the antioxidant is preferably 20% by weight or less, more preferably 10% by weight or less.

Examples of the hindered phenol-based antioxidant may include 2,6-di-t-butyl-4-methylphenol, 2,5-di-t-butylhydroquinorie, N,N'-hexamethylenebis(3,5-di-t-butyl-4-hydroxyhydrocinnamide, 3,5-di-t-butyl-4-hydroxybenzylphosphonate diethyl ester, 2,4-bis[(octylthio)methyl]-o-cresol, 2,6-di-t-butyl-4-ethylphenol, 2,2'-methylenebis(4-methyl-6-t-butylphenol), 2,2'-methylenebis(4-ethyl-6-t-butylphenol), 4,4'-butylidenebis(3-methyl-6-t-butylphenol), 2,5-di-t-amylhydroquinone, 2-t-butyl-6-(3-butyl-2-hydroxy-5-methylbenzyl)-4-methylphenylacrylate, 4,4'-butylidenebis(3-methyl-6-t-butylphenol) and the like.

Examples of commercial products of the hindered phenol-base antioxidant may include "IRGANOX 1076", "IRGANOX 1010", "IRGANOX 1098", "IRGANOX 245", "IRGANOX 1330", "IRGANOX 3114", "IRGANOX 1076", "3,5-di-t-butyl-4-hydroxybiphenyl" and the like. Examples of the hindered amine-based antioxidant may include "SANOL LS2626", "SANOL LS765", "SANOL LS770", "SANOL LS744", "TINUVIN 144", "TINUVIN 622LD", "MARK LA57", "MARK LA67", "MARK LA62", "MARK LA68", "MARK LA63" and the like; examples of the thioether-based antioxidant may include "SUMILIZER TPS", "SUMILIZER TP-D" and the like; and examples of the phosphite-based antioxidant may include "MARK 2112", "MARK PEP-8", "MARK PEP-24G", "MARK PEP-36", "MARK 329K", "MARK HP-10" and the like.

In order to decrease the residual potential or improve the strength, the surface protective layer 5 may include various particles. An example of the particles is silicon-containing particles. The silicon-containing particles include silicon as a constitutional element, and specific examples thereof include colloidal silica and silicone particles. The colloidal silica used as silicon-containing particles is a dispersion of silica having an average particle size of 1 nm or more and 100 nm or less, preferably 10 nm or more and 30 nm or less in an acidic or alkaline aqueous dispersion, or an organic solvent such as alcohols, ketones and esters, and a commercially available product may be used. The solid content of the colloidal silica in the protective layer 5 is not particularly limited, but preferably 0.1% by weight or more and 50% by weight or less, preferably 0.1% by weight or more and 30% by weight or less, with respect to the total solid content of the protective layer 5 from the viewpoints of film-forming property, electrical characteristics, and strength.

The silicone particles used as the silicon-containing particles may be selected from the common commercially available products of silicone resin particles, silicone rubber particles and silicone surface-treated silica particles. These silicone particles are spherical, and preferably have an average particle size of 1 nm or more and 500 nm or less, and more preferably 10 nm or more and 100 nm or less. By using the silicone particles, the surface properties of the electrophotographic photoreceptor may be improved without inhibiting the crosslinking reaction, since the particles may exhibit an excellent dispersibility to resins because of being small in diameter and chemically inactive, and further, the content of the silicone particles required to achieve preferable characteristics may be small. More specifically, the particles are incorporated into a strong crosslinking structure without causing variation, and thereby enhancing the lubricity and water repellency of the surface of the electrophotographic photoreceptor, and maintaining the favorable abrasion resistance and stain resistance over the long time. The content of the silicone particles in the protective layer 5 is preferably 0.1% by weight or more and 30% by weight or less, more preferably 0.5% by weight or more and 10% by weight or less with respect to the total solid content in the protective layer 5.

Other examples of the particles include: fluorine particles such as ethylene tetrafluoride, ethylene trifluoride, propylene hexafluoride, vinyl fluoride and vinylidene fluoride; the particles as described in the proceeding of the $8^{th}$ Polymer Material Forum Lecture, p. 89, the particles including a resin prepared by copolymerization of a fluorocarbon resin with a hydroxy group-containing monomer; and semiconductive metal oxides such as $ZnO—Al_2O_3$, $SnO_2—Sb_2O_3$, $In_2O_3—SnO_2$, $ZnO_2—TiO_2$, $ZnO—TiO_2$, $MgO—Al_2O_3$, $FeO—TiO_2$, $TiO_2$, $SnO_2$, $In_2O_3$, ZnO and MgO. For the same purpose, an oil such as a silicone oil may be added. Examples of the silicone oil include: silicone oils such as dimethylpolysiloxane, diphenylpolysiloxane and phenylmethylsiloxane; reactive silicone oils such as amino-modified polysiloxane, epoxy-modified polysiloxane, carboxyl-modified polysiloxane, carbinol-modified polysiloxane, methacryl-modified polysiloxane, mercapto-modified polysiloxane and phenol-modified polysiloxane; cyclic dimethylcyclosiloxanes such as hexamethylcyclotrisiloxane, octamethylcyclotetrasiloxane, decamethylcyclopentasiloxane and dodecamethylcyclohexasiloxane; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane and 1,3,5,7,9-pentamethyl-1,3,5,7,9-pentaphenylcyclopentasiloxane; cyclic phenylcyclosiloxanes such as hexaphenylcyclotrisiloxane; fluorine-containing cyclosiloxanes such as (3,3,3-trifluoropropyl)methylcyclotrisiloxane; hydrosilyl group-containing cyclosiloxanes such as a methylhydrosiloxane mixture, pentamethylcyclopentasiloxane and phenylhydrocyclosiloxane; and vinyl group-containing cyclosiloxanes such as pentavinylpentamethylcyclopentasiloxane.

The surface protective layer 5 may further include a metal, a metal oxide, carbon black and the like. Examples of the metal include aluminum, zinc, copper, chromium, nickel, silver and stainless steel, and particles obtained by vapor-depositing any of these metals to plastic particles. Examples of the metal oxide include zinc oxide, titanium oxide, tin oxide, antimony oxide, indium oxide, bismuth oxide, tin-doped indium oxide, antimony-doped or tantalum-doped tin oxide, antimony-doped zirconium oxide and the like. These may be used alone or as a mixture of two or more kinds. Where two or more kinds are combined, they may be simply mixed or made into a solid solution or a fusion. The average particle size of the conductive particles is preferably 0.3 μm or less, particularly preferably 0.1 μm or less in view of transparency of the protective layer.

The surface protective layer 5 may include a curing catalyst for accelerating curing of the guanamine compound (for example, a compound represented by formula (A)) and the melamine compound (for example, a compound represented by formula (B)) or the charge transporting material. The curing catalyst is preferably an acid-based catalyst. Examples of the acid-based catalyst may include aliphatic carboxylic acids such as acetic acid, chloroacetic acid, trichloroacetic acid, trifluoroacetic acid, oxalic acid, maleic acid, malonic acid and lactic acid; aromatic carboxylic acids such as benzoic acid, phthalic acid, terephthalic acid and trimellitic acid; and aliphatic or aromatic sulfonic acids such as methanesulfonic acid, dodecylsulfonic acid, benzenesulfonic acid, dodecylbenzenesulfonic acid and naphthalenesulfonic acid. Of these, sulfur-containing materials are preferable.

Where a sulfur-containing material is used as the curing catalyst, the sulfur-containing material may exhibit excellent functions as the curing catalyst for the guanamine compound (for example, a compound represented by formula (A)) and the melamine compound (for example, a compound represented by formula (B)) or the charge transporting material, and may accelerate the curing reaction, which may lead to improving in the mechanical strength of the resultant surface protective layer 5. In cases where the compound represented by formula (I) (including formula (II)) is used as the charge transporting material, the sulfur-containing material may also exhibit excellent functions as a dopant for the charge transporting material, and may improve the electrical characteristics of the resultant functional layer. As a result of this, the resultant electrophotographic photoreceptor may have high levels of all of mechanical strength, film-forming ability, and electrical characteristics.

The sulfur-containing material as the curing catalyst is preferably acidic at normal temperature (for example 25° C.) or after heating, and is preferably at least one of organic sulfonic acids and derivatives thereof from the viewpoints of adhesiveness, ghost, and electrical characteristics. The presence of the catalyst in the protective layer 5 is readily detected by, for example, XPS.

Examples of the organic sulfonic acids and/or the derivatives thereof include p-toluenesulfonic acid, dinonylnaphthalenesulfonic acid (DNNSA), dinonylnaphthalenedisulfonic acid (DNNDSA), dodecylbenzenesulfonic acid and phenolsulfonic acid and the like, and most preferred are p-toluenesulfonic acid and dodecylbenzenesulfonic acid from the viewpoint of catalytic activity and film-forming property. A salt of an organic sulfonic acid may also be used, as long as it dissociates to some degree in a curable resin composition.

By using a so-called heat latent catalyst that exhibits high catalytic activity where a temperature of a certain degree or more is applied, both of the lowering of curing temperature and the storage stability may be achieved, since the catalytic activity at a temperature at which the liquid is in storage is low, while the catalytic activity at the time of curing is high.

Examples of the heat latent catalyst may include the microcapsules in which an organic sulfone compound or the like are coated with a polymer in the form of particles, porous compounds such as zeolite onto which an acid or the like is adsorbed, heat latent protonic acid catalysts in which a protonic acid and/or a derivative thereof are blocked with a base, a protonic acid and/or a derivative thereof esterified by a primary or secondary alcohol, a protonic acid and/or a derivative thereof blocked with a vinyl ether and/or a vinyl thioether, monoethyl amine complexes of boron trifluoride, and pyridine complexes of boron trifluoride.

From the viewpoint of catalytic activity, storage stability, availability and cost efficiency, the protonic acid and/or the derivative thereof that are blocked with a base are preferably used.

Examples of the protonic acid of the heat latent protonic acid catalyst may include sulfuric acid, hydrochloric acid, acetic acid, formic acid, nitric acid, phosphoric acid, sulfonic acid, monocarboxylic acid, polycarboxylic acids, propionic acid, oxalic acid, benzoic acid, acrylic acid, methacrylic acid, itaconic acid, phthalic acid, maleic acid, benzenesulfonic acid, o-, m- and p-toluenesulfonic acids, styrenesulfonic acid, dinonylnaphthalenesulfonic acid, dinonylnaphthalenedisulfonic acid, decylbenzenesulfonic acid, undecylbenzenesulfonic acid, tridecylbenzenesulfonic acid, tetradecylbenzenesulfonic acid and dodecylbenzenesulfonic acid. Examples of the protonic acid derivatives include neutralized alkali metal salts or alkali earth metal salts of protonic acids such as sulfonic acid and phosphoric acid, and polymer compounds in which a protonic acid skeleton is incorporated into a polymer chain (e.g., polyvinylsulfonic acid). Examples of the base that is used to block the protonic acid include amines.

The amines are classified into primary, secondary, and tertiary amines. In the invention, any of these amines may be used without limitation.

Examples of the primary amines may include methylamine, ethylamine, propylamine, isopropylamine, n-butylamine, isobutylamine, t-butylamine, hexylamine, 2-ethylhexylamine, secondary butylamine, allylamine, methylhexylamine and the like.

Examples of the secondary amines may include dimethylamine, diethylamine, di-n-propylamine, diisopropylamine, di-n-butylamine, diisobutylamine, di-t-butylamine, dihexylamine, di(2-ethylhexyl)amine, N-isopropyl N-isobutylamine, di(2-ethylhexyl)amine, disecondarybutylamine, diallylamine, N-methylhexylamine, 3-pipecholine, 4-pipecholine, 2,4-lupetidine, 2,6-lupetidine, 3,5-lupetidine, morpholine, N-methylbenzylamine and the like.

Examples of the tertiary amines include trimethylamine, triethylamine, tri-n-propylamine, triisopropylamine, tri-n-butylamine, triisobutylamine, tri-t-butylamine, trihexylamine, tri(2-ethylhexyl)amine, N-methylmorpholine, N,N-dimethylallylamine, N-methyldiallylamine, triallylamine, N,N-dimethylallylamine, N,N,N',N'-tetramethyl-1,2-diaminoethane, N,N,N',N'-tetramethyl-1,3-diaminopropane, N,N,N',N'-tetraallyl-1,4-diaminobutane, N-methylpiperidine, pyridine, 4-ethylpyridine, N-propyldiallylamine, 3-dimethylaminopropanol, 2-ethylpyrazine, 2,3-dimethylpyrazine, 2,5-dimethylpyrazine, 2,4-lutidine, 2,5-lutidine, 3,4-lutidine, 3,5-lutidine, 2,4,6-collidine, 2-methyl-4-ethylpyrndine, 2-methyl-5-ethylpyridine, N,N,N',N'-tetramethylhexamethylenediamine, N-ethyl-3-hydroxypiperidine, 3-methyl-4-ethylpyridine, 3-ethyl-4-methylpyridine, 4-(5-nonyl)pyridine, imidazole, N-methylpiperazine and the like.

Examples of the commercially available products may include "NACURE 2501" (toluenesulfonic acid dissociation, methanol/isopropanol solvent, pH; 6.0 or more and 7.2 or less, dissociation temperature; 80° C.), "NACURE 2107" (p-toluenesulfonic acid dissociation, isopropanol solvent, pH; 8.0 or more and 9.0 or less, dissociation temperature; 90° C.), "NACURE 2500" (p-toluenesulfonic acid dissociation, isopropanol solvent, pH; 6.0 or more and 7.0 or less, dissociation temperature, 65° C.), "NACURE 2530" (p-toluenesulfonic acid dissociation, methanol/isopropanol solvent, pH; 5.7 or more and 6.5 or less, dissociation temperature; 65° C.), "NACURE 2547" (p-toluenesulfonic acid dissociation, aqueous solution, pH; 8.0 or more and 9.0 or less, dissociation temperature; 107° C.), "NACURE 2558" (p-toluene sulfonic acid dissociation, ethyleneglycol solvent, pH; 3.5 or more and 4.5 or less, dissociation temperature; 80° C.), "NACURE XP-357" (p-toluenesulfonic acid dissociation, methanol solvent, pH; 2.0 or more and 4.0 or less, dissociation temperature; 65° C.), "NACURE XP-386" (p-toluenesulfonic acid dissociation, aqueous solution, pH; 6.1 or more and 6.4 or less, dissociation temperature; 80° C.), "NACURE XC-2211" (p-toluenesulfionic acid dissociation, pH; 7.2 or more and 8.5 or less, dissociation temperature; 80° C.), "NACURE 5225" (dodecylbenzenesulfonic acid dissociation, isopropanol solvent, pH; 6.0 or more and 7.0 or less, dissociation temperature; 120° C.). "NACURE 5414" (dodecylbenzenesulfonic acid dissociation, xylene solvent, dissociation temperature; 120° C.), "NACURE 5528" (dodecylbenzenesulfonic acid dissociation, isopropanol solvent, pH; 7.0 or more and 8.0 or less, dissociation temperature; 120° C.), "NACURE 5925" (dodecylbenzenesulfonic acid dissociation, pH; 7.0 or more and 7.5 or less, dissociation temperature; 130° C., "NACURE 1323" (dinonylnaphthalenesulfonic acid dissociation, xylene solvent, pH; 6.8 or more and 7.5 or less, dissociation temperature; 150° C.), "NACURE 1419" (dinonylnaphthalenesulfonic acid dissociation, xylene/methylisobutylketone solvent, dissociation temperature; 150° C.), "NACURE 1557" (dinonylnaphthalenesulfonic acid dissociation, butanol/2-butoxyethanol solvent, pH; 6.5 or more and 7.5 or less, dissociation temperature; 150° C.), "NACURE X49-110" (dinonylnaphthalenedisulfonic acid dissociation, isobutanol/isopropanol solvent, pH; 6.5 or more and 7.5 or less, dissociation temperature; 90° C.), "NACURE 3525" (dinonylnaphthalenedisulfonic acid dissociation, isobutanol/isopropanol solvent, pH; 7.0 or more and 8.5 or less, dissociation temperature; 120° C.), "NACURE XP-383" (dinonylnaphthalenedisulfonic acid dissociation, xylene solvent, dissociation temperature; 120° C.), "NACURE 3327" (dinonylnaphthalenedisulfonic acid dissociation, isobutanol/isopropanol solvent, pH; 6.5 or more and 7.5 or less, dissociation temperature; 50° C.), "NACURE 4167" (phosphoric acid dissociation, isopropanol/isobutanol solvent, pH; 6.8 or more and 7.3 or less, dissociation temperature; 80° C.), "NACURE XP-297" (phosphoric acid dissociation, water/isopropanol solvent, pH; 6.5 or more and 7.5 or less, dissociation temperature; 90° C., "NACURE 4575" (phosphoric acid dissociation, pH; 7.0 or more and 8.0 or less, dissociation temperature; 110° C.) (all manufactured by King Industries), and the like.

These heat latent catalysts may be used alone or in combination of two or more kinds thereof.

The amount of the catalyst to be incorporated is preferably in the range of 0.1% by weight or more and 50% by weight or less, and more preferably in the range of 10% by weight or more and 30% by weight or less, with respect to the amount of the at least one selected from a guanamine compound (for example, a compound represented by formula (A)) and a melamine compound (for example, a compound represented by formula (B)) (solid content concentration in the coating liquid). Where the amount to be incorporated is less than the above-mentioned range, catalyst activity may be too low, or where the amount to be incorporated exceeds the above-mentioned range, light resistance may be deteriorated. The light resistance refers to a phenomenon in which the concentration of the irradiated part is decreased where a photosensitive layer is exposed to light from external environment such as indoor light. Although the reason is not evident, it is deduced that a similar phenomenon to that of light memory effect may occur as described in JP-A No. 5-099737.

The surface protective layer S having the above-mentioned constitution may be formed by using a coating liquid for the surface protective layer including at least at least one selected from a guanamine compound (for example, a compound represented by formula (A)) and a melamine compound (for example, a compound represented by formula (B)) and at least one specific charge transporting material. Where necessary, any optional component(s) for the surface protective layer 5 may be added to the coating liquid for the surface protective layer.

The surface protective layer may be prepared with no solvent, or as necessary a solvent such as an alcohol, such as methanol, ethanol, propanol or butanol; a ketone, such as acetone or methyl ethyl ketone; and an ether, such as tetrahydrofiuran, diethyl ether or dioxane, may be used. The solvent may be used alone or as a mixture of two or more kinds thereof, and preferably has a boiling point of 100° C. or less. The solvent particularly preferably has at least one or more hydroxy groups (for example, an alcohol and the like).

The amount of the solvent may be arbitrarily selected, but is usually 0.5 parts by weight or more and 30 parts by weight or less, and preferably 1 part by weight or more and 20 parts by weight or less, with respect to 1 part by weight of the at least one kind selected from the guanamine compound (for example, a compound represented by formula (A)) and the melamine compound (for example, a compound represented by formula (B)), to suppress deposition of the guanamine compound (for example, a compound represented by formula (A)) and the melamine compound (for example, a compound represented by formula (B)) in case where the amount of the solvent is too small.

When the above-described components are reacted to make a coating liquid, they may be simply mixed and dissolved, or they may optionally be heated at a temperature of from room temperature (for example, 25° C.) to 100° C., preferably a temperature of from 30° C. to 80° C., for 10 minutes or more and 100 hours or less, preferably 1 hour or more and 50 hours or less. At this time, ultrasonic vibration may be applied. This probably may progress partial reaction, and may facilitates formation of a film with no coating defect and little variation in the film thickness.

The coating liquid for forming the surface protective layer is applied to the charge transporting layer 3 by an ordinary method such as blade coating, Mayer bar coating, spray coating, dip coating, bead coating, air knife coating, or curtain coating. The coating is cured as necessary under heating at a temperature, for example, 100° C. or more and 170° C. or less thereby forming the protective layer 5.

The film thickness of the surface protective layer 5 is preferably 1 μm or more and 15 μm or less, and more preferably 3 μm or more and 10 μm or less.

<Electroconductive Substrate>

Examples of the electroconductive substrate 4 may include metal plates, metal drums and metal belts in which a metal such as aluminum, copper, zinc, stainless steel, chromium, nickel, molybdenum, vanadium, indium, gold and platinum or an alloy thereof, is used; and papers, plastic films and belts which are coated, vapor-deposited or laminated with a conductive compound such as a conductive polymer or indium oxide, a metal such as aluminum, palladium or gold or alloys thereof. As used herein, the term "electroconductive" means that the volume resistivity is less than $10^{13}$ Ωcm.

When the electrophotographic photoreceptor 1A is used in a laser printer, it is desirable that the surface of the conductive substrate 4 is roughened so as to have a centerline average roughness (Ra) of 0.04 μm or more and 0.5 μm or less in order to suppress interference fringes which are formed when irradiated by laser light. When Ra is less than 0.04 μm, the surface is similar to a mirror surface and may have a tendency to exhibit unsatisfactory effect of interference suppression. When Ra exceeds 0.5 μm, the image quality may tend to become rough even if a film is formed. When an incoherent light source is used, surface roughening for suppressing interference fringes may be unnecessary, and occurrence of defects due to the irregular surface of the conductive substrate 4 may be suppressed, and thus the incoherent light source may be suitable for a longer service life.

Examples of the method for surface roughening may include wet honing in which an abrasive suspended in water is blown onto the surface of the electroconductive substrate 4, centerless grinding in which a support is continuously ground by pressing the support onto a rotating grind stone, anodic oxidation, and the like.

As a method of surface roughening, a method of surface roughening by forming a layer in which conductive or semiconductive particles are dispersed in a resin on the surface of the support so that the'surface roughening is achieved by the particles dispersed in the layer, without roughing the surface of the electroconductive substrate 4, may also be used.

In the surface-roughening treatment by anodic oxidation, an oxide film is formed on an aluminum surface by anodic oxidation in which an aluminum as anode is anodized in an electrolyte solution. Examples of the electrolyte solution may include a sulfuric acid solution and an oxalic acid solution. However, the porous anodic oxide film formed by anodic oxidation without modification is chemically active, easily contaminated and has a large variation in the resistance depending on the environment. Therefore, it is preferable to conduct a sealing treatment in which fine pores of the anodic oxide film are sealed by volume expansion caused by hydration in pressurized water vapor or boiled water (to which a metal salt such as a nickel salt may be added) to transform the anodic oxide into a more stable hydrated oxide.

The thickness of the anodic oxide film is preferably 0.3 μm or more and 15 μm or less. When the thickness of the anodic oxide film is less than 0.3 μm, the barrier property against injection may be low and the effects may tend to be insufficient. When the thickness of the anodic oxide film exceeds 15 μm, the residual potential may tend to be increased due to repeated use.

The electroconductive substrate 4 may be subjected to a treatment with an acidic aqueous solution or a boehmite treatment. Examples of the treatment with an acidic treatment solution include a treatment with an acidic treatment solution including phosphoric acid, chromic acid and hydrofluoric acid. The treatment with an acidic treatment solution including phosphoric acid, chromic acid and hydrofluoric acid is carried out as follows: phosphoric acid, chromic acid, and hydrofluoric acid are mixed to prepare an acidic treatment solution preferably in a mixing ratio of 10% by weight or more and 11% by weight or less of phosphoric acid, 3% by weight or more and 5% by weight or less of chromic acid, and 0.5% by weight or more and 2% by weight or less of hydrofluoric acid. The concentration of the total acid components is preferably in the range of 13.5% by weight or more and 18% % by weight or less. The treatment temperature is preferably 42° C. or more and 48° C. or less. When the treatment temperature is kept as high as the above temperature range, a thicker film may be obtained more speedily as compared to the case of a treatment temperature that is less than the above range. The thickness of the film is preferably 0.3 μm or more and 15 μm or less. When the thickness of the film is less than 0.3 μm, the barrier property against injection may be low, and sufficient effects may not be achieved. When the thickness exceeds 15 μm, the residual potential due to repeated use may be increased.

The boehmite treatment is carried out by immersing the substrate in pure water at a temperature of 90° C. or more and 100° C. or less for 5 minutes or more and 60 minutes or less, or by bringing it into contact with heated water vapor at a temperature of 90° C. or more and 120° C. or less for 5 minutes or more and 60 minutes or less. The film thickness is preferably 0.1 μm or more and 5 μm or less. The film may further be subjected to anodic oxidation using an electrolyte solution to which the film has low dissolubility, such as adipic acid, boric acid, boric acid salt, phosphoric acid salt, phthalic acid salt, maleic acid salt, benzoic acid salt, tartaric acid salt and citric acid salt solutions.

<Undercoating Layer>

The undercoating layer 1 includes, for example, a binding resin containing inorganic particles.

The inorganic particles preferably have powder resistance (volume resistivity) of $10^2$ Ω·cm or more and $10^{11}$ Ω·cm or less. This is because that the undercoating layer 1 requires adequate resistance in order to achieve leak resistance and carrier blocking properties. When the resistance value of the inorganic particles is less than the lower limit of the range, sufficient leak resistance may not be achieved, and when the resistance value is higher than the upper limit of the range, increase in residual potential may be caused.

Examples of the inorganic particles having the above resistance value include inorganic particles (electroconductive metal oxide) such as tin oxide, titanium oxide, zinc oxide, and zirconium oxide, and more preferred is zinc oxide.

The inorganic particles may be the ones which have been subjected to a surface treatment. Particles which have been subjected to different surface treatments, or those having different particle diameters, may be used in combination of two or more kinds. The volume average particle size of the inorganic particles is preferably in the range of 50 nm or more and 2000 nm or less (more preferably 60 nm or more and 1000 nm or less).

Inorganic particles having a specific surface area measured by BET method of 10 $m^2$/g or more are preferably used. When the specific surface area thereof is less than 10 $m^2$/g, lowering in charging property may be caused and the favorable electrophotographic characteristics may not be obtained.

When the undercoating layer includes inorganic particles and an acceptor compound, the undercoating layer that is superior in long-term stability of electrical characteristics and carrier blocking property may be obtained.

Any acceptor compound by which desired characteristics may be obtained may be used and examples thereof may include electron transporting substances such as quinone-based compounds such as chloranil and bromanil; tetracyanoquinodimethane-based compounds; fluorenone compounds such as 2,4,7-trinitrofluorenone and 2,4,5,7-tetranitro-9-fluorenone; oxadiazole-based compounds such as 2-(4-biphenyl)-5-(4-t-butylphenyl)-1,3,4-oxadiazole, 2,5-bis(4-naphtyl)-1,3,4-oxadiazole and 2,5-bis(4-diethylaminophenyl)-1,3,4-oxadiazole; xanthone-based compounds; thiophene compounds and diphenoquinone compounds such as 3,3',5,5'-tetra-t-butyldiphenoquinone, and particularly preferable are compounds having an anthraquinone structure. Preferred examples include acceptor compounds having an anthraquinone structure such as hydroxyanthraquinone-based compounds, aminoanthraquinone-based compounds, and aminohydroxyanthraquinone-based compounds, and specific examples thereof include anthraquinone, alizarin, quinizarin, anthrarufin and purpurin.

The content of the acceptor compound may be determined as appropriate within the range where desired characteristics may be achieved, but preferably the content is 0.01% by weight or more and 20% by weight or less relative to inorganic particles, more preferably 0.05% by weight or more and 10% by weight or less in terms of preventing accumulation of charge and aggregation of inorganic particles. The aggregation of the inorganic particles may cause irregular formation of conductive channels, deterioration of maintainability such as increase in residual potential, or image defects such as black points, when the photoreceptor is repeatedly used.

The acceptor compound may simply be added at the time of application of the undercoating layer, or may be previously attached to the surface of the inorganic particles. There are a dry method and a wet method as the method of attaching the acceptor compound to the surface of the inorganic particles.

Where a surface treatment is conducted according to a dry method, the acceptor compound is added dropwise to the inorganic particles or sprayed thereto together with dry air or nitrogen gas, either directly or in the form of a solution in which the acceptor compound is dissolved in an organic solvent, while the inorganic particles are stirred with a mixer or the like having a high shearing force, whereby the particles may be treated without causing irregular formation. The addition or spraying is preferably carried out at a temperature less than the boiling point of the solvent. When the spraying is carried out at a temperature equal to the boiling point of the solvent or higher, the solvent may evaporate before the inorganic particles are stirred to be mixed with the acceptor compound uniformly and the acceptor compound may coagulate locally so that the uniform treatment without causing variation may be difficult to conduct. After the addition or spraying of the acceptor compound, the inorganic particles may further be subjected to baking at a temperature of 100° C. or more. The baking may be carried out as appropriate at a temperature and timing by which desired electrophotographic characteristics may be obtained.

In a wet method, the inorganic particles are dispersed in a solvent by means of stirring, ultrasonic wave, a sand mill, an attritor, a ball mill or the like, then the acceptor compound is added and the mixture is further stirred or dispersed, thereafter the solvent is removed, and thereby the particles may be uniformly surface-treated. The solvent can be removed by filtration or distillation. After removing the solvent, the particles may be subjected to baking at a temperature of 100° C. or more. The baking may be carried out at any temperature and timing in which desired electrophotographic characteristics may be obtained. In the wet method, the moisture contained in the inorganic particles may be removed prior to adding the surface treatment agent. The moisture may be removed by, for example, stirring and heating the particles in the solvent used for the surface treatment, or by azeotropic removal with the solvent.

The inorganic particles may be subjected to a surface treatment prior to the attachment of the acceptor compound thereto. The surface treatment agent may be any agent by which desired characteristics may be obtained, and may be selected from known materials. Examples thereof include silane coupling agents, titanate-based coupling agents, aluminum-based coupling agents and surfactants. Among these, silane coupling agents are preferably used by which favorable electrophotographic characteristics may be provided. A silane coupling agents having an amino group may be preferably used, since it may impart favorable blocking properties to the undercoating layer 1.

Any compound of the silane coupling agents having an amino group may be used by which desired electrophotographic photoreceptor characteristics may be obtained. Specific examples thereof include γ-aminopropyltriethoxysilane, N-β-(aminoethyl)-γ-aminopropyltrimethoxysilane, N-β-(aminoethyl)-γ-aminopropylmethydilmethoxysilane, N,N-bis(β-hydroxyethyl)-γ-aminopropyltriethoxysilane and the like, but are not limited thereto.

The silane coupling agent may be used singly or in combination of two or more kinds thereof. Examples of the silane coupling agents which may be used in combination with the above-described silane coupling agents having an amino group may include vinyltrimethoxysilane, γ-methacryloxypropyl-tris-(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, γ-chloropropyltrimethoxysilane and the like, but are not limited thereto.

The surface treatment method using theses surface treatment agents may be any known method, preferably a dry or wet method. Alternatively, attachment of an acceptor and a surface treatment using a coupling agent or the like may be carried out simultaneously, The content of the silane coupling agent relative to the inorganic particles contained in the undercoating layer 1 may be determined as appropriate within a range in which the desired electrophotographic characteristics may be obtained, but preferably 0.5% by weight or more and 10% by weight or less from the viewpoint of improving dispersibility.

As the binding resin contained in the undercoating layer 1, any known resin that may form a favorable film and achieve desired characteristics may be used. Examples thereof may include known polymer resin compounds, e.g. acetal resins such as polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenolic resins, phenol-formaldehyde resins, melamine resins and urethane resins; charge transporting resins having a charge transporting group; and conductive resins such as polyaniline. Particularly preferred examples are resins which are insoluble in the coating solvent for the upper layer, specifically phenolic resins, phenol-formaldehyde resins, melamine resins, urethane resins, epoxy resins and the like. When two or more of these resins are used in combination, the mixing ratio may be appropriately determined according to the circumstances.

The ratio of the inorganic particles (metal oxide to which acceptor property has been imparted) having an acceptor compound attached to the surface thereof to the binder resin, or the ratio of the inorganic particles to the binder resin, in the coating liquid for forming the undercoating layer, may be appropriately determined within a range in which the desired electrophotographic photoreceptor characteristics may be obtained.

Various additives may be used for the undercoating layer 1 to improve electrical characteristics, environmental stability and image quality. Examples of the additives include known materials such as the polycyclic condensed type or azo-based type of the electron transporting pigments, zirconium chelate compounds, titanium chelate compounds, aluminum chelate compounds, titanium alkoxide compounds, organic titanium compounds and silane coupling agents. A silane coupling agent, which may be used for surface treatment of inorganic particles, may also be added to the coating liquid for forming the undercoating layer as additives.

Specific examples of the silane coupling agent as an additive may include vinyltrimethoxysilane, γ-methacryloxypropyl-tris(β-methoxyethoxy)silane, β-(3,4-epoxycyclohexyl) ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, γ-chloropropyltrimethoxysilane and the like.

Examples of the zirconium chelate compounds may include zirconium butoxide, zirconium ethyl acetoacetate, zirconium triethanolamine, acetylacetonate zirconium butoxide, acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, isostearate zirconium butoxide and the like.

Examples of the titanium chelate compounds may include tetraisopropyl titanate, tetranormalbutyl titanate, butyl titanate dimer, tetra(2-ethylhexyl) titanate, titanium acetyl acetonate, polytitaniumacetyl acetonate, titanium octylene glycolate, titanium lactate ammonium salt, titanium lactate, titanium lactate ethyl ester, titanium triethanol aminate, polyhydroxy titanium stearate and the like.

Examples of the aluminum chelate compounds may include aluminum isopropylate, monobutoxy aluminum diisopropylate, aluminum butylate, ethylacetoacetate aluminum diisopropylate, aluminum tris(ethylacetoacetate) and the like.

These compounds may be used alone, or as a mixture or a polycondensate of two or more kinds thereof.

The solvent for preparing the coating liquid for forming the undercoating layer may appropriately be selected from known organic solvents such as alcohol-based, aromatic-based, hydrocarbon halide-based, ketone-based, ketone alcohol-based, ether-based, and ester-based solvents. Examples of the solvent include common organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene and toluene.

These solvents may be used alone or as a mixture of two or more kinds thereof. Where they are mixed, any mixed solvents which may solve a binder resin may be used.

As methods of dispersing the inorganic particles, when the coating liquid for forming the undercoating layer is prepared, known methods such as a roll mill, a ball mill, a vibration ball mill, an attritor, a sand mill, a colloid mill and a paint shaker may be used.

For applying the undercoating layer 1, as a coating methods, general methods such as blade coating, wire bar coating, spray coating, dip coating, bead coating, air knife coating and curtain coating may be used.

The undercoating layer 1 is formed on the conductive substrate using the thus-obtained coating liquid for forming the undercoating layer.

The Vickers hardness of the undercoating layer 1 is preferably 35 or more.

The thickness of the undercoating layer 1 may be appropriately determined within the range in which the desired characteristics may be obtained, but preferably 15 μm or more, and more preferably 15 μm or more and 50 μm or less.

When the thickness of the undercoating layer 1 is less than 15 μm, sufficient antileak properties may not be obtained, while when the thickness of the undercoating layer 1 exceeds 50 μm or more, residual potential may tends to remain during the long-term operation and thus may cause the defects in image density.

The surface roughness of the undercoating layer 1 (ten point height of irregularities) is adjusted in the range of from $\frac{1}{4}\times n\times\lambda$ to $\frac{1}{2}\times\lambda$, wherein λ represents the wavelength of the laser for exposure to be used and n represents a refractive index of the upper layer, in order to prevent a moire image.

Particles of a resin or the like may also be added to the undercoating layer for adjusting the surface roughness thereof. Examples of the resin particles include silicone resin particles and crosslinking polymethyl methacrylate resin particles.

It is preferable that the undercoating layer includes a binder resin and an electroconductive metal oxide, and has light transmittance with respect to light at a wavelength of 950 nm at a thickness of 20 μm of 40% or less (preferably 10% or more and 35% or less, more preferably 15% or more and 30% or less). In an electrophotographic photoreceptor aiming at longer life, maintenance of stable high image quality is desirable. Similar property may also be required when a crosslink-type outermost layer (surface protective layer) is used. Where a crosslink-type outermost layer (surface protective layer) is used, an acid catalyst is used for curing in many cases, and higher film strength and higher printing durability may be obtained and longer life may be realized where the amount of the acid catalyst is larger with respect to the solid content of the outermost layer (surface protective layer). Meanwhile, since the residual catalyst in a balk acts as trap sites for electron charge, light fatigue resistance may be decreased, which may cause uneven image density upon exposure to light and the like during the maintenance operation and the like. Although the light resistance (light fatigue resistance) may be improved to a practically non-problematic level, by optimizing the amount of the materials (specifically the charge transporting material and the acid catalyst), it may not be considered to be sufficient with respect to exposure at a high luminance for a long time period in the cases of irradiation under circumstances brighter than general offices, for example, at places such as showrooms, and of observation of foreign substances adhered to the surface of the electrophotographic photoreceptor In order to obtain further longer life, it may be necessary to increase the curing catalyst to increase film strength, but in such case, light resistance may be insufficient. Therefore, by using an undercoating layer having a specific light transmittance (i.e., low light transmittance), the undercoating layer absorbs incident light to the electrophotographic photoreceptor, whereby an image having excellent light resistance against light having high intensity and being stable for a long time period may be obtained. Namely, since refractive light from the surface of the electroconductive substrate is decreased, light resistance (light fatigue resistance) against exposure to light having high brightness for a long time period is obtained, and longer life is realized even in the case, for example, where the amount of the curing catalyst is increased to enhance the strength of the outermost layer (surface protective layer) and improve the printing durability.

The light transmittance of the undercoating layer is measured as follows. A coating liquid for the undercoating layer is applied onto a glass plate so that the thickness after drying becomes 20 μm and dried, and light transmittance at a wavelength of 950 nm is measured using a spectrometer. The light transmittance by a spectrometer is measured by using a spectrometer (trade name: SPECTROPHOTOMETER (U-2000), manufactured by Hitachi Ltd.).

The light transmittance of the undercoating layer may be controlled by adjusting disperse time during dispersion using the above-mentioned roll mill, ball mill, oscillation ball mill, atriter, sand mill, colloid mill, paint shaker or the like. Although the disperse time is not specifically limited, it is preferably any time from 5 minutes to 1000 hours, and more preferably from 30 minutes to 10 hours. When the dispersion time is increased, the light transmittance may tend to be decreased.

The surface of the undercoating layer may be subjected to grinding for adjusting the surface roughness thereof. The grinding method such as buffing, sandblast treatment, wet honing, grinding treatment may be used for grinding.

The undercoating layer 1 may be obtained by drying the above-mentioned coating liquid for forming the undercoating layer applied on the electroconductive substrate 4, which is usually carried out by evaporating the solvent at a temperature at which a film may be formed.

<Charge Generating Layer>

The charge generating layer 2 is a layer containing a charge generating material and a binding resin.

Examples of the charge generating material include azo pigments such as bisazo and trisazo pigments, condensed-ring aromatic pigments such as dibromoantanthrone, perylene pigments, pyrrolopyrrole pigment, phthalocyanine pigment, zinc oxides and trigonal selenium. For laser exposure in the near-infrared region, preferable examples are metal or nonmetal phthalocyanine pigments, and more preferable are hydroxygallium phthalocyanine disclosed in JP-A Nos. 5-263007 and 5-279591, chlorogallium phthalocyanine disclosed in JP-A No. 5-98181, dichlorotin phthalocyanine disclosed in JP-A Nos. 5-140472 and 5-140473, and titanyl phthalocyanine disclosed in JP-A Nos. 4-189873. For laser exposure in the near-ultraviolet region, preferred examples are condensed aromatic pigments such as dibromoantanthrone, thioindigo-based pigments, porphyrazine compounds, zinc oxides and trigonal selenium. When a light source having an exposure wavelength of 380 nm or more and 500 nm or less is used, the charge generating material is preferably an inorganic pigment. When a light source having an exposure wavelength of 700 nm or less and 800 nm or more is used, the charge generating material is preferably a metal or non-metalphthalocyanine pigment.

As the charge generating material a hydroxygallium phthalocyanine pigment having the maximum peak wavelength in the range of 810 nm or more and 839 nm or less in the spectral absorbance spectrum in the wavelength area of 600 nm or more and 900 nm or less is preferable. This hydroxygallium phthalocyanine pigment is different from conventional V-type hydroxygallium phthalocyanine pigments and may have more excellent dispersibility. Accordingly, by shifting the maximum peak wavelength of the spectral absorbance spectrum to the lower wavelength side than that of the conventional V-type hydroxygallium phthalocyanine pigments, a fine hydroxygallium phthalocyanine pigment in which the crystal alignment of the pigment particles has been preferably controlled may be obtained, and when this fine hydroxygallium phthalocyanine pigment is used as a material for the electrophotographic photoreceptor, excellent dispersibility, sufficient sensitivity, chargeability and dark decay property may be obtained.

Furthermore, it is preferable that the hydroxygallium phthalocyanine pigment having the maximum peak wavelength in the range of 810 nm or more and 839 nm or less has an average particle size in a specific range and a BET specific surface area in a specific range. Specifically, the average particle size is preferably 0.20 μm or less, and more preferably 0.01 μm or more and 0.15 μm or less, and the BET specific surface area is preferably 45 $m^2/g$ or more, more preferably 50 $m^2/g$ or more, and specifically preferably 55 $m^2/g$ or more and 120 $m^2/g$ or less. The average particle size is a value represented by a volume average particle size (d50 average particle size), which is measured by a laser diffraction scattering particle size distribution measuring apparatus (trade name: LA-700, manufactured by Horiba, Ltd.). The BET specific surface area is a value measured using a BET specific surface area measuring apparatus (trade name: FLOW SORB II2300, manufactured by Shimadzu Corporation) by a nitrogen substitution method.

When the average particle size is more than 0.20 μm or the specific surface area value is less than 45 $m^2/g$, the pigment particles are coarse or aggregated, and the properties such as dispersiability, sensitivity, chargeability and dark decay property where the particles are used as a material for the electrophotographic photoreceptor may tend to be readily deteriorated, whereby image deficiencies may tend to be readily generated.

Furthermore, the maximum particle size (maximum value of the primary particle size) of the hydroxygallium phthalocyanine pigment is preferably 1.2 μm or less, more preferably 1.0 μm or less, and further preferably 0.3 μm or less. When the maximum particle size exceeds the above-mentined range, minute black spots may tend to be generated.

Furthermore, from the viewpoint of more reliable suppression of uneven density due to exposure of the photoreceptor to a fluorescent lamp or the like, it is preferable that the hydroxygallium phthalocyanine pigment has an average particle size of 0.2 μm or less, a maximum particle size of 1.2 μm or less, and a specific surface area value of 45 $m^2/g$ or more.

Moreover, it is preferable that the hydroxygallium phthalocyanine pigment has diffraction peaks at Bragg's angles ($2\theta \pm 0.2°$) of 7.5°, 9.9°, 12.5°, 16.3°, 18.6°, 25.1° and 28.3° in an X-ray diffraction spectrum using CuKα characteristic X-ray.

In addition, where the temperature is raised from 25° C. to 400° C., the hydroxygallium phthalocyanine pigment has a thermal weight loss, preferably 2.0% or more and 4.0% or less, and more preferably 2.5% or more and 3.8% or less. The thermal weight loss is measured by a thermal balance or the like. Where the thermal weight loss exceeds 4.0%, impurities included in the hydroxygallium phthalocyanine pigment may affect the electrophotographic photoreceptor, whereby sensitivity property, stability of electropotential during repetitive use and image quality may tend to be deteriorated. Where the thermal weight loss is less than 2.0%, sensitivity may tend to be decreased. The reason for this is thought to be that the hydroxygallium phthalocyanine pigment shows sensitization effect by interaction with a trace amount of solvent molecules included in the crystalline.

Where the above-mentioned hydroxygallium phthalocyanine pigment is used as the charge generating material for the electrophotographic photoreceptor, optimum sensitivity and excellent photoelectric effect of the photoreceptor may be obtained, and image quality may be excellent since dispersiability in the binder resin included in the photosensitive layer may be excellent.

It has been known that generation of initial fogging and black spots may be suppressed by specifying the average particle size and the BET specific surface area of the hydroxygallium phthalocyanine pigment, but there was a problem that fogging and black spots may be generated after long time use. In this regard, when the specific outermost layer (a protective layer including a crosslinking film formed by using at least one selected from a guanamine compound and a melamine compound and a specific charge transporting material) mentioned below is used, generation of fogging and black spots after long time use, which was a problem in a combination use of a conventional outermost layer and a charge generating layer, may be suppressed. The reason for this is thought to be that abrasion of a film and deterioration of chargeability that are generated due to long time use are suppressed by use of the above-mentioned protective layer. Furthermore, even when a thinner film of the charge transporting layer is formed to improve electric property (decrease of residual potential), fogging and black spots, which generated in conventional photoreceptors, may be suppressed.

The binding resin used in the charge generating layer 2 may be selected from a wide range of insulating resins, and from organic light conductive polymers such as poly-N-vinyl carbazole, polyvinyl anthracene, polyvinyl pyrene and polysilane. Preferable examples of the binding resin may include polyvinyl butyral resins, polyarylate resins (polycondensates of bisphenols and aromatic divalent carboxylic acid or the like), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, polyvinyl pyrrolidone resins and the like. These binding resins may be used alone or in combination of two or more kinds thereof The mixing ratio between the charge generating material and the binding resin is preferably in the range of 10:1 to 1:10 by weight ratio. The term "insulating" means that the volume resistivity is $10^{13}$ Ω·cm or more.

The charge generating layer 2 may be formed using a coating liquid in which the above-described charge generating materials and binding resins are dispersed in a solvent.

Examples of the solvent used for dispersion may include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, toluene and the like, which may be used alone or in combination of two or more kinds.

For dispersing the charge generating materials and the binding resins in a solvent, ordinary methods such as a ball mill dispersion method, an attritor dispersion method and a sand mill dispersion method may be used. By these dispersion methods, deformation of crystals of the charge generating material caused by dispersion may be suppressed. The average particle size of the charge generating material to be dispersed is preferably 0.5 μm or less, more preferably 0.3 μm or less and further preferably 0.15 μm or less.

For forming the charge generating layer 2, conventional methods such as blade coating, Meyer bar coating, spray coating, dip coating, bead coating, air knife coating or curtain coating may be used.

The film thickness of the thus obtained charge generating layer 2 is preferably 0.1 μm or more and 5.0 μm or less, and more preferably 0.2 μm or more and 2.0 μm or less.

<Charge Transporting Layer>

The charge transporting layer 3 may include a charge transporting material and a binding resin, or the charge transporting layer 3 may include a polymer charge transporting material.

Examples of the charge transporting material include charge transporting compounds such as quinone-based compounds such as p-benzoquinone, chloranil, bromanil and anthraquinone, tetracyanoquinodimethane-based compounds, fluorenone compounds such as 2,4,7-trinitrofluorenone, xanthone-based compounds, benzophenone-based compounds, cyanovinyl-based compounds, and ethylene-based compounds; and positive hole-transporting compounds such as triarylamine-based compounds, benzidine-based compounds, arylalkane-based compounds, aryl substituted ethylene-based compounds, stilbene-based compounds, anthracene-based compounds and hydrazone-based compounds. These charge transporting materials may be used alone or in combination of two or more kinds thereof. The charge transporting material is not limited the above described examples.

Preferable examples of the charge transporting material include a triarylamine derivative represented by the following formula (a-1) and a benzidine derivative represented by the following formula (a-2), from the viewpoint of charge mobility.

(a-1)

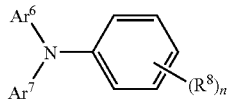

In formula (a-1), $R^8$ is a hydrogen atom or a methyl group; n is 1 or 2; $Ar^6$ and $Ar^7$ are each independently a substituted or unsubstituted aryl group, $—C_6H_4—C(R^9)=C(R^{10})(R^{11})$ or $—C_6H_4—CH=CH—CH=C(R^{12})(R^{13})$, wherein $R^9$ through $R^{13}$ are each independently a hydrogen atom, a substituted or unsubstituted alkyl group, or a substituted or unsubstituted aryl group. The substituent is a halogen atom, an alkyl group having 1 to 5 carbon atoms, an alkoxy group having 1 to 5 carbon atoms, or an amino group substituted with an alkyl group having 1 to 3 carbon atoms.

(a-2)

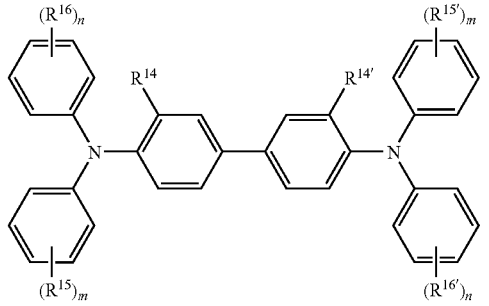

In formula (a-2), $R^{14}$ and $R^{14'}$ may be the same or different from each other, and are each independently a hydrogen atom, a halogen atom, an alkyl group having 1 to 5 carbon atoms, or an alkoxy group having 1 to 5 carbon atoms; $R^{15}$, $R^{15'}$, $R^{16}$ and $R^{16'}$ may be the same or different from each other, and are each independently a hydrogen atom, a halogen atom, an alkyl group having 1 to 5 carbon atoms, an alkoxy group having 1 to 5 carbon atoms, an amino group substituted with an alkyl group having 1 to 2 carbon atoms, a substituted or unsubstituted aryl group, $—C(R^{17})=C(R^{18})(R^{19})$ or $—CH=CH—CH=C(R^{20})(R^{21})$, wherein $R^{17}$ through $R^{21}$ are each independently a hydrogen atom, a substituted or unsubstituted alkyl group, or a substituted or unsubstituted aryl group; and m and n are each independently an integer of 0 or more and 2 or less.

Among the triarylamine derivatives represented by formula (a-1) and the benzidine derivatives represented by formula (a-2), triarylamine derivatives having "$—C_6H_4—CH=CH—CH=C(R^{12})(R^{13})$" and benzidine derivatives having "$—CH=CH—CH=C(R^{20})(R^{21})$" are particularly preferable since they are excellent in charge mobility, adhesiveness to the protective layer, and a residual image caused by the hysteresis of the preceding image (hereinafter sometimes referred to as "ghost").

Examples of the binding resin used in the charge transporting layer 3 include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinyl carbazole and polysilane. Further, polymer charge transporting materials may also be used as the binding resin, such as the polyester-based polymer charge transporting materials disclosed in JP-A Nos. 8-176293 and 8-208820. These binding resins may be used alone or in combination of two or more kinds thereof. The mixing ratio between the charge transporting material and the binding resin may be 10:1 to 1:5 by weight ratio.

Although the binder resin is not specifically limited, it is preferable to use at least one kind selected from a polycarbonate resin having viscosity average molecular weight of 50000 or more and 80000 or less, and a polyarylate resin having a viscosity average molecular weight of 50000 or more and 80000 or less since a fine film, may readily be obtained.

As the charge transporting material, a polymer charge transport material may also be used. As the polymer charge transporting material, known materials having charge transporting property such as poly-N-vinyl carbazole and polysilane may be used. Polyester-based polymer charge transporting materials disclosed in JP-A Nos. 8-176293 and 8-208820, having high charge transporting properties, are particularly preferable. Charge transporting polymer materials may form a film alone, but may also be mixed with the later-described binding resin to form a film.

The charge transporting layer 3 may be formed using the coating liquid for forming the charge transporting layer containing the above-described constituents. Examples of the solvent used for the coating liquid for forming the charge transporting layer include ordinary organic solvents such as aromatic hydrocarbons such as benzene, toluene, xylene and chlorobenzene, ketones such as acetone and 2-butanone, aliphatic hydrocarbon halides such as methylene chloride, chloroform and ethylene chloride, cyclic or straight-chained ethers such as tetrahydrofuran and ethyl ether. These solvents may be used alone or in combination of two or more kinds thereof. Known methods may be used for dispersing the above-described constituents.

For applying the coating liquid for forming the charge transporting layer onto the charge generating layer 2, ordinary methods such as blade coating, Meyer bar coating, spray coating, dip coating, bead coating, air knife coating and curtain coating may be used.

The film thickness of the charge transporting layer 3 is preferably 5 to 50 μm and more preferably 10 to 30 μm.

An example of the function separation type photosensitive layer included in the electrophotographic photoreceptor 7A as shown in FIG. 1 is explained above. In the single layer type photosensitive layer 6 (charge generating/charge transporting layer) included in the electrophotographic photoreceptor 7C as shown in FIG. 3, the content of the charge generating material may be about 10% by weight or more and 85% by weight or less, preferably 20% by weight or more and 50% by weight or less, and the content of the charge transporting material is preferably 5% by weight or more and 50% by weight or less. The method for forming the single layer type photosensitive layer 6 (charge generating/charge transporting layer) is similar to the methods for forming the charge generating layer 2 and the charge transporting layer 3. The film thickness of the single layer type photosensitive layer (charge generating/charge transporting layer) 6 is preferably about 5 μm or more and 50 μm or less, and further preferably 10 μm or more and 40 μm or less.

In the electrophotographic photoreceptors 7A to 7C shown in FIGS. 1 to 3, for the purpose of suppressing generation of ozone and oxidic gas in the image forming apparatus, or deterioration of the photoreceptor due to light or heat, additives such as antioxidants, light stabilizers and heat stabilizers may be added to the layers constituting the photosensitive layer Examples of the antioxidant may include hindered phenol, hindered amine, p-phenylenediamine, arylalkanes, hydroquinone, spirochromane, spiroindanone and derivatives thereof, organic sulfur compounds, organic phosphor compounds, and the like.

Examples of the light stabilizer may include derivatives such as benzophenone, benzotriazole, dithiocarbamate and tetramethylpiperidine. Furthermore, for the purposes of improvement of sensitivity, decreasing of residual potential, decreasing of fatigue during repetitive use and the like, at least one kind of electron-accepting materials may be added. Examples of electron-accepting materials that may be used may include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chroranyl, dinitroanthraquinone, trinitrofluorenone, picric acid, o-nitrobenzoic acid, p-nitrobenzoic acid, phthalic acid and the like. Of these, benzene derivatives having an electron withdrawing substituent such as a fluorenone-based substituent, a quinone-based substituent, Cl—, CN— or $NO_2$— are specifically preferable.

Furthermore, it is preferable to treat the surface protective layer 5 in the electrophotographic photoreceptors 7A to 7C as shown in FIGS. 1 to 3 with an aqueous dispersion liquid including a fluorine-based resin, as in the blade member, since torque may further be decreased and transfer efficiency may be improved.

Toner

Hereinafter the toner used for the image forming apparatus of the present exemplary embodiment is explained.

The toner used for the image forming apparatus of the present exemplary embodiment is a toner including silica, more specifically, a toner for developing electrostatic latent images in which silica has been added as an external additive to toner particles (hereinafter also referred to as toner mother particles) including at least a binder resin and a colorant.

As used in the present specification, the "toner" means toners including toner particles and an external additive added to the particles.

As the toner used for the image forming apparatus of the present exemplary embodiment, one having an average shape factor of 100 or more and 150 or less is also preferable.

As used herein, the average shape factor is a number average value of shape factors obtained for toner particles. The shape factor for each toner particle may be obtained by importing an image obtained by observing the toner by an optical microscope into an image analyzer (for example, trade name: LUZEX III, manufactured by Nireco Corporation) to measure a circle-equivalent diameter, and calculating from the maximum length and surface area according to the following equation (i):

$$(ML^2/A)=(\text{maximum length})^2\times\pi\times100/[4\times(\text{projection area})] \quad \text{(i)}$$

Where the particle has a perfect spherical shape, $ML^2/L=100$.

The average shape factor may be obtained, for example, by obtaining shape factors for any 100 toner particles based on the equation (i) and averaging out the values per particles.

Where a toner having a shape factor represented by the above-mentioned equation (i) of 100 or more and 150 or less, so-called a spherical toner, is used in an image forming apparatus, property of removing of the residual toner remained on the surface of the electrophotographic photoreceptor after transfer may tend to be lowered, due to that the toner is spherical and thus the toner sneaks through the blade member during removal of the toner remained on the surface of the electrophotographic photoreceptor after the transfer by the residual toner removing unit, and the like. However, in the image forming apparatus of the present exemplary embodiment having the above-mentioned constitution, even when a toner having an average shape factor ($ML^2/A$) of 100 or more and 150 or less is used, sneaking of the toner between the electrophotographic photoreceptor and the blade members in the residual toner removing unit may be effectively suppressed, and thus the property of removing the toner remained on the surface of the electrophotographic photoreceptor after a toner image is transferred on the transfer medium may be excellent and good images may be obtained repetitively for a long time period.

<Binder Resin>

The binder resin is not specifically limited, and known resin materials may be used. Examples of the binder resin may include crystalline resins and amorphous resins. Specifically, crystalline resins having sharp melt property (sharp melting property) are useful for providing low temperature fixing property.

It is preferable that the crystalline resin is used in the range of 5% by weight or more and 30% by weight or less in the components for constituting the toner. More preferably, it is used in the range of 8% by weight or more and 20% by weight or less. Where the ratio of the crystalline resin is 30% by weight or more, fine fixing property may be obtained, but the phase separation structure in the fixing image may become uneven and the strength of the fixing image, specifically the scratch strength may be decreased and the image may become susceptible to scratches. On the other hand, where the ratio of the crystalline resin is less than 5% by weight, sharp melt property derived from the crystalline resin may not be obtained and only plasticization of the amorphous resin may occur, and thus the toner blocking resistance property and image preserving property may not be maintained while keeping favorable low temperature fixing property.

The "crystalline resin" means a resin that shows a distinct endothermic peak, not a stepwise change in the endothermic caloric value thereof in differential scanning calorimetry (DSC). As used herein, the "crystalline" in the crystalline resin means that the resin shows a distinct endothermic peak, not a stepwise change in the endothermic caloric value thereof in differential scanning calorimetry (DSC), specifically, that the half width of the endothermic peak measured at a temperature raising velocity of 10° C./min is within 6° C. On the other hand, resins having a half width of more than 6° C. and resins having no distinct endothermic peak mean amorphous resins. It is preferable to use a resin having no distinct endothermic peak as the amorphous resin included in the toner of the present exemplary embodiment.

The crystalline resin is not specifically limited as long as it has crystallinity, and specific examples may include crystalline polyester resins and crystalline vinyl resins. Crystalline polyesters are preferable in view of fixing property on paper during fixing, chargeability, and adjustment of a melting point to a preferable range. Furthermore, as the crystalline resin, aliphatic crystalline polyester resins having a suitable melting point are more preferable.

As the crystalline polyester resin, a commercial product may be used, or a suitably synthesized crystalline polyester resin may be used.

The crystalline polyester resin is generally synthesized by using a polyvalent carboxylic acid component and a polyvalent alcohol component.

Examples of the polyvalent carboxylic acid component may include, but are not limited to, aliphatic dicarboxylic acids such as oxalic acid, succinic acid, glutalic acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid and 1,18-octadecanedicarboxylic acid; aromatic dicarboxylic acids such as dibasic acids such as phthalic acid, isophthalic acid, terephthalic acid, naphthalene-2,6-dicarboxylic acid, malonic acid and mesaconic acid; and the like, as well as anhydrides thereof and lower alkyl esters thereof.

Examples of the tri- or more valent carboxylic acid may include 1,2,4-benzenetricarboxylic acid, 1,2,5-benzenetricarboxylic acid and 1,2,4-naphthalenetricarboxylic acid, and anhydrides thereof and lower alkyl esters thereof. These may be used by solely or as a combination of two or more kinds.

The polyvalent carboxylic acid component preferably includes a dicarboxylic acid component having a sulfonic acid group besides the aliphatic dicarboxylic acid or the aromatic dicarboxylic acid. The dicarboxylic acid having a sulfonic acid group is effective since it may improve dispersion of colorants such as pigments. Furthermore, where sulfonic acid groups are present during preparation of particles by emulsifying or suspending whole resin in water, emulsification or suspension may be performed without using a surfactant, as mentioned below.

Examples of the dicarboxylic acid having a sulfonic acid group may include, but are not limited to, sodium 2-sulfotelephthalate, sodium 5-sulfoisophthalate, sodium sulfosuccinate and the like. In addition, lower alkyl esters and acid anhydride thereof are also exemplified. These di- or more valent carboxylic acid components having a sulfonic acid group is included preferably by 0 mol % or more and 20 mol %, and more preferably by 0.5 mol % or more and 100 mol % or less, with respect to the total carboxylic acid components that are used for the polyester. Where the content is less than 0.5 mol %, stability over time of the emulsification particles may be deteriorated, whereas where the content is more tan 10 mol %, the crystallinity of the polyester resin may be deteriorated. In addition, where the toner is prepared by the aggregation and coalescence method mentioned below, the particles may negatively affect the step for coalescing the particles after aggregation, and that adjustment of the toner diameter may become difficult.

Furthermore, it is more preferable to include a dicarboxylic acid component having a double bond besides the aliphatic dicarboxylic acid or aromatic dicarboxylic acid. The dicarboxylic acid component having a double bond may be preferably used for suppressing hot offset during fixing since it may bond by radically crosslinking via a double bond. Examples of such dicarboxylic acid may include, but are not limited to, maleic acid, fumaric acid, 3-hexenedioic acid, 3-octenedioic acid and the like. Furthermore, lower esters thereof acid anhydrides thereof and the like may also be included. Of these, fumaric acid and maleic acid may be mentioned in view of cost.

As the polyvalent alcohol component, aliphatic diols are preferable, and straight chain aliphatic diols having 7 to 20 carbon atoms in the main chain part are more preferable. Where the aliphatic diol is branched-type, the crystallinity of the polyester resin is lowered and the melting point is lowered, which may cause deterioration of toner blocking resistance, image preserving property and low temperature fixing property. Furthermore, where the carbon number is less than 7, the melting point becomes higher during condensation polymerization with the aromatic dicarboxylic acid, which may sometimes make low temperature fixing difficult, whereas where the carbon number exceeds 20, a practical material becomes difficult to obtain. More preferably, the carbon number is 14 or less.

Specific examples of the aliphatic diol preferably used for the synthesis of the crystalline polyester may include, but are not limited to, ethyleneglycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,14-eicosanedecanediol and the like. Of these, 1,8-octanediol, 1,9-nonanediol and 1,10-decanediol are preferable in view of availability.

Examples of the tri- or more valent alcohol may include glycerin, trimethylolethane, trimethylolpropane, pentaerythritol and the like. These may be used by solely one kind or as a combination of two or more kinds.

In the polyvalent alcohol component, the content of the aliphatic diol component is preferably 80 mol % or more, and more preferably 90% or more. Where the content of the aliphatic diol component is less than 80 mol %, the crystallinity of the polyester resin is decreased and the melting point is decreased, which may cause deterioration of toner blocking resistance, image preserving property and low temperature fixing property.

Where necessary, monovalent acids such as acetic acid and benzoic acid, and monovalent alcohols such as cyclohexanol and benzylalcohol may also be used for the purpose of adjustment of acid value and hydroxy group value, and the like.

The production method of the crystalline polyester resin is not specifically limited, and the crystalline polyester resin is produced by a general polymerization method for polyesters by a reaction between an acidic component and an alcoholic component. Examples of the production method may include direct polycondensation, transesterification and the like, which are used according to the kinds of the monomers.

The crystalline polyester resin may be produced at a polymerization temperature between 180° C. or more and 230° C. or less. Where necessary, the reaction is performed while the pressure in the reaction system is reduced so as to remove water and alcohol generated during condensation. Where the monomer is not dissolved or compatible at the reaction temperature, it may be dissolved by adding a solvent having a high boiling point as a dissolution aid. The polycondensation reaction is performed while removing the dissolution aid. Where a monomer having poor compatibility are used in copolymerization reaction, it is preferable to condensate the monomer having poor compatibility and an acid or an alcohol to be polycondensed with the monomer in advance, and polycondensate the condensate with the main component.

A dispersion liquid of resin particles of the crystalline polyester may be prepared by emulsification dispersion by adjustment of the acid value of the resin, or emulsification dispersion using an ionic surfactant or the like.

Examples of the catalyst that may be used during production of the crystalline polyester resin may include alkali metal compounds such as sodium and lithium; alkaline earth metal compounds such as magnesium and calcium; metal compounds such as zinc, manganese, antimony, titanium, tin, zirconium and germanium; phosphite compounds; phosphate compounds; amine compounds and the like, specifically the following compounds.

Examples may include compounds such as sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributyl antimony, tin formate, tin oxalate, tetraphenyl tin, dibutyltin dichloride, dibutyltin oxide, diphenyltin oxide, zirconium tetrabutoxide, zirconium naphthenate, zirconyl carbonate, zirconyl acetate, zirconyl stearate, zirconyl octylate, germanium oxide, triphenyl phosphite, tris(2,4-t-butylphenyl) phosphite, ethyltriphenylphosphonium bromide, triethylamine and triphenylamine.

Examples of the crystalline vinyl resins may include vinyl resins including (meth)acrylic acid esters of long chain alkyls and alkenyls such as amyl(meth)acrylate, hexyl(meth)acrylate, heptyl(meth)acrylate, octyl(meth)acrylate, nonyl(meth) acrylate, decyl(meth)acrylate, undecyl(meth)acrylate, tridecyl(meth)acrylate, myristyl(meth)acrylate, cetyl(meth) acrylate, stearyl(meth)acrylate, oleyl(meth)acrylate and behenyl(meth)acrylate. In the present specification, the description "(meth)acryl" means to include both "acryl" and "methacryl".

The melting point of the crystalline resin is preferably 50° C. or more and 100° C., and more preferably 60° C. or more and 80° C. or less. Where the melting point is less than 50° C., problems of the preserve property of the toner and the preserve property of the toner image after fixing may be caused, whereas where the melting point is more than 100° C., sufficient low temperature fixing may not be obtained as compared to that of a conventional toner. Furthermore, some crystalline resins may show plural of melting peaks, the maximum peak is considered to be a melting point in the present specification.

As the amorphous resin, known resin materials may be used, and amorphous polyester resins are specifically preferable. The amorphous polyester resin may be obtained by, for example, polycondensation of a polyvalent carboxylic acid and a polyvalent alcohol.

It is advantageous to use the amorphous polyester resin, since a dispersion liquid of resin particles may be readily prepared by adjusting the acid value of the resin and emulsification dispersion using an ionic surfactant and the like.

Examples of the polyvalent carboxylic acid may include aromatic carboxylic acids such as telephthalic acid, isophthalic acid, phthalic anhydride, trimellitic anhydride, pyromellitic acid and naphthalenedicarboxylic acid; and aliphatic carboxylic acids such as maleic anhydride, fumaric acid, succinic acid, alkenyl succinic anhydride and adipic acid; and alicyclic carboxylic acids such as cyclohexane dicarboxylic acid. These polyvalent carboxylic acids may be used by one kind or two or more kinds. Of these polyvalent carboxylic acids, it is preferable to use aromatic carboxylic acids. Furthermore, in order to have a crosslinking structure or a branched structure to ensure fine fixing property, it is preferable to use a dicarboxylic acid and a tri- or more valent carboxylic acid (for example, trimellitic acid or acid anhydride thereof) in combination.

Examples of the polyvalent alcohol may include aliphatic diols such as ethylene glycol, diethylene glycol, triethylene glycol, propylene glycol, butanediol, hexanediol, neopentyl glycol and glycerin; alicyclic diols such as cyclohexane diol, cyclohexane dimethanol and hydrogenated bisphenol A; aromatic diols such as ethylene oxide additive of bisphenol A and propylene oxide additive of bisphenol A. These polyvalent alcohols may be used by one kind or two or more kinds. Of these polyvalent alcohols, the aromatic diols and alicyclic diols are preferable, of which the aromatic diols are more preferable. Furthermore, in order to have a crosslinking structure or a branched structure to ensure fine fixing property, a diol and a tri- or more valent polyvalent alcohol (glycerin, trimethylol propane, pentaerythritol) may be used in combination. Moreover, the acid value of the polyester resin may be adjusted by further adding a monocarboxylic acid and/or a monoalcohol to the polyester resin obtained by polycondensation of the polyvalent carboxylic acid and the polyvalent alcohol to esterify the hydroxyl groups and/or carboxyl groups at the polymerization terminals. Examples of the monocarboxylic acid may include acetic acid, acetic anhydride, benzoic acid, trichloroacetic acid, trifluoroacetic acid, propionic anhydride and the like, and examples of the monoalcohol may include methanol, ethanol, propanol, octanol, 2-ethylhexanol, trifluoroethanol, trichloroethanol, hexafluoroisopropanol and phenol.

The amorphous polyester resin is produced by condensation reaction of the polyvalent alcohol and the polyvalent carboxylic acid according to a general method. For example, it is produced by charging a polyvalent alcohol and a polyvalent carboxylic acid, and where necessary, a catalyst, in a reaction container equipped with a thermometer, a stirrer and a falling condenser, heating the mixture in the presence of inert gas (nitrogen gas or the like) at 150° C. or more and 250° C. or less, continuously removing the by-products of low molecular compounds out of the reaction system, quenching the reaction at the time when the acid value reaches a predetermined value and cooling to give the objective reaction product.

Examples of the catalyst used for the synthesis of the amorphous polyester resin may include organic metals such as dibutyltin dilaurate and dibutyltin oxide, and esterified catalysts such as metal alkoxido such as tetrabutyl titanate. The amount of such catalyst is preferably 0.01 to 1.00 wt % with respect to the total amount of the raw materials.

The amorphous resin has a weight average molecular weight (Mw) by measurement of molecular by gel permeation chromatography (GPC) of the soluble contents in tetrahydrofuran (THF) of, preferably 5000 or more and 1000000 or less, and more preferably 7000 or more and 500000 or less; a number average molecular weight (Mn) of 2000 or more and 10000 or less; and a molecular weight distribution Mw/Mn of preferably 1.5 or more and 100 or less, more preferably 2 or more and 60 or less.

Where the weight average molecular weight and number average molecular weight are smaller than the above-mentioned ranges, it may be effective for low temperature fixing property, whereas the hot offset resistance may be significantly deteriorated and the glass transition temperature of the toner may be decreased, as compared to the case where the molecular weights are in the above-mentioned ranges, and thus the preserving property such as blocking of the toner may be adversely affected. On the other hand, where the molecular weights are larger than the above-mentioned ranges, the hot offset resistance may be sufficiently imparted as compared to the case where the molecular weights are in the above-mentioned ranges, but the low temperature fixing property may be deteriorated, and leaking of the crystalline polyester phase in the toner may be prevented, whereby the document preserving property may be adversely affected. Accordingly, by satisfying the above-mentioned conditions, balancing of low temperature fixing property, hot offset resistance and document may become easy.

In the present specification, the molecular weight of the resin is calculated by using a molecular weight calibration curve prepared using a monodispersed polystyrene standard sample by measuring the substances soluble in THF using a THF solvent using GPC HLC-8120 (manufactured by Tosoh Corporation) and TSK gel Super HM-M (15 cm) (manufactured by Tosoh Corporation).

The acid value of the polyester resin (number of mg of KOH required for neutralizing 1 g of the resin) is preferably 1 mg KOH/g to 30 mg KOH/g, since the molecular weight distribution as mentioned above may be readily obtained, granulation property of the toner particles by emulsification dispersion method may be readily ensured, the environment stability (stability of chargeability where the temperature and humidity are changed) of the toner may be readily kept fine, and the like. The acid value of the polyester resin may be adjusted by controlling the carboxyl groups at the terminals of the polyester by controlling the incorporation ratio and reaction percentage of the polyvalent carboxylic acid and the polyvalent alcohol as raw materials. Alternatively, a polyester having carboxyl groups in the main chain may be obtained by using trimellitic acid anhydride as the polyvalent carboxylic acid component.

Furthermore, styrene acrylic resins may also be used as known amorphous resins. In this case, examples of the monomers that may be used may include polymers of monomers such as styrenes such as styrene, p-chlorostyrene and α-methylstyrene; esters having a vinyl group such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate and 2-ethylhexyl methacrylate; vinylnitriles such as acrylonitrile and methacrylonitrile; vinyl ethers such as vinyl methyl ether and vinyl isobutyl ether; vinyl ketones such as vinyl methyl ketone, vinyl ethyl ketone and vinyl isopropenyl ketone; and polyolefins such as ethylene, propylene and butadiene, and copolymers obtained by combining two or more kinds of those monomers, or mixtures thereof. Furthermore, non-vinyl condensed resins such as epoxy resins, polyester resins, polyurethane resins, polyamide resins, cellulose resins and polyether resins; or mixtures of these resins and a vinyl-based resin; and graft polymers obtained during polymerization of a vinyl monomer in the presence of these resins may also be used.

The glass transition temperature of the amorphous resin is preferably 35° C. or more and 100° C. or less, and more preferably 50° C. or more and 80° C. or less in view of the balance between the storage stability and fixing property of the toner. Where the glass transition temperature is less than 35° C., the toner may tend to cause blocking (phenomenon that the toner particles aggregate to form a mass) during storage or in a developing device. On the other hand, where the glass transition temperature is higher than 100° C., the fixing temperature of the toner may become high.

Furthermore, the softening point of the amorphous resin is preferably in the range of 80° C. or more and 130° C. or less. More preferable softening point is in the range of 90° C. or more and 120° C. or less. Where the softening point is 80° C. or less, the toner and the image stability of the toner may be significantly deteriorated after fixing and during storage. Where the softening point is 130° C. or more, low temperature fixing property may be deteriorated.

The measurement value of the softening point of the amorphous resin refers to the intermediate temperature between the melting-initiating temperature and the melting-ending temperature under the conditions of a flow tester (trade name: CFT-500C, manufactured by Shimadzu Corporation), preheating: 80° C./300 sec, plunger pressure: 0.980665 MPa, die size: 1 mmϕ×1 mm and temperature raising velocity: 3.0° C./min.

<Releasing Agent>

The toner may include a releasing agent.

The releasing agent is preferably a substance having a main maximum peak measured according to ASTMD 3418-8, the disclosure of which is incorporated by reference herein, in the range of 50 to 140° C. Where the main maximum peak is less than 50° C., offset may be liable to occur in fixing. Where the main maximum peak exceeds 140° C., the fixing temperature may be increased and the smoothness on the surface of the fixed image may become insufficient, whereby the gloss property may be deteriorated.

The measurement of the main maximum peak is conducted, for example, by using DSC-7 (manufactured by Perkin Elmer, Inc.) The temperature compensation at the detection part of the apparatus is conducted by using the melting points of indium and zinc, the compensation of heat quantity is conducted by using the heat of fusion of indium. The measurement is conducted by using a pan made of aluminum for a sample, and by setting a vacant pan for control, at a temperature increasing rate of 10° C. per minute.

Furthermore, the viscosity $\eta 1$ at 160° C. of the releasing agent is preferably 20 mPa·s or more and 600 mPa·s. Where the viscosity $\eta 1$ is less than 20 m Pa·s, hot offset may readily occur, and where the viscosity $\eta 1$ is higher than 600 mPa·s, cold offset may occur during fixing.

In addition, the ratio of the viscosity $\eta 1$ at 160° C. and the viscosity $\eta 2$ at 200° C. ($\eta 2/\eta 1$) is preferably in the range of 0.5 or more and 0.7 or less. Where $\eta 2/\eta 1$ is less than 0.5, the amount of bleeding at low temperature is small and cold offset may occur. Where $\eta 2/\eta 1$ is higher than 0.7, the amount of bleeding at high temperature is large and wax offset may occur, as well as stability of peeling may be affected.

Specific examples of the releasing agent used in the invention include low molecular weight polyolefins such as polyethylene, polypropylene and polybutene; silicones exhibiting a softening point by heating; aliphatic amides such as oleic acid amide, erucic acid amide, ricinoleic acid amide and stearic acid amide; vegetable waxes such as carnauba wax, rice wax, candelilla wax, wood wax and jojoba oil; animal waxes such as bees wax; mineral or petroleum waxes such as montan wax, ozokerite, ceresin, paraffin wax, microcrystalline wax and Fischer-Tropsch wax; and modified products thereof.

<Colorant>

The colorant to be included in the toner is not specifically limited and may be a known colorant, and may be suitably selected according to the purpose. As the colorant, the following pigments and the like may be used.

Examples of the black pigment may include carbon black, magnetic powder and the like. Examples of the yellow pigment may include Hansa yellow, Hansa yellow 10G, benzidine yellow G, benzidine yellow GR, threne yellow, quinoline yellow, permanent yellow NCG and the like. Examples of the red pigment may include red iron oxide, watchung red, permanent red 4R, lithol red, brilliant carmine 3B, brilliant carmine 6B, Dupont oil red, pyrazolone red, rhodamine B lake, lake red C, rose Bengal, coxine red, alizarin lake and the like.

Examples of the blue pigment may include Prussian blue, cobalt blue, alkali blue lake, Victoria blue lake, fast skyblue, induthrene blue BC, aniline blue, ultramarine blue, Calco oil blue, methylene blue chloride, phthalocyanine blue, phthalocyanine green, malachite green oxalorate and the like.

These pigments may also used as a mixture or in the state of a solid solution.

These colorants are dispersed by known methods, and media type dispersing machines such as a rotary shearing type homogenizer, a ball mill, a sand mill and an attriter, a high-pressure opposing collision type dispersing machine, and the like are preferably used.

In addition, these colorants may also be dispersed into an aqueous medium by using an ionic surfactant having a polarity and using the above-mentioned homogenizer to prepare a dispersion liquid of the colorant particles.

<External Additive>

The toner used for the image forming apparatus of the present exemplary embodiment includes silica as an external additive. Since silica has high chargeability, readily adheres to the photoreceptor even in the liberated state and has suitably high electric resistance, it may be hard to be transferred. Therefore, since silica is readily supplied to residual toner removing unit (cleaning device), the significant effect of the image forming apparatus of the present exemplary embodiment may be exhibited by including silica as an external additive.

In the present exemplary embodiment, the silica to be used as an external additive preferably has a volume average particle size of 80 nm or more and 1000 nm or less. Where the volume average particle size is less than 80 nm, the silica tends to act less effectively on decrease of non-electrostatic adhesion force as compared to the case where the silica has a particle size of 80 nm or more. Specifically, a silica having a volume average particle size of less than 80 nm may be readily embedded in the toner particles due to stress in the image forming apparatus, and may sometimes be separated. On the other hand, a silica having a volume average particle size of higher than 1000 nm may be readily detached from the toner particles as compared to the case of the silica having a particle size of 1000 nm or less, and even though the silica may be separated, it may tend to be difficult to adhere to the residual toner that is remained on the photoreceptor after transfer before the residual toner forms a toner dam. The preferable range of the volume average size of the silica is 80 nm or more and 500 nm or less, and specifically preferable range is 150 nm or more and 300 nm or less.

The measurement method for the particle size where the particle diameter to be measured is less than 2 μm as in the external additives such as silica is performed by using a laser diffraction-type particle size distribution measuring apparatus (trade name: LA-700, manufactured by Horiba Ltd.). In the measurement method, a sample in the form of a dispersion liquid is adjusted to have a solid content of about 2 g, and ion exchanged water is added up to about 40 ml. The liquid is put into a cell until a suitable concentration and allowed to wait for about 2 minutes, and measurement is initiated at the time the concentration in the cell become almost constant. The volume average particle sizes for every obtained channels are accumulated from lower sizes, and the point at which the accumulation becomes 50% is considered as the volume average particle size.

It is preferable that the silica is monodispersed and has a spherical shape. The silica being monodispersed and having a spherical shape (hereinafter also referred to as monodispersed spherical silica) is uniformly dispersed on the surfaces of the toner particles, whereby stable spacer effect may be obtained.

The definition of "monodispersed" in the present specification may be discussed using a standard deviation to an average particle size including aggregates, and the volume average particle size is preferably D50×0.22 or less as a standard deviation. Furthermore, the definition of "spherical" in the present specification may be discussed according to Wadell's sphericity, and the sphericity is preferably 0.6 or more, and more preferably 0.8 or more.

The monodispersed spherical silica having a volume average particle size of 80 nm or more and 1000 nm or less may be obtained by a sol-gel process that is a wet process. Furthermore, the true specific gravity of the thus-obtained silica may be controlled to be less than that in a vapor phase oxidizing process since the silica is prepared by the wet method without calcination. Moreover, the true specific gravity may further be controlled by controlling the kind of the hydrophobizing treatment agent or the amount of the treatment in the hydrophobizing process. The particle size of the monodispersed spherical silica may be freely controlled by hydrolysis in a sol-gel process, the weight ratio of alkoxysilane, ammonia, alcohol and water in the polycondensation process, the reaction temperature, the stirring velocity and the feeding velocity. The monodispersed spherical form may be achieved by preparing using this technique.

Examples of the method for producing the specific monodispersed spherical silica may include the following method.

Tetramethoxysilane is added dropwise in the presence of water and alcohol using an aqueous ammonia as a catalyst and the mixture is stirred. The silica sol suspension liquid obtained by the reaction is then separated into wet silica gel, alcohol and aqueous ammonia by centrifugation. A solvent is added to the wet silica gel to form a silica sol again, and a hydrophobizing treatment agent is added to hydrophobize the silica surface. As the hydrophobizing treatment agent, a general silane compound may be used. The solvent is then removed from the hydrophobized silica sol, and the residue is dried and sieved to give the objective monodispersed spherical silica. The thus-obtained silica may be subjected to the treatment again. The production method of the monodispersed spherical silica is not limited to the above-mentioned method.

As the silane compound used for the production of the monodispersed spherical silica, a water-soluble one may be used. Examples of such silane compound may include a compound represented by the following chemical structure formula.

$$R_aSiX_{4-a}$$

In the above chemical structure formula, a is an integer of 0 to 3, R is a hydrogen atom, or an organic group (for example, an alkyl group or an alkenyl group), and X is a chlorine atom, or a hydrolysable group (for example, a methoxy group or an ethoxy group).

As the silane compound, any type of chlorosilanes, alkoxysilanes, silazanes and specific silylating agents may be used. Typical examples may include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltrimethoxysilane, decyltrimethoxysilane, hexamethyldisilazane, N,O-(bistrimethylsilyl)acetamide, N,N-bis(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane and γ-chloropropyltrimethoxysilane. Specifically preferable hydrophobizing agent in the invention may include dimethyldimethoxysilane, hexamethyldisilazane, methyltrimethoxysilane, isobutyltrimethoxysilane, decyltrimethoxysilane and the like.

It is preferable that the silica sufficiently covers the surfaces of the toner particles in order to control the flowability and chargeability of the toner. Where necessary, it is preferable to use an inorganic compound having a small particle size and/or organic particles in combination with silica. As the inorganic compound having a small particle size, an inorganic compound having a volume average particle size of 80 nm or less is preferable, and an inorganic compound having a volume average particle size of 50 nm or less is more preferable. Specific examples may include all particles that are generally used as external additives for the surface of the toner such as alumina, titania, calcium carbonate, magnesium carbonate, calcium triphosphate, cerium oxide, zinc oxide, titanium oxide and tin oxide. Examples of the organic particles may include all particles that are generally used as external additives for the surface of the toner such as vinyl-based resins, polyester resins, silicone resins and fluorine-based resins. Furthermore, a lubricant may be added. Examples of the lubricant may include aliphatic acid amides such as ethylenebisstearic acid amide and oleic acid amide, aliphatic acid metal salts such as zinc stearate and calcium stearate, and the like.

<Production Method of Toner>

Next, one preferable example of the method for the production of the toner is explained.

It is preferable to obtain toner particles (toner mother particles) to be included in the toner by a wet process including an aggregating step in which aggregated particles are formed in a dispersion liquid in which at least resin particles and colorant particles have been dispersed, and a coalescing step in which the aggregated particles are heated to coalescing the aggregated particles, since a toner having a small particle diameter having a sharp particle size distribution may be obtained, and a toner with which full-color images having high image quality may be formed, may be obtained.

In the aggregation step, a dispersion liquid of resin particles including at least a binder resin and a dispersion liquid of a colorant including a colorant, and where necessary, other components such as a dispersing liquid of a releasing agent are added and mixed to give a dispersion liquid, an aggregating agent is added thereto, and the mixture is stirred under heating so as to aggregate the resin particles, the colorant and the like to form aggregated particles.

It is preferable that the volume average particle size of the aggregated particles is in the range of 2 μm or more and 9 μm or less. Resin particles (additional particles) may be further added to the thus-formed aggregated particles to give cover layers on the surfaces of the aggregated particles (adhering step). The resin particles (additional particles) to be further added in the step of adhering are not necessary the same as the dispersion liquid of the resin particles used in the above-mentioned aggregation step.

The particle size of the aggregated particles may be measured by, for example, a laser diffraction-type particle size distribution measuring apparatus (LA-700, manufactured by Horiba Ltd.).

As the resin used for the aggregating step and the adhering step, it is preferable to mix a resin having a relatively high molecular weight so that the external additive may be easily separated. Specific preferable examples of such resin may include resins having a Z average molecular weight Mz of 100000 to 500000.

Next, in the coalescing step, the aggregated particles are heated to, for example, a temperature equal to or more than the glass transition temperature of the resin, generally 7° C. or more and 120° C. or less, to coalesce the aggregated particles to give a liquid containing the toner particles (dispersion liquid of the toner particles). The obtained liquid containing the toner particles is treated by centrifugation or aspiration filtration to separate the toner particles, and the toner particles are washed by ion exchanged water one to three times. During this step, washing effect may further be enhanced by adjusting the pH. The toner particles are then separated by filtration, washed by ion exchanged water one to three times, and dried. Thus, the toner particles used for the toner of the present exemplary embodiment may be obtained.

In the toner of the present exemplary embodiment, silica is added as an external additive to the toner particles. The amount to be added of the silica with respect to the toner particles is preferably 0.3% by weight or more and 15% by weight or less, and more preferably 1% by weight or more and 10% by weight or less.

Furthermore, the toner may be used as a mixture with a carrier. As the carrier, iron powder, glass beads, ferrite powder, nickel powder, or carriers obtained by coating the surface of these materials with a resin may be used. The mixing ratio with respect to the carrier may be decided.

Residual Toner Removing Unit

Figure 6:
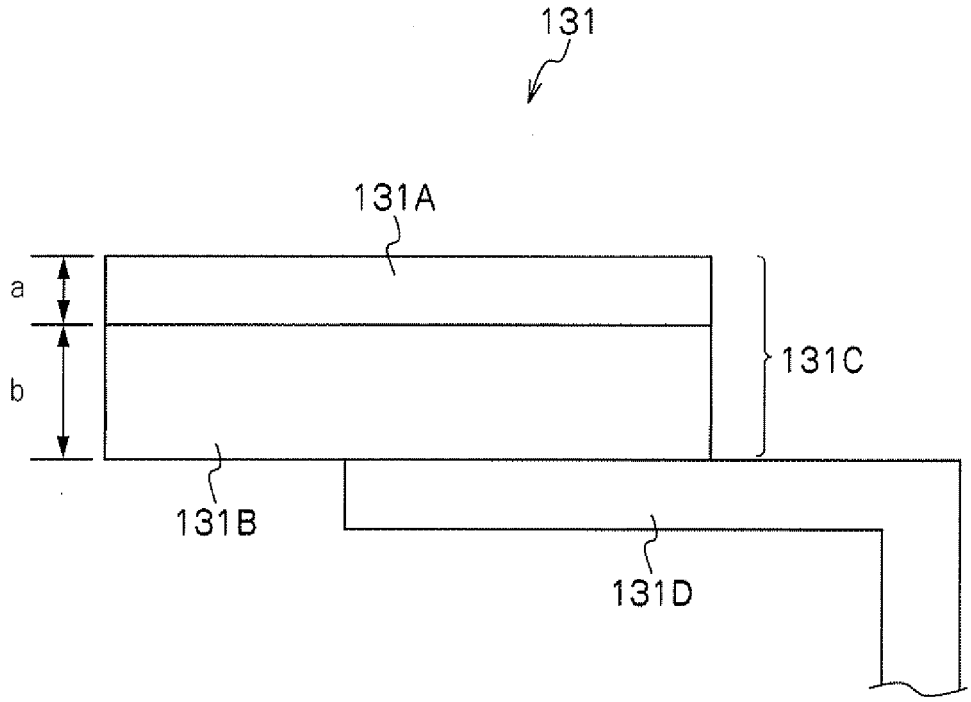
FIG. 6 is a schematic cross-sectional view of one example of an cleaning blade provided in a cleaning device of an exemplary embodiment.

The residual toner removing unit (cleaning device) in the present exemplary embodiment includes a blade member (hereinafter suitably referred to as "cleaning blade") including a base layer and an edge layer having a type A durometer hardness of HsA 75 (or about HsA 75) or more and HsA 90 (or about HsA 90) or less at 23° C., the hardness of the edge layer being higher than the hardness of the base layer. FIG. 6 is a schematic constitutional view showing the cleaning blade that is provided in the cleaning device of the present exemplary embodiment.

As shown in FIG. 6, the cleaning blade 131 includes a support member 131D (support portion) and a rubber member 131C. The rubber member 131C is a member to be pressed to contacted with the surface of the electrophotographic photoreceptor (not depicted), and has a two-layer structure including a edge layer 131A and a base layer 131B. The rubber member 131C is bonded by adhesion or the like to the main face on one end portion (one end portion in the width direction) of the support member 131D, in which the main face of the base layer 131B is opposed to the rubber member 131C.

In the rubber member 131C, the edge layer 131A has a function to scrape off the toner remained on the surface of the photoreceptor surface, and the base layer 131B has a function to adjust the force of the edge portion of the elastic rubber member 131C to contact to the image carrier by pressure.

The edge layer 131A has a type A durometer hardness of HsA 75 (or about HsA 75) or more and HsA 90 (or about HsA 90) or less at 23° C., and the hardness of the edge layer is higher than the hardness of the base layer 131B.

It is preferable that the edge layer 131A includes a material having, at 23° C., a type A durometer hardness of HsA 75 or more and HsA 90 or less (preferably HsA 80 or more and HsA 90 or less), a modulus of repulsion elasticity of 5% or more and 20% or less preferably 8% or more and 15% or less) and a permanent elongation of 5% or less (preferably 1% or more and 3% or less).

Where the type A durometer hardness of the edge layer 131 is less than 75, the hardness is insufficient, and the peak value of the distribution of the pressure contact force applied to the edge layer 131 may become too small to clean the small particle size toner or spherical toner during scraping off the toner remaining on the photoreceptor. Where the type A durometer hardness of the edge layer 131 exceeds 90, the surface of the photoreceptor may be deteriorated since the hardness is too high.

In the present specification, the "type A durometer hardness" refers to a value measured by a spring type A durometer hardness testing machine according to JIS K 7312, the disclosure of which is incorporated by reference herein.

Where the modulus of repulsion elasticity of the edge layer 131A exceeds 20%, the cleaning blade 100 may cause stick-slip behavior (oscillation behavior of the blade edge during rotation of the photoreceptor) following the movement of the photoreceptor, which may cause sneaking of the toner and abnormal sound.

In the present specification, the "modulus of repulsion elasticity" refers to a value measured according to the repulsion elasticity test of JIS K 7312.

Where the permanent elongation of the edge layer 131A exceeds 5%, settling may occur after the blade abutted to the photoreceptor for a long time period and stable pressure contact force may not be obtained for a long time period.

In the present specification, the "permanent elongation" refers to a value measured according to the permanent elongation test of JIS K 7312. In this case, the elongation percentage of 200%.

The base layer 131B is a layer having a hardness less than the hardness of the edge layer 131A. It is preferable that the base layer 131B include a material having, at 23° C., a type A durometer hardness of HsA 60 (or about HsA 60) or more and HsA 75 (or about HsA 75) or less (preferably HsA 62 or more and HsA 72 or less), a modulus of repulsion elasticity of 25% or more 40% or less (preferably 28% or more and 35% or less) and a permanent elongation of 1.5% or less preferably 0.5% or more and 1.2% or less).

Where the type A durometer hardness of the base layer 131B is out of the above-mentioned range, it may be difficult to adjust the pressure contact force between the photoreceptor contact portion of the edge layer 131A, and the photoreceptor.

Where the modulus of repulsion elasticity of the base layer 131B is less than 25%, the pressure contact force between the edge layer 131A and the photoreceptor may become insufficient and sneaking of the toner may occur, and where the modulus of repulsion elasticity exceeds 40%, the oscillation at the edge portion may not be absorbed and the life span of the cleaning blade 100 may be shorten. Where the permanent elongation of the base layer 131B exceeds 1.5%, settling may occur after the blade abutted to the photoreceptor for a long time period and stable pressure contact force may not be obtained for a long time period.

The thickness of the edge layer 131A shown by "a" in FIG. 6 is preferably 0.2 mm or more and 1.5 mm or less, and more preferably 0.5 mm or more and 1.0 mm or less. The thickness of the base layer 131B shown by "b" in FIG. 6 is preferably 1.0 mm or more and 3.0 mm or less, and more preferably 1.5 mm or more and 2.5 mm or less. The ratio of the thickness of the edge layer 131A to the thickness of the base layer 131B (a:b) is preferably 1:20 to 1:2, and more preferably 1:10 to 1:3.

Specific elastic material for forming the rubber member 131C is preferably, for example, those including polyurethane. Polyurethane is not specifically limited as long as it is generally used for forming polyurethanes. For example, polyurethane in which a urethane prepolymer obtained from a polyol such as polyesterpolyols such as polyethylene adipate and polycaprolactone and an isocyanate such as diphenylmethane diisocyanate, and a crosslinking agent such as 1,4-butanediol, trimethylolpropane or ethyleneglycol or mixtures thereof as raw materials, is preferable, in view of obtaining a rubber member which has excellent antiabrasion property and high mechanical strength. Examples of preferable urethane prepolymer may include those having a content of NCO groups of4% by weight or more and 10% by weight or less, and a viscosity at 70° C. of 1000 mPa·s or more and 3000 mPa·s or less.

Where the rubber member 131C is prepared from a polyurethane, a method generally used for forming a polyurethane may be used. Examples of the method include the following method. First, a polyol that has been subjected to a dehydration treatment is mixed with an isocyanate; the mixture is reacted at a temperature of 100° C. or more and 120° C. or less for 30 minutes or more and 90 minutes or less to form a prepolymer; a crosslinking agent and the like are added to the prepolymer; and the mixture is injected into a mold of a centrifugation forming machine that is preheated to 140° C., and cured for 5 minutes or more and 15 minutes or less to form the base layer 131B. After the curing reaction, the material for the edge layer that has been pretreated in a similar manner is poured on the cured base layer and cured for 30 minutes to 60 minutes to form the edge layer 131A. After the curing reaction, the sheet is taken from the mold to give a cylindrical two layer structure sheet having a thickness of 2 mm or more and 3 mm or less. This is cut into a strip having a width of 5 mm or more and 30 mm and a length of 200 mm to 500 mm to give the rubber member 131C.

The support member 131D is not specifically limited and examples thereof include a support member that is integrated with the housing of the cleaning device, a mounting bracket for mounting on the housing, and the like. Examples of the mounting brackets may include those made of metals, plastics, ceramics and the like, and specifically preferable examples may include mounting brackets made of untreated steel plates, steel plates whose surface has been subjected to zinc phosphate treatment, chromate treatment or the like, as well as steel plates that have been subjected to plating treatment, and the like, in view of that they may be less likely to cause change over time such as corrosion.

The method for adhering the rubber member 131C and the support member 131D is not specifically limited, and adhesion methods using an EVA-based adhesive, a polyamide-based adhesive, a polyurethane-based hot melt adhesive, an epoxy-based adhesive, a phenol-based adhesive and the like may be used. Of these methods for adhesion, it is preferable to use hot-melt adhesion method.

The pressure contact force of the cleaning blade 100 (rubber member 131C) against the electrophotographic photoreceptor is preferably 20 N/m or more and 80 N/m or less, more preferably 20 N/m or more and 60 N/m or less, and further preferably 20 N/m or more and 50 N/m or less. By adjusting the pressure contact force to the above-mentioned range, toner removability may be improved, and application of local force on the surface of the electrophotographic photoreceptor may be suppressed. As a result, local abrasion of the surface of the electrophotographic photoreceptor may be suppressed, and fine images may be obtained repetitively for a long time period.

Image Forming Apparatus/Process Cartridge

Figure 4:
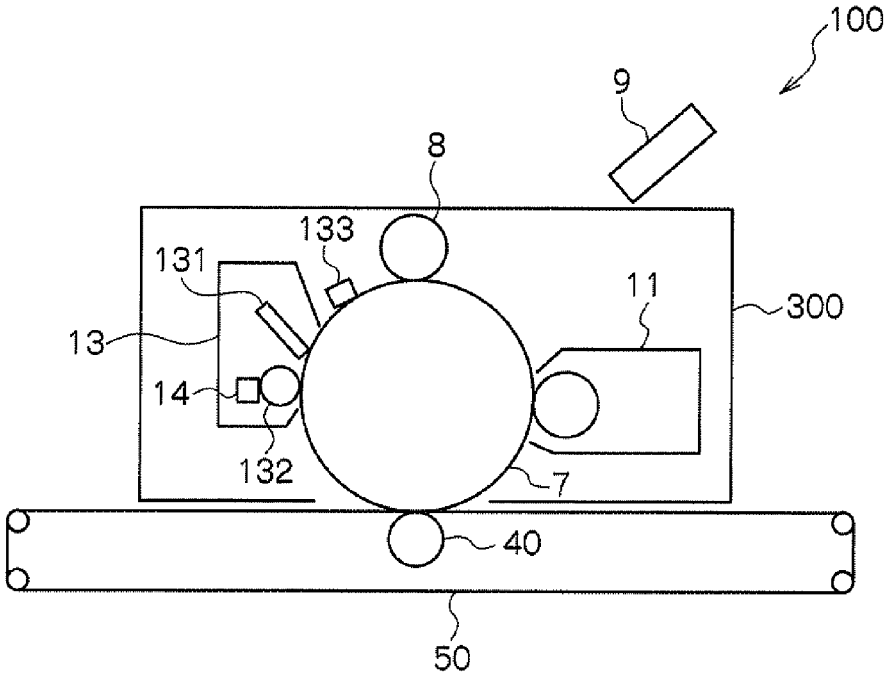
FIG. 4 is a schematic constitutional view of an image forming apparatus of an exemplary embodiment.

FIG. 4 is a schematic constitutional view showing an image forming apparatus of an exemplary embodiment. As shown in FIG. 4, the image forming apparatus 100 includes a process cartridge 300 that includes the electrophotographic photoreceptor 7, an exposure device 9, a transfer device 40 and an intermediate transfer body 50. In the image forming apparatus 100, the exposure device 9 is disposed on the position capable of exposing the electrophotographic photoreceptor 7 to the light from the opening of the process cartridge 300; the transfer device 40 is disposed on the position opposing to the electrophotographic photoreceptor 7 across the intermediate transfer body 50; and the intermediate transfer body 50 is disposed so that it partially contacts with the electrophotographic photoreceptor 7.

The process cartridge 300 in FIG. 4 integrally supports the electrophotographic photoreceptor 7, the charging device 8, the developing device 11 and the cleaning device 13 in the housing. The cleaning device 13 has the cleaning blade 131 (blade member), and the cleaning blade 131 is disposed so that it contact with the surface of the electrophotographic photoreceptor 7.

An example of the constitution of the cleaning blade 131 is as explained above with referring to FIG. 6.

In the example shown in FIG. 4, a fibrous member 132 (roll type) that supplies the lubricating material 14 to the surface of the photoreceptor 7 and a fibrous member 133 (planar brush type) that assists cleaning are used. These members may be optionally used where necessary.

As the charging device 8, for example, a contact charging device using an electroconductive or semiconductive charging roller, a charging brush, a charging film, a charging rubber blade, a charging tube or the like may be used. Alternatively, a non-contact roller charging device, a charging device known per se such as a scorotron charging device and a corotron charging device utilizing corona discharge, or the like may also be used.

Although not depicted in the drawing, a photoreceptor heating member for increasing the temperature of the electrophotographic photoreceptor 7 and decreasing the relative temperature may be disposed around the electrophotographic photoreceptor 7 for the purpose of improving the stability of the image.

As the exposure device 9, examples thereof include an optical device that expose the surface of the photoreceptor 7 to light such as semiconductor laser light, LED light and liquid crystal shutter light in the shape of a desired image, or the like. The wavelength used for a light source is one at the spectrum-sensitive area of the photoreceptor. The widely used wavelength of the semiconductor laser is near infrared having an oscillation wavelength near 780 nm. However, the wavelength is not limited to this wavelength, and laser having an oscillation wavelength of 600 nms or blue laser having an oscillation wavelength near 400 nm or more and 450 nm or less may also be utilized. Furthermore, for color image forming, a surface-emitting type laser light source capable of multibeam output may be used.

As the developing device 11, for example, a general developing device that develops by contacting or not contacting a magnetic or non-magnetic, one component or two compartment developer and the like may be used. The developing device is not specifically limited as long as it has the above-mentioned function, and is selected according to the purpose. Examples may include known developing devices having a function to attach the one component developer or the two component developer to the photoreceptor 7 using a brush, roller or the like, and the like. Of these, a device using a developing roller that retains a developer on the surface is preferable.

As the toner to be used for the developing device 11, the above-mentioned toner is used.

Examples of the transfer device 40 may include a contact transfer charging device using a belt, a roller, a film, a rubber blade and the like, transfer charging devices known per se such as a scorotron transfer charging device using corona discharge and a corotron transfer charging device, and the like.

As the intermediate transfer body 50, a belt-like material (intermediate transfer belt) such as those made of polyimide, polyamideimide, polycarbonate, polyarylate, polyester, rubber and the like having semiconductivity (intermediate transfer belt) is used. Furthermore, the intermediate transfer body 50 of a drum-like shape may be used.

The image forming apparatus 100 may include, for example, a photo-eraser that photo-erases charges of the photoreceptor 7, in addition to the above-mentioned devices.

Figure 5:
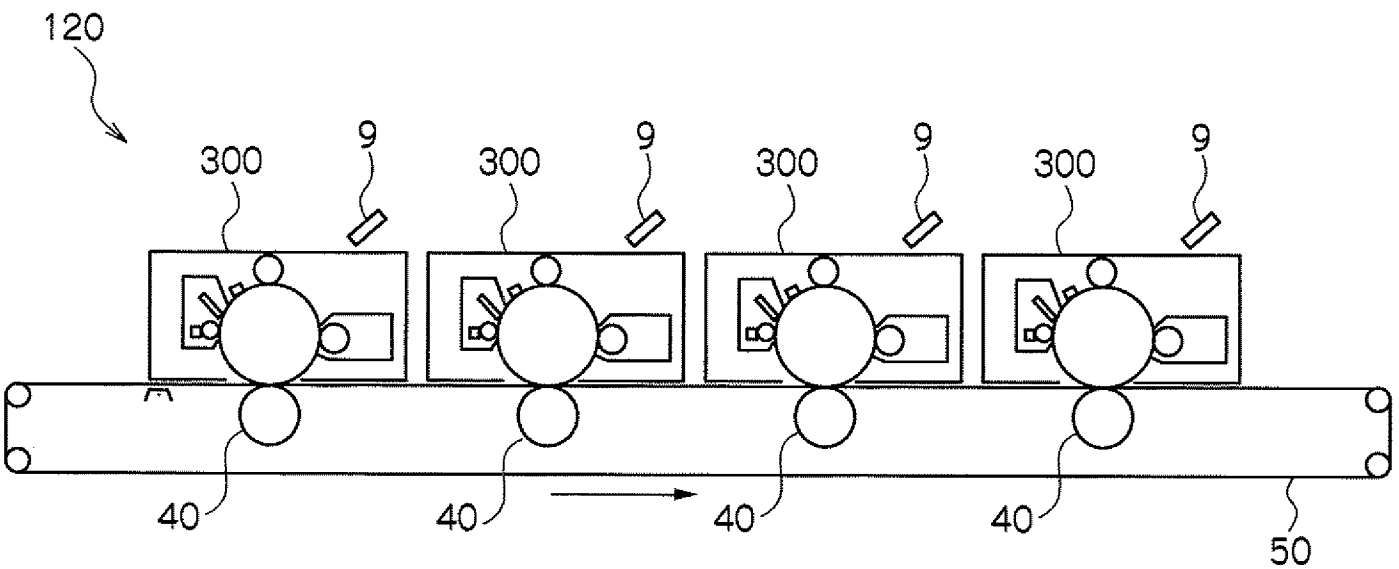
FIG. 5 is a schematic constitutional view of another image forming apparatus of an exemplary embodiment.

FIG. 5 is a schematic cross-sectional drawing showing an image forming apparatus according to another exemplary embodiment. As shown in FIG. 5, the image forming apparatus 120 is a tandem-type full color image forming apparatus having four process cartridges 300. The image forming apparatus 120 has a constitution in which four process cartridges 300 are arranged in a line on the intermediate transfer body 50, and one electrophotographic photoreceptor is used per one color The image forming apparatus 120 has a similar constitution to that of the image forming apparatus 100 except that it is tandem-type.

Where the electrophotographic photoreceptor of the invention is used for the tandem-type image forming apparatus, the electric property of the four photoreceptors may become stable, and thus image quality having excellent color balance may be obtained for a longer time period.

Furthermore, in the image forming apparatus (or process cartridge) of the present exemplary embodiment, the developing device (developing unit) is preferably one having a holder for holding a developer containing a magnetic body and used for developing electrostatic latent images using a two component developer including a magnetic carrier and a toner. By this constitution, finer image quality may be obtained in color images as compared to the case where a one component developer, specifically a non-magnetic one component developer is used, and higher image quality and longer lifetime may be realized at a high level.

EXAMPLES

Hereinafter the invention is further specifically explained with referring to Examples and Comparative Examples, but the invention is not limited to the following Examples in any way.

Photoreceptor 1

<Undercoat Layer>

Zinc oxide (average particle size: 70 nm, manufactured by Tayca Corporation, specific surface area value: 15 $m^2/g$) (100 parts by weight) is mixed with toluene (500 parts by weight) while stirring, a silane coupling agent (trade name: KBM603, manufactured by Shin-Etsu Chemical Co., Ltd.) (1.25 parts by weight) is added thereto, and this mixture is stirred for 2 hours. Toluene is then distilled off under reduced pressure, and the residue is baked at 120° C. for 3 hours to give a zinc oxide pigment whose surface has been treated with a silane coupling agent.

The surface-treated zinc oxide (100 parts by weight) is mixed with tetrahydrofuran (500 parts by weight) while stirring, a solution of alizarin (1 part by weight) in tetrahydrofuran (50 parts by weight) is added thereto, and this mixture is stirred at 50° C. for 5 hours. The zinc oxide on which alizarin has been applied is then separated by filtration under reduced pressure and further dried at 60° C. under reduced pressure to give an alizarin-coated zinc oxide pigment.

A solution (38 parts by weight) in which the alizarin-coated zinc oxide pigment (60 parts by weight), a blocked isocyanate as a curing agent (trade name: SUMIDUL 3175, manufactured by Sumitomo Bayer Urethane Co. Ltd.) (13.5 parts by weight) and a butyral resin (trade name: S-LEC BM-1, manufactured by Sekisui Chemical Co., Ltd.) (15 parts by weight) has been dissolved in methyl ethyl ketone (85 parts by weight) is mixed with methylethylketone (25 parts by weight), and the mixture is dispersed using glass beads (1 mmϕ) by a sand mill for 2 hours to give a dispersion liquid.

Dioctyltin dilaurate as a catalyst (0.005 parts by weight) and silicone resin particles (trade name: TOSPEARL 145, manufactured by GE Toshiba Silicones Co., Ltd.) (40 parts by weight) are added to the obtained dispersion liquid, and the mixture is cured by drying at 170° C. for 40 minutes to give a coating liquid for undercoat layer. The coating liquid is applied on an aluminum substrate having a diameter of 30 mm, a length of 404 mm and a thickness of 1 mm by soaking coating process to give an undercoat layer having a thickness of 21 μm.

<Charge Generating Layer>

Next, as a charge generating material on the aluminum substrate, chlorogallium phthalocyanine crystal (1 parts by weight) whose Bragg's angle in an X-ray diffraction spectrum (2θ±0.2°) has strong diffraction peaks at 7.4°, 16.6°, 25.5° and 28.3°, is added, together with a polyvinylbutyral resin (trade name: S-LEC BM-S, manufactured by Sekisui Chemical Co., Ltd.) (1 parts by weight), to butyl acetate (100 parts by weight), and the mixture is dispersed together with glass beads using a paint shaker for 1 hour. The obtained coating liquid is applied on the surface of the undercoat layer by soaking, and dried at 100° C. for 10 minutes to form an charge generating layer having a thickness of 0.2 μm.

<Charge Transporting Layer>

Furthermore, a coating liquid obtained by dissolving compound 1 represented by the following formula (2 parts by weight) and the polymer compound represented by the following structural formula 1 (viscosity average molecular weight: 39,000) (3 parts by weight) in tetrahydrofuran (10 parts by weight) and toluene (5 parts by weight) is applied on the surface of the charge generating layer by soaking, and dried by heating at 135° C. for 35 minutes to form a charge transporting layer having a film thickness of 22 μm.

Compound 1

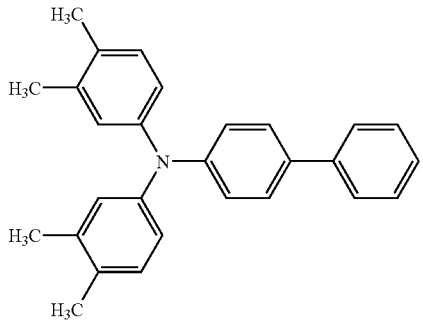

Structural Formula 1

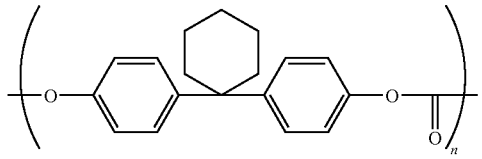

<Surface Protective Layer>

Next, compound 2 represented by the following formula (9.4 parts by weight), cyclopentanol (35 parts by weight), tetrahydrofuran (9 parts by weight) and distilled water (0.9 part by weight) are mixed. An ion exchanged resin (trade name: AMBERLYST 15E:Rohm & Haas Co., Ltd.) (0.5 part by weight) is added to the mixture and stirred at room temperature to perform hydrolysis for 2 hours. Furthermore, a benzoguanamine resin (trade name: NIKALAC BL-60, manufactured by Sanwa Chemical Co., Ltd.) (0.5 part by weight), dimethylpolysiloxane (trade name: GRANOL 450, manufactured by Kyoeisha Chemical Co., Ltd.) (0.1 part by weight) and NACURE2500 (trade name, manufactured by King Industry) (0.01 part by weight) are added to prepare a coating liquid for forming a protective layer. The coating liquid for surface protective layer is applied on the charge transporting layer by soaking coating process and dried at 155° C. for 45 minutes to form a surface protective layer having a film thickness of about 7 μm on the photoreceptor, and the thus obtained photoreceptor is used as photoreceptor 1.

Compound 2

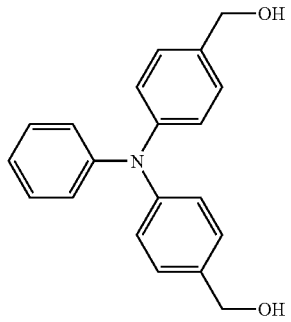

Photoreceptor 2

A photoreceptor is obtained in a similar manner to that of photoreceptor 1 except that the amount of compound 2 is 9.35 parts by weight the benzoguanarnine resin is changed to a methylated melamine resin (B-2, trade name: NIKALAK MW-30HM, manufactured by Sanwa Chemical Co., Ltd.) and the amount of dimethylpolysiloxane is 0.2 part by weight in the preparation of the surface protective layer for the photoreceptor 1, and the thus obtained photoreceptor is used as photoreceptor 2.

Photoreceptor 3

A photoreceptor is obtained in a similar manner to that of photoreceptor 1 except that compound 3 represented by the following formula (the compound listed above as I-21) (9.7 parts by weight) is used instead of Compound 2 and the amount of the benzoguanamine resin is 0.2 parts by weight in the preparation of the surface protective layer for photoreceptor 1, and the thus obtained photoreceptor is used as photoreceptor 3.

Compound 3

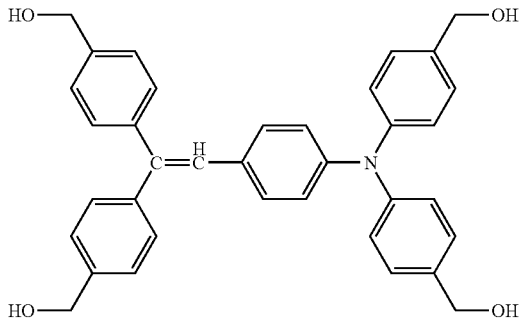

Photoreceptor 4

A photoreceptor is obtained in a similar manner to that of photoreceptor 3 except that a methylated melamine resin (B-2, trade name: NIKALAK MW-30HM, manufactured by Sanwa Chemical Co., Ltd.) is used instead of the benzoguanamine resin in the preparation of the surface protective layer for photoreceptor 3, and the thus obtained photoreceptor is used as photoreceptor 4.

Photoreceptor 5

A photoreceptor is obtained in a similar manner to that of photoreceptor 1 except that the amount of compound 2 is 8.45 parts by weight, the amount of the benzoguanamine resin is 0.5 part by weight and the amount of dimethylpolysiloxane is 0.05 part by weight, and a butyral resin (trade name: S-LEC BL-1, manufactured by Sekisui Chemical Co., Ltd) (1 part by weight) is added in the preparation of the surface protective layer for photoreceptor 1, and the thus obtained photoreceptor is used as photoreceptor 5.

Photoreceptor 6

A photoreceptor is obtained in a similar manner to that of photoreceptor 2 except that the amount of compound 2 is 7.4 parts by weight, the amount of methylated melamine resin is 1.0 part by weight and the amount of dimethylpolysiloxane is 0.1 part by weight, and a butyral resin (trade name: S-LEC BL-1, manufactured by Sekisui Chemical Co., Ltd) (1.5 part by weight) is added in the preparation of the surface protective layer for photoreceptor 2, and the thus obtained photoreceptor is used as photoreceptor 6.

Photoreceptor 7

A photoreceptor is obtained in a similar manner to that of photoreceptor 5 except that the amount of the compound 2 is changed to 8.5 parts by weight and the amount of dimethylpolysiloxane is 1.0 part by weight in the preparation of the surface protective layer for photoreceptor 5, and the thus obtained photoreceptor is used as photoreceptor 7.

Photoreceptor 8

A photoreceptor is obtained in a similar manner to that of photoreceptor 6 except that the amount of the methylated melamine resin is changed to 2.5 parts by weight and the amount of dimethylpolysiloxane is changed to 0.05 part by weight in the preparation of the surface protective layer for photoreceptor 6, and the thus obtained photoreceptor is used as photoreceptor 8.

Photoreceptor 9

A photoreceptor is obtained in a similar manner to that of photoreceptor 1 except that the charge transporting layer is formed but the protective layer is not applied, and the thus obtained photoreceptor is used as photoreceptor 9.

Photoreceptor 10

A photoreceptor is obtained in a similar manner to that of photoreceptor 1 except that the benzoguanamine resin is changed to a resol-type phenol resin (trade name: PL-2215, manufactured by Gunei Chemical Industry Co., Ltd.) in the preparation of the surface protective layer for photoreceptor 1, and the thus obtained photoreceptor is used as photoreceptor 10.

Preparation of Cleaning Blade

Cleaning Blade 1

A rubber member including, as an edge layer, an urethane rubber (320 mm×15 mm) having a type A durometer hardness of HsA 81, a modulus of repulsion elasticity of 11%, a permanent elongation of 4%, and a thickness of 0.5 mm, and, as a base layer, an urethane rubber (320 mm×15 mm) having a type A durometer hardness of HsA 64, a modulus of repulsion elasticity of 33%, a permanent elongation of 0.5% and a thickness of 1.5 mm, is adhered to a support member made of a plated steel plate to prepare a cleaning blade for an electrophotograph apparatus. The thus obtained cleaning blade is used as cleaning blade 1.

Cleaning Blade 2

A cleaning blade is prepared in a similar manner to cleaning blade 1 except that an urethane rubber having a type A durometer hardness of HsA 88, a modulus of repulsion elasticity of 5.5%, a permanent elongation of 4% and a thickness of 0.5 mm is used for the edge layer, and the thus obtained cleaning blade is used as cleaning blade 2.

Cleaning Blade 3

A cleaning blade is prepared in a similar manner to cleaning blade 1 except that an urethane rubber having a type A durometer hardness of HsA 77, a modulus of repulsion elasticity of 19%, a permanent elongation of 1.5% and a thickness of 0.5 mm is used for the edge layer, and the thus obtained cleaning blade is used as cleaning blade 3.

Cleaning Blade 4

A cleaning blade is prepared in a similar manner to cleaning blade 1 except that an urethane rubber having a type A durometer hardness of HsA 93, a modulus of repulsion elasticity of 4%, a permanent elongation of 5% and a thickness of 0.5 mm is used for the edge layer, and the thus obtained cleaning blade is used as cleaning blade 4.

Cleaning Blade 5

A cleaning blade is prepared in a similar manner to cleaning blade 1 except that an urethane rubber having a type A durometer hardness of HsA 70, a modulus of repulsion elasticity of 25%, a permanent elongation of 2% and a thickness of 0.5 mm is used for the edge layer, and the thus obtained cleaning blade is used as cleaning blade 5.

Cleaning Blade 6

A cleaning blade is prepared in a similar manner to cleaning blade 1 except that an urethane rubber having a type A durometer hardness of HsA 73, a modulus of repulsion elasticity of 26%, a permanent elongation of 3% and a thickness of 1.5 mm is used for the base layer, and the thus obtained cleaning blade is used as cleaning blade 6.

Cleaning Blade 7

A cleaning blade is prepared in a similar manner to cleaning blade 1 except that an urethane rubber having a type A durometer hardness of HsA 62, a modulus of repulsion elasticity of 38%, a permanent elongation of 1.5% and a thickness of 1.5 mm is used for the base layer, and the thus obtained cleaning blade is used as cleaning blade 7.

Cleaning Blade 8

A cleaning blade is prepared in a similar manner to cleaning blade 1 except that an urethane rubber having a type A durometer hardness of HsA 76, a modulus of repulsion elasticity of 21%, a permanent elongation of 3% and a thickness of 1.5 mm is used for the base layer, and the thus obtained cleaning blade is used as cleaning blade 8.

Cleaning Blade 9

A cleaning blade is prepared in a similar manner to cleaning blade 1 except that an urethane rubber having a type A durometer hardness of HsA 58, a modulus of repulsion elasticity of 40%, a permanent elongation of 1% and a thickness of 1.5 mm is used for the base layer, and the thus obtained cleaning blade is used as cleaning blade 9.

Cleaning Blade 10

A elastic rubber member including, as an edge layer, an urethane rubber (320 mm×15 mm) having a type A durometer hardness of HsA 70, a modulus of repulsion elasticity of 25%, a permanent elongation of 2%, and a thickness of 0.5 mm, and, as a base layer, an urethane rubber (320 mm×15 mm) having a type A durometer hardness of HsA 76, a modulus of repulsion elasticity of 21%, a permanent elongation of 3% and a thickness of 1.5 mm, is attached to a support member made of a plated steel plate to prepare a cleaning blade for an electrophotograph apparatus. The thus obtained cleaning blade is used as cleaning blade 10.

Preparation of Developer

In the following explanation, the physical characteristic values are measured according to the following methods.

<Particle Size Distributions of Toner Particles and Hybrid Particles>

They are measured using MULTISIZER (trade name, manufactured by Nikkaki Bios Co., Ltd) having an aperture diameter of 100 μm.

<Average Shape Factors ($ML^2/A$) of Toner Particles and Hybrid Particles>

The toner particles or compound particles are observed by an optical microscope, and the image thereof is imported into an image analyzer (trade name: LUZEX III, manufactured by Nireco Corporation) and the circle-equivalent diameter is measured. The value of shape factor ($ML^2/A$) is then obtained for each particle according to the following equation (i) from the maximum length and the projection area of the toner particles or hybrid particles, and an average shape factor is obtained by calculating the number average per 100 toner particles.

$$(ML^2/A)=(\text{maximum length})^2\pi\times100/[4\times(\text{projection area})] \quad \text{(i)}$$

(Developer-1)

Production of Toner Mother Particles

<Preparation of Dispersion Liquid of Resin Particles>

A solution obtained by mixing and dissolving styrene (370 g), n-butyl acrylate (30 g), acrylic acid (8 g), dodecanethiol (24 g) and carbon tetrabromide (4 g) is mixed with a solution obtained by mixing dissolving a nonionic surfactant (trade name: NONIPOL 400, manufactured by Sanyo Chemical Industries, Ltd.) (6 g) and an anionic surfactant (trade name: NEOGEN SC, manufactured by Dai-Ichi Kogyou Seiyalcu Co., Ltd.) (10 g) in ion exchanged water (550 g) to initiate emulsion polymerization in a flask. Ion exchanged water (50 g) in which ammonium persulfate (4 g) has been dissolved is added to this mixed solution while the mixed solution is gently stirred for 10 minutes. The air in the flask is replaced with nitrogen, and the mixed solution is heated in an oil bath under stirring until the temperature of the mixed solution becomes 70° C., and the emulsion polymerization is continued for 5 hours. As a result, a dispersion liquid of resin particles in which resin particles having an average particle size of 150 nm, a glass transition temperature (Tg) of 58° C. and a weight average molecular weight (Mw) of 11,500 has been dispersed is obtained. The solid content concentration of the dispersion liquid is 40% by weight.

<Preparation of Colorant Dispersion Liquid-1>

Carbon black (trade name: MOGAL L, manufactured by Cabot Corporation) (60 g), a nonionic surfactant (trade name: NONIPOL 400, manufactured by Sanyo Chemical Industries, Ltd.) (6 g) and ion exchanged water (240 g) are mixed, and the mixture is stirred using a homogenizer (trade name: ULTRA TURRAX T50, manufactured by IKA) for 10 minutes. The mixture is then subjected to a dispersing treatment using ULTIMIZER to prepare colorant dispersion liquid-1 in which colorant (carbon black) particles having an average particle size of 250 nm have been dispersed.

<Preparation of Dispersion Liquid of Releasing Agent>

Paraffin wax (trade name: HNP 0190, manufactured by Nippon Seiro Co., Ltd., melting point: 85° C.) (100 g), a cationic surfactant (trade name: SANISOL B50, manufactured by Kao Corporation) (5 g) and ion exchanged water (240 g) are mixed, and this mixture is dispersed in a round flask made of stainless steel using a homogenizer (trade name: ULTRA TURRAX T50, manufactured by IKA) for 10 minutes. The resulting mixture is then subjected to a dispersing treatment using a pressure ejection type homogenizer to prepare a dispersion liquid of a releasing agent in which releasing agent particles having an average particle size of 550 nm have been dispersed.

<Preparation of Toner Mother Particles K1>

The above-mentioned dispersion liquid of resin particles (234 parts by weight), colorant dispersion liquid-1 (30 parts by weight), the dispersion liquid of the releasing agent (40 parts by weight), polyaluminum hydroxide (trade name: Paho2S, manufactured by Asada Chemical Industry Co., Ltd.) (0.5 parts by weight) and ion exchanged water (600 parts by weight are placed in a round flask made of stainless steel, and mixed and dispersed using a homogenizer (trade name: ULTRA TURRAX T50, manufactured by IKA). The mixed liquid is heated in an oil bath for heating while being stirred and retained at 40° C. for 30 minutes. At that time, generation of aggregated particles having $D_{50}$ of 4.5 μm in the mixed liquid is confirmed. Furthermore, the temperature of the oil bath for heating is raised and the mixed liquid is further retained at 56° C. for 1 minute, whereby $D_{50}$ becomes 5.3 μm. The dispersion liquid of the resin particles (26 parts by weight) is added to this dispersion liquid including the aggregated particles, and the mixture is retained at 50° C. for 30 minutes using the oil bath for heating. 1N sodium hydroxide is added to this dispersion liquid including the aggregated particles to adjust the pH of the dispersion liquid to 7.0, the flask is sealed, and the mixture is heated at 80° C. for 4 hours using a magnetic seal while the stirring is continued. The dispersion liquid is cooled, and the toner mother particles generated in the dispersion liquid are separated by filtration, washed with ion exchanged water four times and lyophilized to give the toner mother particles K1. The $D_{50}$ is 5.9 μm and the average shape factor is 132 for the toner mother particles K1.

<Production of Carrier>

A coating liquid is prepared by mixing toluene (14 parts by weight), a styrene-methacrylate copolymer (component ratio: 90/10) (2 parts by weight) and carbon black (trade name: R330, manufactured by Cabot Corporation) (0.2 parts) and subjecting the mixture to a dispersion treatment by stirring using a stirrer for 10 minutes. The coating liquid and ferrite particles (average particle size: 50 μm) (100 parts by weight) are placed in a vacuum degassing kneader, and the mixture is stirred at 60° C. for 30 minutes, and dried by degassing under reduced pressure with heating to give a carrier. The carrier has a volume resistivity of $10^{11}$ Ω·cm when 1000 V/cm of electric field is applied.

<Preparation of Toner-1 and Developer-1>

The toner mother particles K1 (100 parts by weight), rutile-type titanium oxide (particle size: 20 nm, treated with n-decyltrimethoxysilane) (1 part by weight), silica (particle size: 40 nm, prepared by vapor phase oxidation method and treated with silicone oil) (2.0 parts by weight), cerium oxide (average particle size: 0.7 μm) (1 part by weight) and a higher aliphatic acid alcohol (obtained by milling a higher aliphatic acid alcohol having a molecular weight of 700 in a jet mill so as to have an average particle size of 8.0 μm) (0.3 parts by weight) are blended in a 5 L HENSCHEL mixer at a peripheral speed of 30 m/s for 15 minutes.

The coarse particles are then removed using a sieve having a mesh of 45 μm to give toner-1 (black). Furthermore, the carrier (100 parts by weight) and toner-1 (5 parts by weight) are mixed and stirred using a V-blender at 40 rpm for 20 minutes and the resulting mixture is sieved using a sieve having a mesh of 212 μm to give developer-1 (black), (Developer-2)

A developer is prepared in a similar manner to the preparation of toner-1 and developer-1 except that silica is not used, and the thus obtained developer is used as developer 2.

<Explanation on Measurement Method of Surface Free Energy>

The surface free energy of the surface protective layer of each photoreceptor can be obtained by using reagents whose dipolar component, dispersion component and hydrogen-bonding component of the surface free energy are already known, and measuring the adhesion to the reagents.

Specifically, the surface free energy of each component can be calculated by using pure water, methylene iodide, α-bromonaphthalene and sodium dodecylsulfate as reagents, measuring a contact angle to a surface of the photoreceptor using a contact angle meter (trade name: CA-X, manufactured by Kyowa Interface Sciences Co., Ltd.), and calculating the surface free energy using a surface free energy analyzing software (trade name: EG-11, manufactured by Kyowa Interface Sciences Co., Ltd.) based on the measurement result. The reagents are not limited to the above-mentined pure water, methylene iodide, α-bromonaphthalene and sodium dodecylsulfate, and reagents having a suitable combination of dipolar component, dispersion component and hydrogen-bonding component may also be used.

In the present Examples, the contact angle is measured in an environment in which the room temperature is controlled to 22° C. to 24° C. and the humidity is controlled to 50% to 60%, and the reagents used for dropping are pure water and aqueous sodium dodecylsulfate solutions of two levels (2.7 mmol/L and 5.3 mmol/L). The droplet for dropping is 2.5 μL, and the period up to the measurement of the contact angles is 60 seconds after the dropping of the reagents, and the surface free energy is calculated using these contact angles using the surface free energy analyzing software (trade name: EG-11, manufactured by Kyowa Interface Sciences Co., Ltd.). For the measurement, unused photoreceptors that have not been mounted on an image forming apparatus or the like after preparation, is used.

The measured values of the surface free energies of the photoreceptors are shown in Table 1.

TABLE 1

| | Surface Free Energy of Surface Protective Layer (mN/m) |
|---|---|
| Photoreceptor 1 | 22.3 |
| Photoreceptor 2 | 13.7 |
| Photoreceptor 3 | 19.1 |
| Photoreceptor 4 | 17.9 |
| Photoreceptor 5 | 28.1 |
| Photoreceptor 6 | 31.2 |
| Photoreceptor 7 | 9.2 |
| Photoreceptor 8 | 32 |
| Photoreceptor 9 | 34.8 |
| Photoreceptor 10 | 24.8 |

Image Forming Test

Image forming tests are performed using photoreceptors 1 to 10, cleaning blades 1 to 10 and the developers in the combinations as shown in Table 2. As an experimental apparatus, DOCUCENTRE COLORE A450 (trade name, manufactured by Fuji Xerox Co., Ltd.) is used. In the tests, full-color images are formed on 100,000 sheets of A4-size paper at an image density of 5% under an environment of high temperature and high humidity (28° C., 80% RH), and the ghost, sneaking of the toner and amount of abrasion per 1000 revolutions (nm) are evaluated. Furthermore, comprehensive evaluation is made.

1. Evaluation of Ghosting

As shown in FIG. 7, a chart of a pattern having letters G and a black area is printed, the appearance of the letters G on the black solid part is visually observed, and ghosting is evaluated according to the following criteria.

Figure 7A:
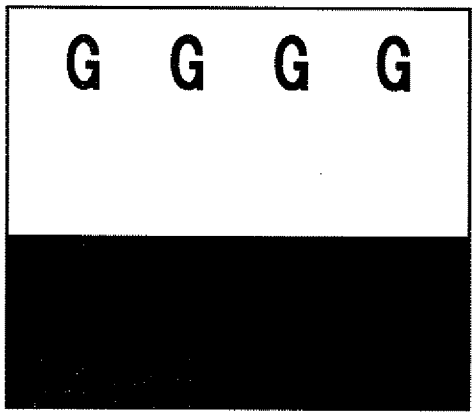
FIGS. 7A, 7B and 7C are drawings showing the evaluation pattern and evaluation criteria of ghosting.

A: Good or the characters are slightly observed as shown in FIG. 7A.

Figure 7B:
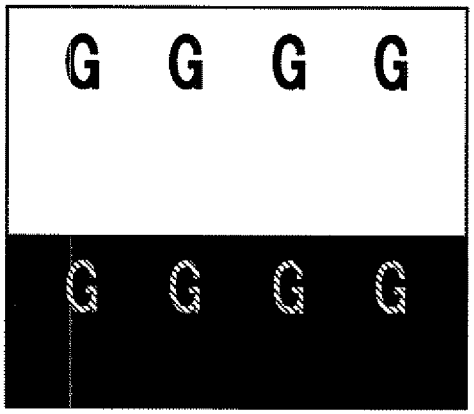

B: The characters are somewhat apparent as shown in FIG. 7B.

Figure 7C:
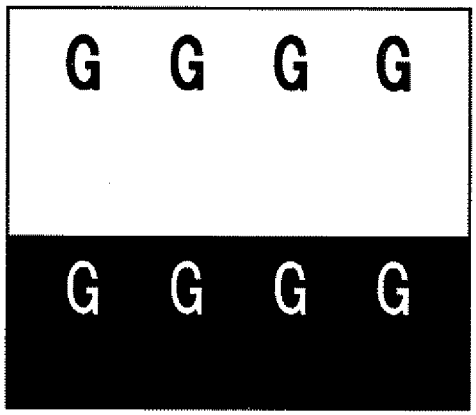

C: The characters are distinctly observed as shown in FIG. 7C.

2. Sneaking of Toner

Sneaking of the toner is confirmed by observing the degree of sneaking of the toner on the photoreceptor after cleaning of the images (paper size: A3, image density: Cin=100%, 5 sheets, not transferred), and evaluated according to the following criteria.

A: Good.

B: Partial (about 10% or less of the entire area) sneaking of the toner is observed.

C: Sneaking of the toner is observed in a broad area.

3. Amount of Abrasion

The amount of abrasion is measured at the time of the above-mentioned image forming test by measuring the initial film thickness in advance, measuring the difference between the initial film thickness and the film thickness after the images are formed on 100,000 sheets, and calculating the amount of abrasion (nm) per 1000 revolutions of the photoreceptor 4. Evaluation Criteria of Comprehensive Evaluation Comprehensive evaluation is made according to the following criteria based on the evaluation results of the ghosting, sneaking of the toner and the amount of abrasion.

A: Good.

B: Slightly poor, but practically non-problematic.

C: Unusable,

TABLE 2

| | Photoreceptor | Cleaning Blade | Developer | Ghost | Sneaking of Toner | Amount of Wearing (nm) | Comprehensive Evaluation |
|---|---|---|---|---|---|---|---|
| Example 1 | Photoreceptor 1 | Cleaning Blade 1 | Developer 1 | A | A | 4 | A |
| Example 2 | Photoreceptor 2 | Cleaning Blade 1 | Developer 1 | B | B | 3 | B |
| Example 3 | Photoreceptor 3 | Cleaning Blade 1 | Developer 1 | A | A | 3 | A |
| Example 4 | Photoreceptor 4 | Cleaning Blade 1 | Developer 1 | B | A | 2 | A |
| Example 5 | Photoreceptor 5 | Cleaning Blade 1 | Developer 1 | A | A | 5 | A |
| Example 6 | Photoreceptor 10 | Cleaning Blade 1 | Developer 1 | B | A | 3 | A |
| Example 7 | Photoreceptor 1 | Cleaning Blade 2 | Developer 1 | A | A | 4 | A |
| Example 8 | Photoreceptor 1 | Cleaning Blade 3 | Developer 1 | A | A | 4 | A |
| Example 9 | Photoreceptor 1 | Cleaning Blade 6 | Developer 1 | A | A | 4 | A |
| Example 10 | Photoreceptor 1 | Cleaning Blade 7 | Developer 1 | A | A | 4 | A |
| Example 11 | Photoreceptor 1 | Cleaning Blade 8 | Developer 1 | A | B | 4 | A |
| Example 12 | Photoreceptor 1 | Cleaning Blade 9 | Developer 1 | A | B | 4 | A |
| Comparative Example 1 | Photoreceptor 6 | Cleaning Blade 1 | Developer 1 | A | C | 7 | C |
| Comparative Example 2 | Photoreceptor 7 | Cleaning Blade 1 | Developer 1 | C | B | 5 | C |
| Comparative Example 3 | Photoreceptor 8 | Cleaning Blade 1 | Developer 1 | A | C | 8 | C |
| Comparative Example 4 | Photoreceptor 9 | Cleaning Blade 1 | Developer 1 | A | A | 20 | C |
| Comparative Example 5 | Photoreceptor 1 | Cleaning Blade 10 | Developer 1 | A | C | 6 | C |
| Comparative Example 6 | Photoreceptor 2 | Cleaning Blade 10 | Developer 1 | B | C | 4 | C |
| Comparative Example 7 | Photoreceptor 1 | Cleaning Blade 1 | Developer 2 | A | C | 2 | C |
| Comparative Example 8 | Photoreceptor 2 | Cleaning Blade 1 | Developer 2 | A | C | 2 | C |
| Comparative Example 9 | Photoreceptor 1 | Cleaning Blade 4 | Developer 1 | B | B | 8 | C |
| Comparative Example 10 | Photoreceptor 1 | Cleaning Blade 5 | Developer 1 | B | C | 4 | C |

As shown in Table 2, in Examples, the removability of the toner remained on the surface of the electrophotographic photoreceptor after the toner image is transferred to the medium is more excellent, and good images can be obtained repetitively for a long time period, as compared to Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments are chosen and described in order to best explain the principles of the invention and its practical applications, thereby enabling others skilled in the art to understand the invention for various embodiments and with the various modifications as are suited to the particular use contemplated.

What is claimed is:

1. An image forming apparatus, comprising:

an electrophotographic photoreceptor comprising an electroconductive substrate, and a photosensitive layer and a surface protective layer disposed on the electroconductive substrate in this order;

a charging unit that charges the electrophotographic photoreceptor;

an electrostatic latent image forming unit that forms an electrostatic latent image on the charged electrophotographic photoreceptor;

a developing unit that develops the electrostatic latent image formed on the electrophotographic photoreceptor using a toner to form a toner image;

a transfer unit that transfers the toner image on a transfer medium; and a residual toner removing unit that removes the toner remaining on the electrophotographic photoreceptor after transfer of the toner image, the surface protective layer of the electrophotographic photoreceptor having a surface free energy of from 10 mN/m to 30 mN/m, and comprising a crosslinked product of a composition comprising:

at least one compound selected from the group consisting of a compound having a guanamine structure and a compound having a melamine structure, and at least one charge transporting material that includes at least one substituent selected from the group consisting of —OH, —$OCH_3$, —$NH_2$, —SH and —COOH, wherein the solid content concentration of the charge transporting material in the composition is 80% by weight or more, and wherein the solid content concentration of the at least one compound selected from the group consisting of a compound having a guanamine structure and a compound having a melamine structure in the composition is from 0.1% by weight to 5% by weight, the toner in the developing unit comprising silica, and the residual toner removing unit comprising a blade member including a base layer and an edge layer having a type A durometer hardness of from HsA 75 to HsA 90 at 23° C., the hardness of the edge layer being higher than the hardness of the base layer.

2. The image forming apparatus of claim 1, wherein the charge transporting material includes from three to four substituents selected from the group consisting of —OH, —$OCH_3$, —$NH_2$, —SH and —COOH.

3. The image forming apparatus of claim 1, wherein the charge transporting material is a compound represented by the following formula (I):

$$F—((—R^7—X)_{n1}(R^8)_{n2}Y)_{n3} \qquad \text{Formula (I)}$$

wherein F is an organic group derived from a positive hole-transporting compound, $R^7$ and $R^8$ are each independently a linear or branched alkylene group having from 1 to 5 carbon atoms, n1 is 0 or 1, n2 is 0 or 1, n3 is an integer of from 1 to 4, X is an oxygen atom, NH or a sulfur atom, and Y is —OH, —$OCH_3$, —$NH_2$, —SH or —COOH.

4. The image forming apparatus of claim 1, wherein the charge transporting material includes from two to four substituents selected from the group consisting of —OH, —$OCH_3$, —$NH_2$, —SH and —COOH.

5. The image forming apparatus of claim 1, wherein the edge layer in the blade member of the residual toner removing unit has a type A durometer hardness of from HsA 75 to HsA 90 at 23° C., and the base layer has a type A durometer hardness of from HsA 60 to HsA 75 at 23° C.

6. The image forming apparatus of claim 1, wherein the edge layer in the blade member of the residual toner removing unit has a modulus of repulsion elasticity of from 5% to 20%.

7. The image forming apparatus of claim 1, wherein the base layer in the blade member of the residual toner removing unit has a modulus of repulsion elasticity of from 25% to 40%.

8. The image forming apparatus of claim 1, wherein the toner in the developing unit has an average shape factor of from 100 to 150.

9. A process cartridge, comprising:

an electrophotographic photoreceptor; and at least one selected from the group consisting of a residual toner removing unit that removes the toner remaining on a surface of the electrophotographic photoreceptor, a charging unit that charges the electrophotographic photoreceptor, and a developing unit that develops an electrostatic latent image formed on the electrophotographic photoreceptor using a toner to form a toner image, the electrophotographic photoreceptor comprising an electroconductive substrate, and a photosensitive layer and a surface protective layer disposed on the electroconductive substrate in this order, the surface protective layer of the electrophotographic photoreceptor having a surface free energy of from 10 mN/m to 30 mN/m, and comprising a crosslinked product of a composition comprising:

at least one compound selected from the group consisting of a compound having a guanamine structure and a compound having a melamine structure, and at least one charge transporting material that includes at least one substituent selected from the group consisting of —OH, —$OCH_3$, —$NH_2$, —SH and —COOH, wherein the solid content concentration of the charge transporting material in the composition is 80% by weight or more, and wherein the solid content concentration of the at least one compound selected from the group consisting of a compound having a guanamine structure and a compound having a melamine structure in the composition is from 0.1% by weight to 5% by weight, the toner in the developing unit comprising silica, and the residual toner removing unit comprising a blade member including a base layer and an edge layer having a type A durometer hardness HsA of from 75 to 90 at 23° C., the hardness of the edge layer being higher than the hardness of the base layer.

10. The process cartridge of claim 9, wherein the charge transporting material includes from two to four substituents selected from the group consisting of —OH, —$OCH_3$, —$NH_2$, —SH and —COOH.

11. The process cartridge of claim 9, wherein the charge transporting material includes from three to four substituents selected from the group consisting of —OH, —$OCH_3$, —$NH_2$, —SH and —COOH.

12. The process cartridge of claim 9, wherein the charge transporting material is a compound represented by the following formula (I):

$$F—((—R^7—X)_{n1}(R^8)_{n2}Y)_{n3} \quad (I)$$

wherein F is an organic group derived from a positive hole-transporting compound, $R^7$ and $R^8$ are each independently a linear or branched alkylene group having from 1 to 5 carbon atoms, n1 is 0 or 1, n2 is 0 or 1, n3 is an integer of from 1 to 4, X is an oxygen atom, NH or a sulfur atom, and Y is —OH, —$OCH_3$, —$NH_2$, —SH or —COOH.

13. The process cartridge of claim 9, wherein the edge layer in the blade member of the residual toner removing unit has a type A durometer hardness of from HsA 75 to HsA 90 at 23° C., and the base layer has a type A durometer hardness of from HsA 60 to HsA 75 at 23° C.

14. The process cartridge of claim 9, wherein the edge layer in the blade member of the residual toner removing unit has a modulus of repulsion elasticity of from 5% to 20%.

15. The process cartridge of claim 9, wherein the base layer in the blade member of the residual toner removing unit has a modulus of repulsion elasticity of from 25% to 40%.

16. The process cartridge of claim 9, wherein the toner in the developing unit has an average shape factor of from 100 to 150.

* * * * *